US005483255A

United States Patent [19]

Numao

[11] Patent Number: 5,483,255

[45] Date of Patent: Jan. 9, 1996

[54] DISPLAY CONTROLLER FOR LIQUID CRYSTAL PANEL STRUCTURE

[75] Inventor: Takaji Numao, Nara, Japan

[73] Assignee: Sharp Kabushiki Kaisha, Osaka, Japan

[21] Appl. No.: 972,043

[22] Filed: Nov. 5, 1992

[30] Foreign Application Priority Data

Nov. 7, 1991 [JP] Japan ..... 3-291699
Sep. 7, 1992 [JP] Japan ..... 4-238619

[51] Int. Cl.[6] ..... G09G 3/36

[52] U.S. Cl. ..... 345/98; 345/87

[58] Field of Search ..... 340/784, 765, 340/811, 805, 799; 359/54, 55; 358/236, 241; 345/98, 99, 100, 103, 185, 201, 200; 348/790, 792, 793

[56] References Cited

U.S. PATENT DOCUMENTS

| | | | |
|---|---|---|---|
| 4,430,648 | 2/1984 | Togashi | 340/784 |
| 4,714,921 | 12/1987 | Kanno et al. | 340/784 |
| 5,034,735 | 7/1991 | Inoue et al. | 340/784 |
| 5,111,195 | 5/1992 | Fukuoka et al. | 340/811 |

FOREIGN PATENT DOCUMENTS

| | | |
|---|---|---|
| 0435701 | 7/1991 | European Pat. Off. . |
| 0492542 | 7/1992 | European Pat. Off. . |

OTHER PUBLICATIONS

Japanese Unexamined Patent Publication No. 59389/1989.
Japanese Unexamined Patent Publication No. 298286/1988.

*Primary Examiner*—Richard Hjerpe
*Assistant Examiner*—Xiao M. Wu
*Attorney, Agent, or Firm*—David G. Conlin; Kevin J. Fournier

[57] ABSTRACT

A display controller for a liquid crystal panel has a display data storage device for storing data on a state of a pixel as display data for each pixel, an identity/non-identity data storage device for storing data, as identity/non-identity discerning data, on whether a difference takes place between a pixel state to be displayed and a pixel state displayed for each pixel group, and an identification data storage device for storing data, as identification data, on whether a pixel is included whose state to be displayed differs from a state displayed for each scanning electrode group. The identification data storage device includes a data selecting part for deciding which scanning electrode group should be selected in a next scan, and a data erasing part for deciding whether the identity/non-identity data on a related pixel should be erased. These two parts change the storage contents to indicate a change in the display each time the state of a related pixel changes, and thereafter the data selecting storage part changes the storage content to indicate no change in the display when the related scanning electrode group is to be selected, and the data erasing part changes the storage content to be the same as in the data selecting part when the related scanning electrode group has been scanned.

5 Claims, 51 Drawing Sheets

(1) Voltage of scanning electrode Lo (2) Voltage of scanning electrode L1

(3) Voltage of scanning electrode L2

(4) Voltage of signal electrode S1

(5) Voltage of signal electrode S2

(6) Voltage of signal electrode S5

(7) Voltage of Pixel A11

(8) Voltage of pixel A21

(9) Voltage of pixel A22

(10) Voltage of pixel A25

DISPLAY CONTROLLER FOR LIQUID CRYSTAL PANEL STRUCTURE

FIELD OF THE INVENTION

The present invention relates to a display controller for a liquid crystal panel structure, and more particularly to a display controller for a ferroelectric liquid crystal (hereinafter referred to as an FLC) panel structure.

DESCRIPTION OF THE RELATED ART

FIG. 31 is a section view schematically showing the structure of an FLC panel according to the prior art. In an FLC panel structure 26 according to the prior art, glass substrates 5*a* and 5*b* are provided opposite to each other. A plurality of signal electrodes S are provided in parallel with one another on the surface of the glass substrate 5*a*. The signal electrodes S consist of indium tin oxide (hereinafter referred to as ITO) and are covered by a transparent insulating film 6*a* which consists of $SiO_2$. A plurality of scanning electrodes L are provided in parallel with one another and perpendicularly to the signal electrodes S on the surface of the glass substrate 5*b* which is opposite to the signal electrodes S. The scanning electrodes L consist of ITO and are covered by a transparent insulating film 6*b* which consists of $SiO_2$. On the insulating films 6*a* and 6*b* are formed orientation films 7*a* and 7*b* which are subjected to rubbing processing and consist of polyvinyl alcohol and the like.

The glass substrates 5*a* and 5*b* are stuck together by a sealing agent 8 with an inlet left. An FLC 9 is introduced into a space interposed between the orientation films 7*a* and 7*b* through the inlet by vacuum injection. Then, the inlet is sealed by the sealing agent 8. The glass substrates 5*a* and 5*b* thus stuck together are interposed between polarizing plates 10*a* and 10*b*. The polarizing plates 10*a* and 10*b* are provided in such a manner that their polarizing axes are perpendicular to each other.

FIG. 32 is a plan view showing the structure of an FLC display (hereinafter referred to as an FLCD) 27 in which the scanning electrodes L and signal electrodes S of the FLC panel 26 having a simple matrix structure are connected to a scanning side drive circuit 28 and a signal side drive circuit 29, respectively. The scanning side drive circuit 28 serves to apply a voltage to the scanning electrodes L. The signal side drive circuit 29 serves to apply a voltage to the signal electrodes S.

For simplicity, there will be described an FLCD 4 which has 9 scanning electrodes L and 8 signal electrodes S, that is, which is formed by 9×8 pixels. Each scanning electrode L is coded by adding a subscript i (i=0 to 8) to a character L. Each signal electrode S is coded by adding a subscript j (j=0 to 7) to a character S. In the following description, a pixel in a portion or cell where a given scanning electrode Li and a given signal electrode Sj intersect each other is indicated at Aij.

FIG. 30 is a block diagram schematically showing the structure of a display system using the FLCD 27. Referring to the display system, information necessary for image display is obtained from a digital signal which is outputted from a personal computer 2 to a CRT display 3, and a display controller 25 converts the digital signal into a signal for causing the FLCD 27 to perform image display. Based on a conversion signal thus obtained, image display is performed by the FLCD 27.

FIG. 4 is a waveform diagram for each signal outputted from the personal computer 2 to the CRT display 3. FIG. 4 (1) shows a horizontal synchronous signal HD which gives a cycle for a horizontal scanning section of image information outputted to the CRT display 3. FIG. 4 (2) shows a vertical synchronous signal VD which gives a cycle for a screen of the image information. FIG. 4 (3) collectively shows the image information as display data Data for each horizontal scanning section, in which numerals are attached to correspond to the scanning electrode Li of the FLCD 27.

FIG. 4 (4) is an enlarged waveform diagram showing the horizontal scanning section of the horizontal synchronous signal HD. FIG. 4 (5) is an enlarged waveform diagram showing the horizontal scanning section of the display data Data, in which numerals are attached to correspond to the signal electrode Sj of the FLCD 27. FIG. 4 (6) is a waveform diagram showing a data transfer clock CLK for each pixel of the display data Data.

Japanese Unexamined Patent Publication No. 59389/1989 has disclosed a method for driving the FLCD 27. FIG. 10 is a waveform diagram showing an example of the waveform of each voltage applied to the scanning electrodes L and signal electrodes S which are used for the driving method. FIG. 10 (1) shows the waveform of a selection voltage A which is applied to the scanning electrode L so as to change or rewrite the memory state of pixels thereon, that is, the state of luminance brightness. FIG. 10 (2) shows the waveform of a non-selection voltage B which is applied to other scanning electrodes L so as not to change the display state of pixels thereon.

FIG. 10 (3) shows the waveform of a rewriting dark voltage C which is applied to the signal electrode S so as to change, into the state of "dark", the display state of pixels on the scanning electrode L to which the selection voltage A is applied. FIG. 10 (4) shows the waveform of a rewriting bright voltage D which is applied to the signal electrode S so as to change, into the state of "bright", the display state of pixels on the scanning electrode L to which the selection voltage A is applied. FIG. 10 (5) shows the waveform of a non-rewriting voltage G which is applied to the signal electrode S so as not to change the display state of pixels on the scanning electrode L to which the selection voltage A is applied.

FIGS. 10 (6) to (11) show the waveforms of effective voltages applied to the pixel Aij. FIG. 10 (6) shows a waveform A-C of a voltage which is applied to the pixel Aij when the selection voltage A is applied to the scanning electrode Li and the rewriting dark voltage C is applied to the signal electrode Sj. FIG. 10 (7) shows a waveform A-D of a voltage which is applied to the pixel Aij when the selection voltage A is applied to the scanning electrode Li and the rewriting bright voltage D is applied to the signal electrode Sj. FIG. 10 (8) shows a waveform A-G of a voltage which is applied to the pixel Aij when the selection voltage A is applied to the scanning electrode Li and the non-rewriting voltage G is applied to the signal electrode Sj. FIG. 10 (9) shows a waveform B-C of a voltage which is applied to the pixel Aij when the non-selection voltage B is applied to the scanning electrode Li and the rewriting dark voltage C is applied to the signal electrode Sj. FIG. 10 (10) shows a waveform B-D of a voltage which is applied to the pixel Aij when the non-selection voltage B is applied to the scanning electrode Li and the rewriting bright voltage D is applied to the signal electrode Sj. FIG. 10 (11) shows a waveform B-G of a voltage which is applied to the pixel Aij when the non-selection voltage B is applied to the scanning electrode Li and the non-rewriting voltage G is applied to the signal electrode Sj.

In case the display state of the pixel Aij on the FLCD 27 shown in FIG. 32 is changed by the above-mentioned driving method, the selection voltage A shown in FIG. 10 (1) is applied to the scanning electrode Li and the non-selection voltage B shown in FIG. 10 (2) is applied to other scanning electrodes Lk (k≠i, k=to 8). In case the display state of the pixel Aij is changed into "dark", the rewriting dark voltage C shown in FIG. 10 (3) is applied to the signal electrode Sj. In case the display state of the pixel Aij is changed into "bright", the rewriting bright voltage D shown in FIG. 10 (4) is applied to the signal electrode Sj. In case the display state of "bright" or "dark" in the previous frame of the pixel Aij is kept, the non-rewriting voltage G shown in FIG. 10 (5) is applied to the signal electrode Sj.

In case a signal for displaying a character "E" shown in FIG. 5 is inputted from the personal computer 2 to the display controller 25 when a character "A" is displayed on a screen by pixels Aij which take the display state of "dark" as indicated by hatchings in the FLCD 27 of FIG. 32, a conversion takes place over the screen shown in FIG. 33. Specifically, in FIG. 33, the pixel Aij of which display state is changed from "bright" to "dark" is indicated at "C" correspondingly to the rewriting dark voltage C, the pixel Aij of which display state is changed from "dark" to "bright" is indicated at "D" correspondingly to the rewriting bright voltage D, the pixel Aij in the display state of "dark" is indicated at "H", and the pixel Aij in the display state of "bright" has no symbol.

In the above-mentioned driving method, the selection voltage A is applied to the scanning electrodes L0 to L8 in order. In addition, to the signal electrodes S0 to S7 are applied the rewriting dark voltage C corresponding to the position of "C" shown in FIG. 33, the rewriting bright voltage D corresponding to the position of "D", and the non-rewriting voltage G corresponding to the positions of "H" and "no symbol". When the selection voltage A is applied to the scanning electrode L2, the rewriting dark voltage C is applied to the signal electrodes S1 and S5 and the non-rewriting voltage G is applied to other signal electrodes. When the selection voltage A is applied to the scanning electrode L3, the rewriting bright voltage D is applied to the signal electrode S5 and the non-rewriting voltage G is applied to other signal electrodes.

Thus, voltages shown in FIGS. 10 (8) and (9) to (11) are applied to the pixels indicated at "H" and "no symbol" in FIG. 33. The optical effects produced on the pixels by both voltages make little difference. Consequently, even though a 1-frame cycle, that is, a time period starting at the application of the selection voltage A to the scanning electrode Li to reach the reapplication of the selection voltage A to the same scanning electrode Li is greater than 33.3 ms (which is equivalent to 30 Hz), display can be performed without a flicker.

However, it is very difficult to obtain a completely bistable memory state in the FLC panel which uses an FLC as display medium. In the display area in a certain panel, locally, there may be some area where the memory state of "dark" is stable and the other area where that of "bright" is stable as mixture. In case the selection voltage is applied to the scanning electrode of the FLC panel without controlling the above-mentioned orientation state, each pixel is brought into a stable memory state if only the non-rewriting voltage is continuously applied to the signal electrode. Consequently, display is unclear. This has been the problem.

Japanese Unexamined Patent Publication No. 298286/1988 has disclosed that it is possible to perform display in which a flicker is not marked. More specifically, all scanning electrodes are divided into quarters which are adjacent to each other. There is carried out 4:1 jump or interlace scan in which a selection voltage is applied to first to fourth scanning electrodes in first to fourth fields, respectively. A field frequency is set to 30 Hz or more. Consequently, there can be performed display in which the flicker is not marked.

According to a driving method in which display is changed by N:1 jump scan, however, it takes N fields, that is, 1 frame to slightly change display. It is easily anticipated that there can be obtained an FLCD wherein a flicker is not marked and the displayed contents are changed fast if a selection voltage is applied to the constant number of scanning electrodes including pixels of which display is changed so as to rewrite pixels on the scanning electrodes by the N:1 jump scan with the use of the driving method disclosed in the Japanese Unexamined Patent Publication No. 59389/1989 (hereinafter referred to as a driving method of FIG. 10).

However, it is not preferred that the pixels are rewritten by the N:1 jump scan before the pixels are rewritten by the driving method of FIG. 10, because the displayed contents are changed every few scanning electrodes. In order to avoid such a condition, the following operations should be carried out. More specifically, when the selection voltage is applied to the scanning electrode so as to practice the N:1 jump scan driving method, it is checked whether the pixel on the scanning electrode is to be rewritten by the driving method of FIG. 10. If the pixel on the scanning electrode is to be rewritten, a non-rewriting voltage is applied to the signal electrode irrespective of display data. If the pixel is not to be rewritten, a rewriting dark voltage is applied to the signal electrode when the display data is in the state of "dark", and a rewriting bright voltage is applied to the signal electrode when the display data is in the state of "bright".

Referring to a display controller wherein only the scanning electrodes on which pixels are to be rewritten are selected, however, it is impossible to fully distinguish data for deciding which pixels on the scanning electrodes are to be rewritten by the driving method of FIG. 10 from data for deciding whether the pixels on the scanning electrodes have been rewritten by the driving method of FIG. 10. Consequently, when input is provided to the scanning electrode again before the pixels on the scanning electrode are rewritten, rewriting is erased or cannot be erased even though the pixels on the scanning electrode have been rewritten.

For the related art to the present invention, Japanese Unexamined Patent Publication No. 298286/1988 has disclosed a method for driving a display device and Japanese Unexamined Patent Publication No. 59389/1989 has disclosed a ferroelectric liquid crystal display method. Referring to the driving method disclosed in the Japanese Unexamined Patent Publication No. 298286/1988, rewriting is carried out visually fast over a screen to enhance the quality of an image in such a manner that a flicker is not marked in a display device such as a ferroelectric liquid crystal which has incomplete storage characteristics and requires a predetermined time for rewriting pixels for a horizontal scanning period. Referring to the ferroelectric liquid crystal display method disclosed in the Japanese Unexamined Patent Publication No. 59389/1989, distinction is made between three patterns of display "bright" and "dark" at the last time and this time in each pixel on a scanning electrode which is selected at the present time, a voltage applied to pixels on the scanning electrode which is selected at the present time and a voltage applied to pixels on scanning electrodes which are not selected are defined according to the patterns in such a manner that optical effects produced on pixels in the storage state of "bright" or "dark" have no significant difference, so that a flicker is not sensed and the number of scanning electrodes can optionally be increased even though a frame frequency is not greater than 60 Hz.

In order to eliminate the above-mentioned drawbacks, it is an object of the present invention to provide a display controller which comprises a memory for deciding which scanning electrode carries (a) pixel(s) to be rewritten and another memory for deciding whether pixels on a scanning electrode have been rewritten, and thus the controller is suited to realize a display controlling method in which scanning electrodes are selected to rewrite pixels.

SUMMARY OF THE INVENTION

The present invention provides a display controller for a liquid crystal panel structure, the panel structure including a liquid crystal provided in spaces between a plurality of scanning electrodes and a plurality of signal electrodes crossing over each other, and pixels formed of liquid crystal cells provided by overcrossings of the scanning and signal electrodes for displaying various images by changes of states of pixels, the display controller comprising display data storage means for storing data on a state of a pixel as display data for each pixel, identity/non-identity data storage means for storing data, as identity/non-identity discerning data, on whether a difference takes place between a pixel state to be displayed and a pixel state displayed for each pixel group which includes a plurality of pixels, identification data storage means for storing data, as identification data, on whether a pixel is included whose state to be displayed differs from a state displayed for each scanning electrode group which includes a plurality of scanning electrodes, wherein the identification data storage means includes a data selecting part for deciding which scanning electrode group should be selected in next scan, and a data erasing part for deciding whether the identity/non-identity data on a related pixel should be erased, and wherein the data selecting part and the data erasing part change the storage contents to indicate a change in the display each time the state of a related pixel changes, and thereafter the data selecting storage part changes the storage content to indicate no change in the display when the related scanning electrode group is to be selected, and the data erasing part changes the storage content to be the same as in the data selecting part when the related scanning electrode group has been scanned.

It is preferred that the identity/non-identity data storage means stores data, as identity/non-identity discerning data, on whether a difference takes place between a pixel state to be displayed and a pixel state displayed for each pixel group which includes four pixels.

Preferably, the identification data storage means stores data, as identification data, on whether a pixel is included whose state to be displayed differs from a state displayed for each scanning electrode group which includes four scanning electrodes.

According to the present invention, when input data corresponding to a scanning electrode group to be selected is sent again for a period from the rewriting operation of the identification data of the data selecting storage part into the storage contents of "unchanged display" till the rewriting operation of the identification data of the data erasing storage part into the same storage contents, the following operations are carried out.

(1) In case the input data includes the changed data, the identification data of the data selecting and erasing storage parts are rewritten into the storage contents of "changed display". Even though the selection of the scanning electrode group is completed, the identification data of the data erasing storage part is not rewritten into the storage contents of "unchanged display".

(2) In case the input data does not include the changed data, the storage contents of the identification data of the data selecting and erasing storage parts are not changed. When the selection of the scanning electrode group is completed, the identification data of the data erasing storage part is rewritten into the storage contents of "unchanged display".

When input data corresponding to the scanning electrodes is sent again, the following operations are carried out.

(1) If the identification data of the data erasing storage part has the storage contents of "changed display", identity and difference data which is recorded, and new identity and difference data are collectively recorded (there is recorded any of the data which has the storage contents of "changed display").

(2) If the identification data of the data erasing storage part has the storage contents of "unchanged display", the recorded identity and difference data is erased and the new identity and difference data is recorded.

Thus, the identity and difference data included in the scanning electrode group is not erased before completely read out. When completely read out, the identity and difference data included in the scanning electrode group is erased if the unchanged data of the scanning electrode group is inputted next.

DETAILED DESCRIPTION OF THE PREFERRED EMBODIMENT

A preferred embodiment of the present invention will be described in detail with reference to the drawings. The present invention should not be construed as being limited by the following embodiment.

Figure 2:
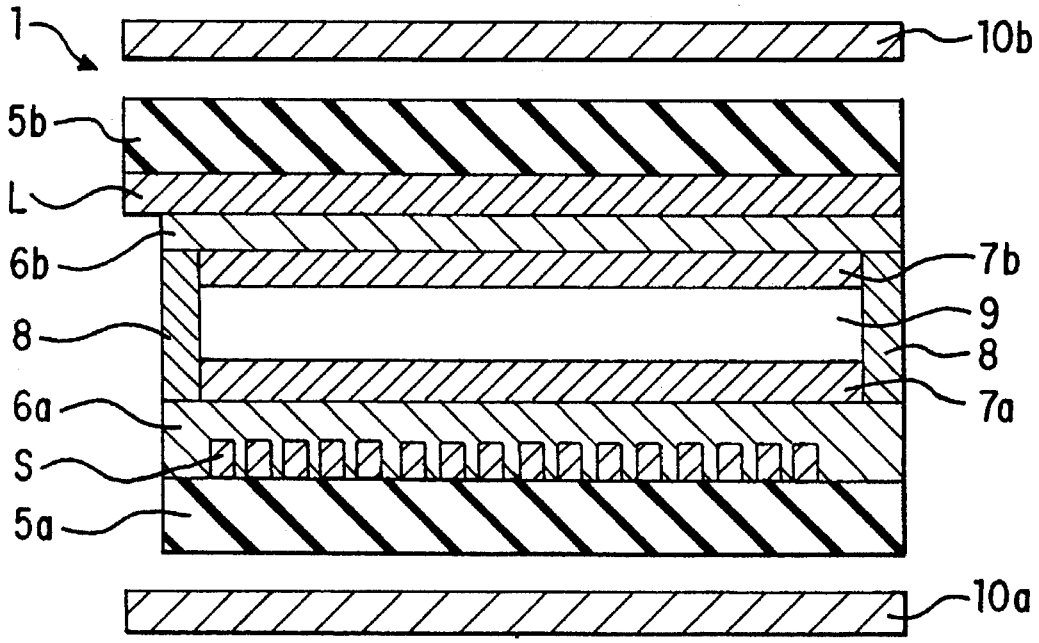
FIG. 2 is a section view showing the schematic structure of an FLC panel used in the embodiment of the present invention.
Figure 31:
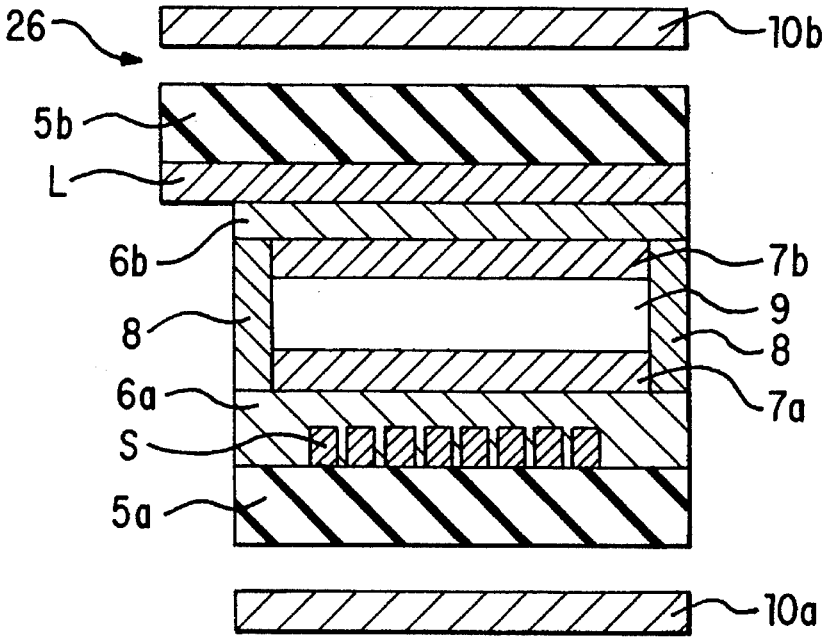
FIG. 31 PRIOR ART
FIG. 31 is a section view showing the schematic structure of an FLC panel used in an FLCD of the display system according to the prior art.
Figure 32:
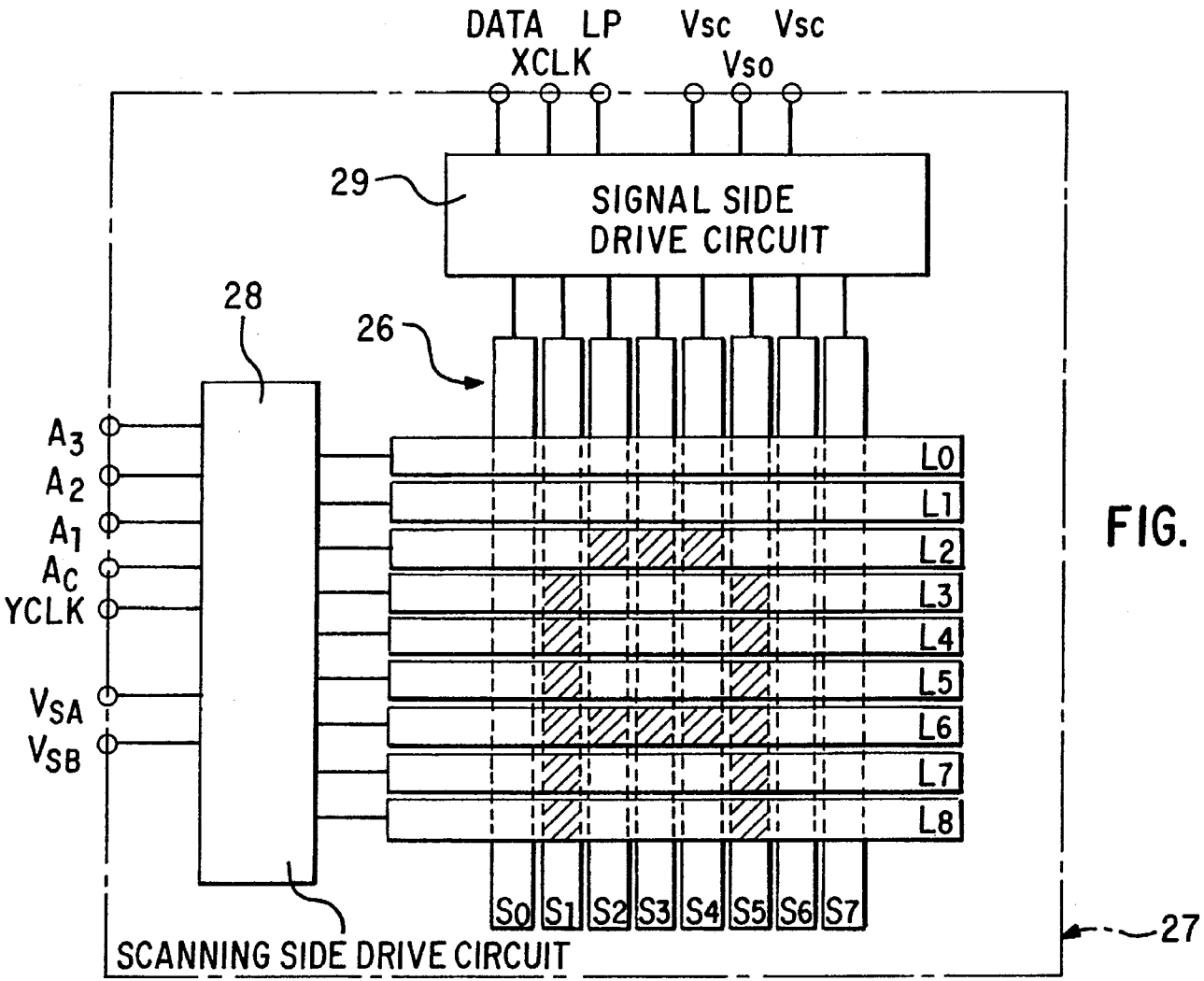
FIG. 32 PRIOR ART
FIG. 32 is a diagram showing the state in which a character "A" is displayed on the FLCD used in the display system according to the prior art.
Figure 33:
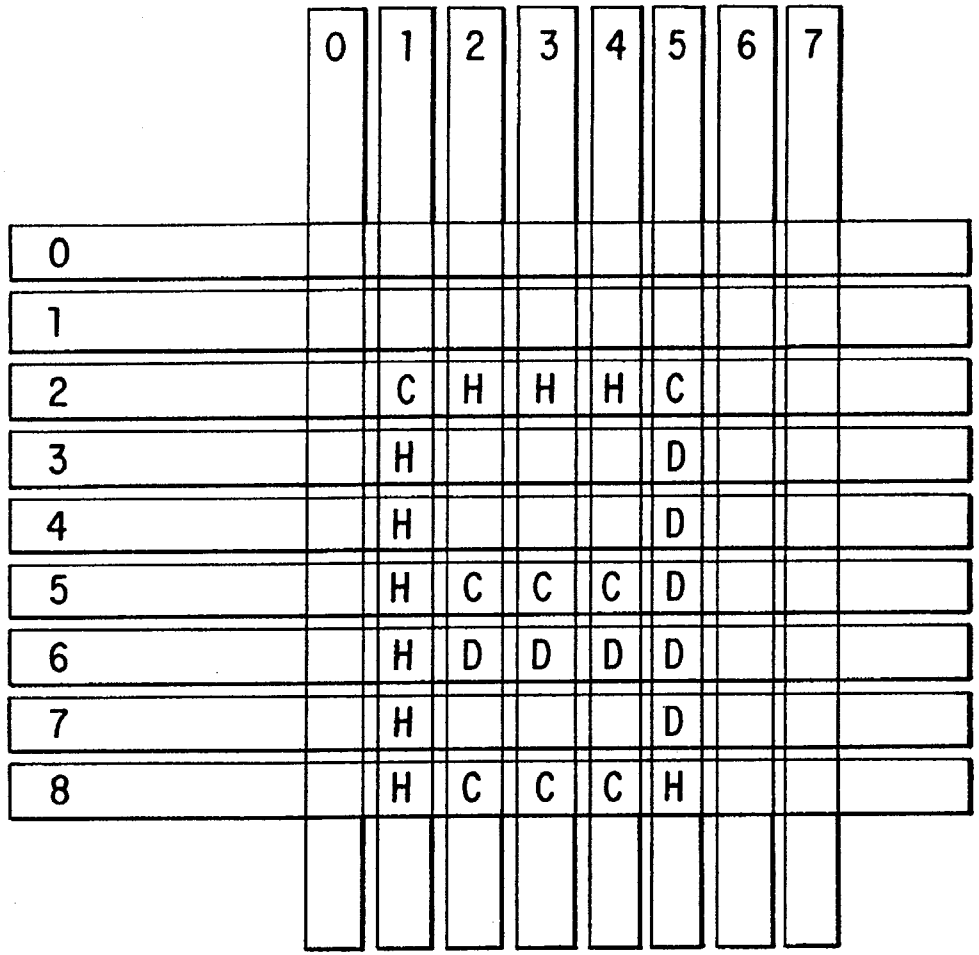
FIG. 33 PRIOR ART
FIG. 33 is a diagram conceptually showing, in symbol, the change of the display state of pixels on the FLC panel according to the prior art.

FIG. 2 is a section view showing the schematic structure of an FLC panel 1 used in the present embodiment. Since the structure of the FLC panel 1 is the same as that of an FLC panel 26 shown in FIG. 31 except that there are provided 16 scanning electrodes L and 16 signal electrodes S, its description will be omitted. In the FLC panel 1 according to the present embodiment, polyimide which is subjected to rubbing processing is used for an orientation film, and ZLI--b 4237/000manufactured by Merk Co., Ltd. is used for a ferroelectric liquid crystal.

Figure 3:
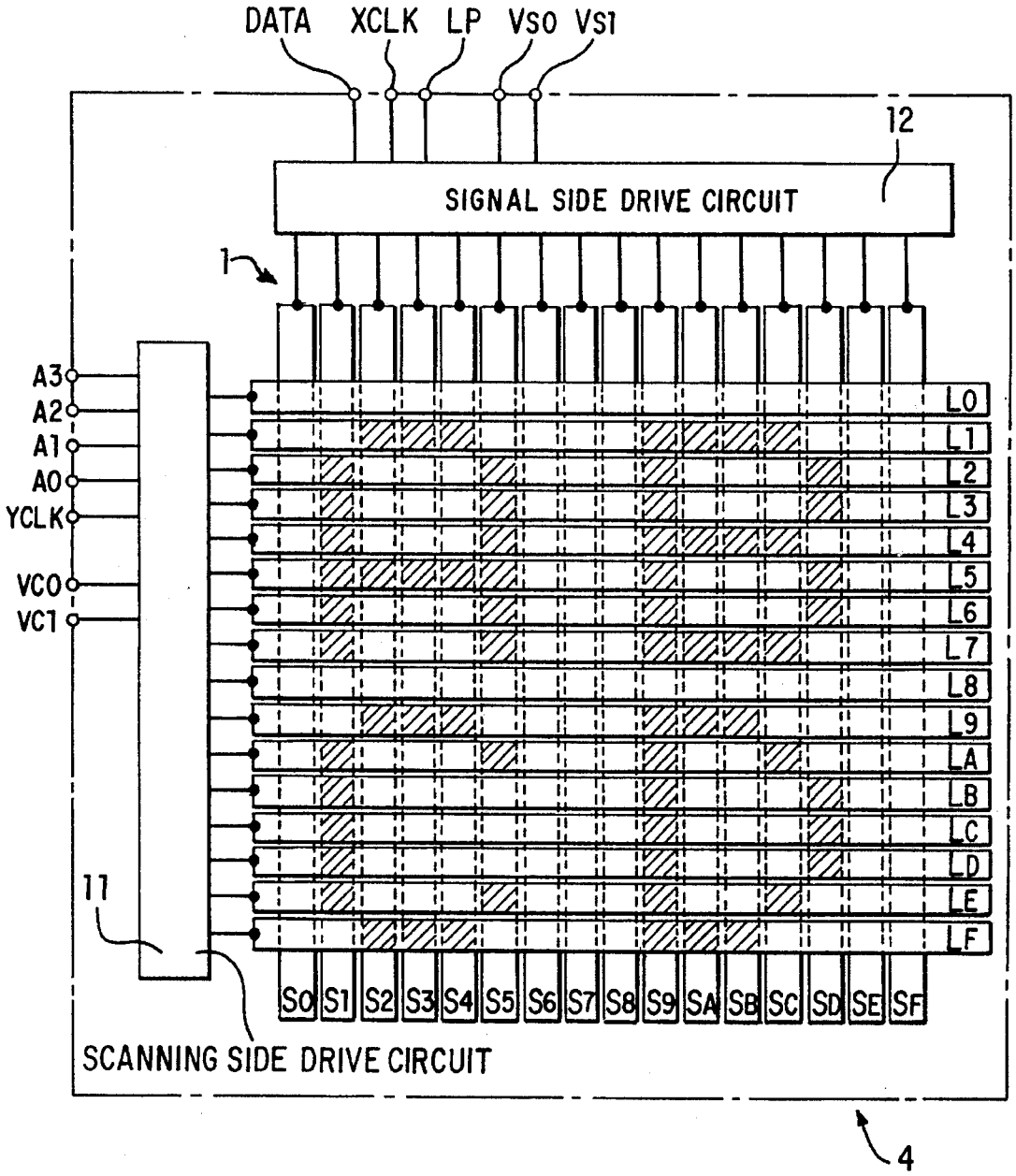
FIG. 3 is a plan view showing the structure of an FLCD used in the display system according to the embodiment of the present invention.

FIG. 3 is a plan view showing the structure of an FLCD 4 in which a scanning side drive circuit 11 and a signal side drive circuit 12 are connected to the scanning electrodes L and the signal electrodes S of the FLC panel 1 having a simple 16×16 matrix structure, respectively. Each scanning electrode L is coded by adding a subscript i (i=0 to F) to a character L. Each signal electrode S is coded by adding a subscript j (j=0 to F) to a character S.

Figure 1:
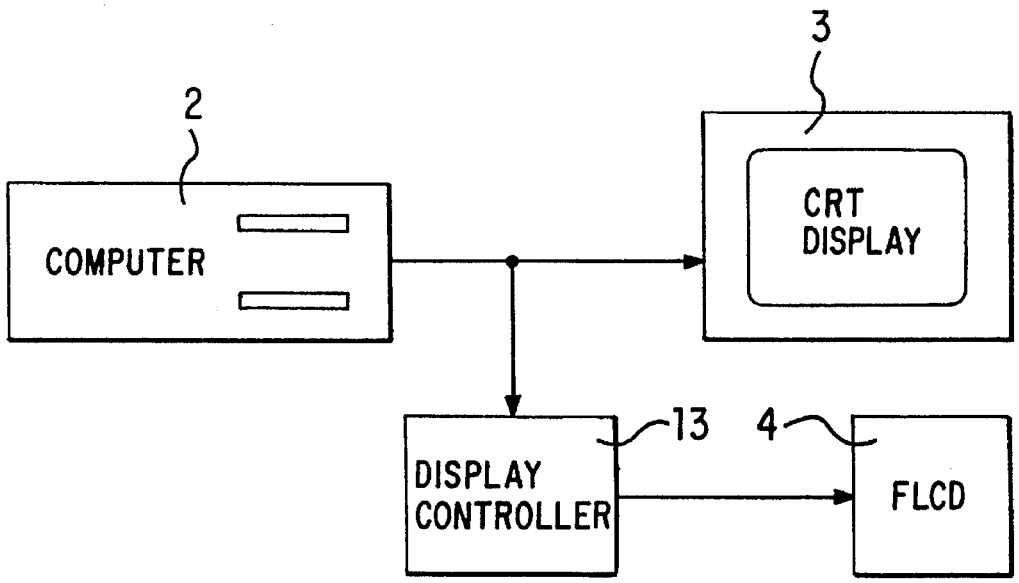
FIG. 1 is a block diagram showing the schematic structure of a display system according to an embodiment of the present invention.
Figure 30:
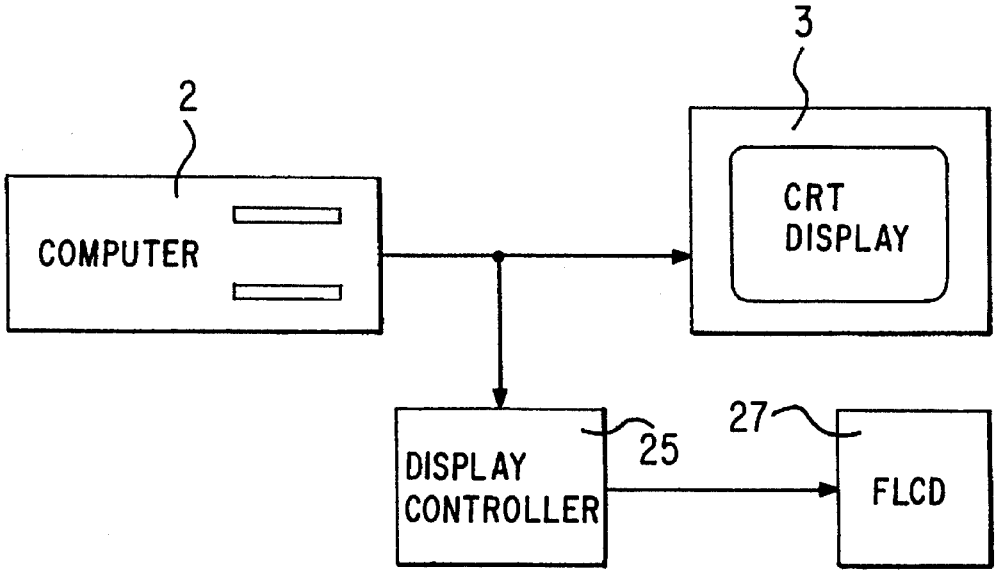
FIG. 30 PRIOR ART
FIG. 30 is a block diagram showing the schematic structure of a display system according to the prior art.

FIG. 1 is a block diagram schematically showing the structure of a display system using the FLCD 4. The display system basically has the same structure as that of a display system shown in FIG. 30 according to the prior art. Information necessary for image display is obtained from a digital signal of FIG. 4 which is the same as in the prior art. The digital signal is outputted from a personal computer 2 to a CRT display 3. A display controller 13 converts the digital signal into a signal for causing the FLCD 4 to perform image display. Based on a conversion signal thus obtained, image display is performed by the FLCD 4.

Figure 4:
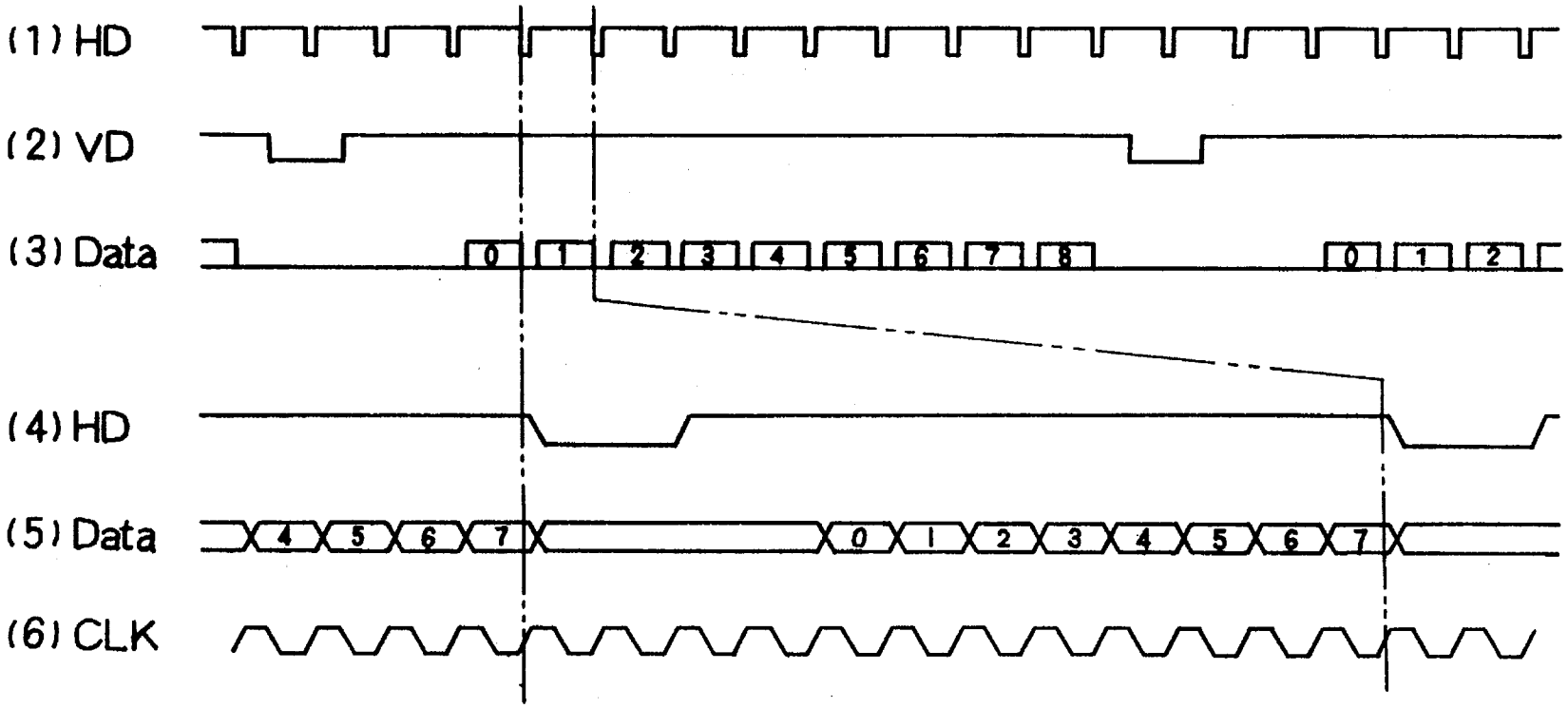
FIG. 4 is a waveform diagram showing an output signal from a personal computer in the display system according to the embodiment of the present invention.
Figure 5:
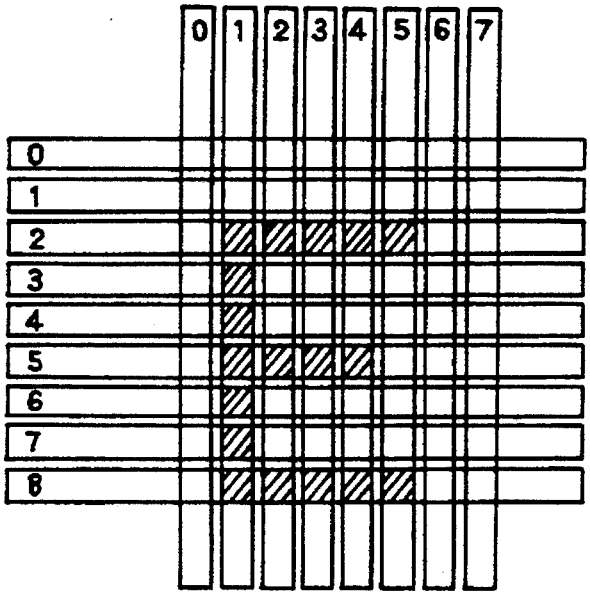
FIG. 5 is a diagram showing the display data of digital signals of a liquid crystal panel in a matrix.
Figure 6:
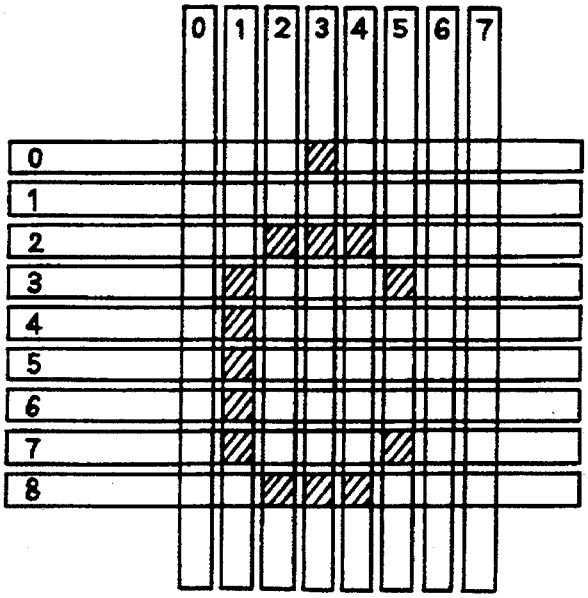
FIG. 6 is a diagram showing the display data of digital signals of the liquid crystal panel in a matrix.

FIGS. 5 and 6 are data diagrams showing, in a matrix, display data Data of the digital signal shown in FIGS. 4 (3) and (5). Although the digital signal has data for only 9×8 pixels, data for 16×16 pixels of the FLC panel 1 shown in FIG. 3 can be displayed for the following reason. The 16×16 pixels of the FLC panel 1 are virtually divided into display portions 0 to 3. The display portion 0 has scanning electrodes L0 to L7 and signal electrodes S0 to S7. The display portion 1 has the scanning electrodes L0 to L7 and signal electrodes S8 to SF. The display portion 2 has scanning electrodes L8 to LF and the signal electrodes S0 to S7. The display portion 3 has the scanning electrodes L8 to LF and the signal electrodes S8 to SF. As shown in FIGS. 5 and 6, data in a 0th horizontal scanning section of the digital signal for 9×8 pixels to be inputted indicates the correspondence of data in first to eighth horizontal scanning sections to the display portions 0 to 3.

Referring to FIGS. 5 and 6, if third and seventh data in the 0th horizontal scanning section are "bright" (data having no hatchings) and "bright" (to which FIG. 5 is suited) respectively, data in the first to eighth horizontal scanning sections correspond to the display portion 0. If the third and seventh data in the 0th horizontal scanning section are "bright" and "dark" (data having hatchings) respectively, the data in the first to eighth horizontal scanning sections correspond to the display portion 1. If the third and seventh data in the 0th horizontal scanning section are "dark" and "bright" (to which FIG. 6 is suited) respectively, the data in the first to eighth horizontal scanning sections correspond to the display portion 2. If the third and seventh data in the 0th horizontal scanning section are "dark", the data in the first to eighth horizontal scanning sections correspond to the display portion 3.

Figure 7:
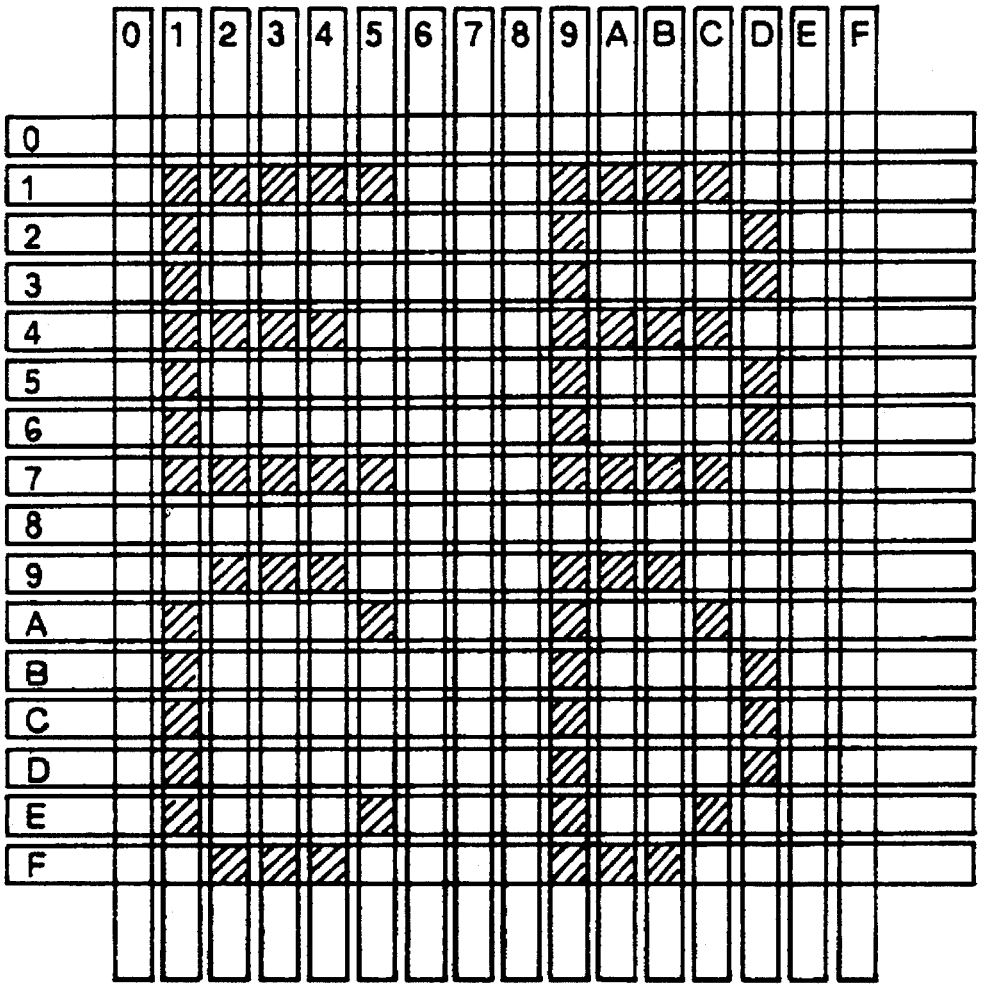
FIG. 7 is a diagram showing the data of a display memory in a matrix correspondingly to pixels on the FLC panel.

FIG. 7 is a data diagram showing, in a 16×16 matrix, the contents of a display memory for recording display data DA to be displayed next on the FLC panel 1 based on the 9×8 digital signals correspondingly to each pixel of the FLC panel 1 according to the above-mentioned rules.

Figure 8:
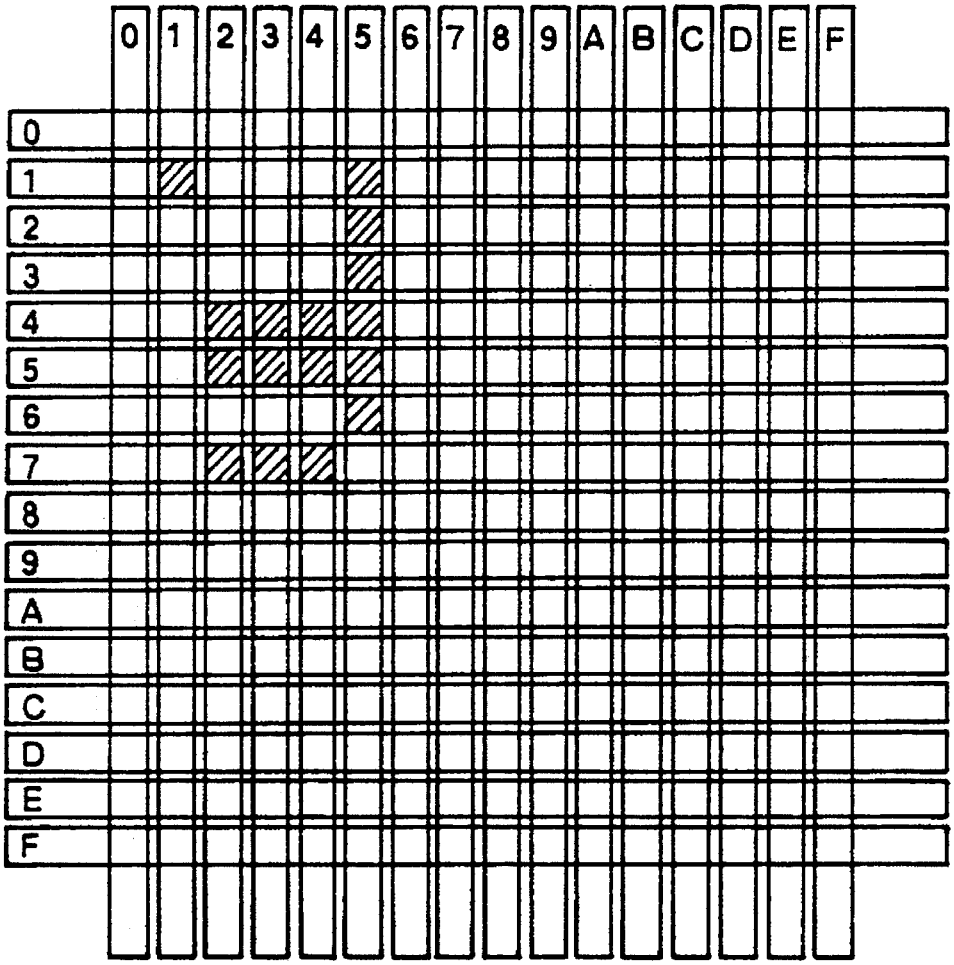
FIG. 8 is a diagram showing the change of data of the display memory in a matrix correspondingly to pixels on the FLC panel.

While data "A B C D" displayed on the FLCD 4 as shown in FIG. 3 has been recorded on the display memory in a 16×≠matrix, display data Data "E" shown in FIG. 5 is inputted to the display controller 13 so that data "E B C D" shown in FIG. 7 is recorded on the display memory. FIG. 8 shows the change of data of the display memory in a 16×16 matrix correspondingly to each pixel of the FLC panel 1 (the data shown in hatchings has been changed).

According to the present embodiment, the change of data of the display memory is collectively recorded on an identity and difference memory every four pixels of the FLCD 4 (if only one pixel has a difference, there is a difference). More specifically, the change of data of the display memory shown in FIG. 8 is collected every four pixels correspondingly to pixels A00, A01, A10, A11, pixels A02, A03, A12, A13 . . . , pixels AEE, AEF, AFE, AFF of the FLC panel 1 and is recorded as identity and difference data DF on addresses Ax=00, 01 . . . 77 of the identity and difference memory shown in FIG. 11 (the data shown in hatchings has a difference). The change of data of the display memory is collectively recorded on an identification memory every four scanning electrodes of the FLCD 4 (if only one pixel has a difference, there is a difference). More specifically, the change of data of the display memory shown in FIG. 8 is recorded on data erasing identification data GDFI (indicated at I in FIG. 9) and data selecting identification data GDFO (indicated at 0 in FIG. 9) in addresses Ax=0, 1, 2, 3 of the identification memory shown in FIG. 9 correspondingly to the scanning electrodes L0 to L3, L4 to L7, L8 to LB and LC to LF of the FLC pane 11.

Figure 12:
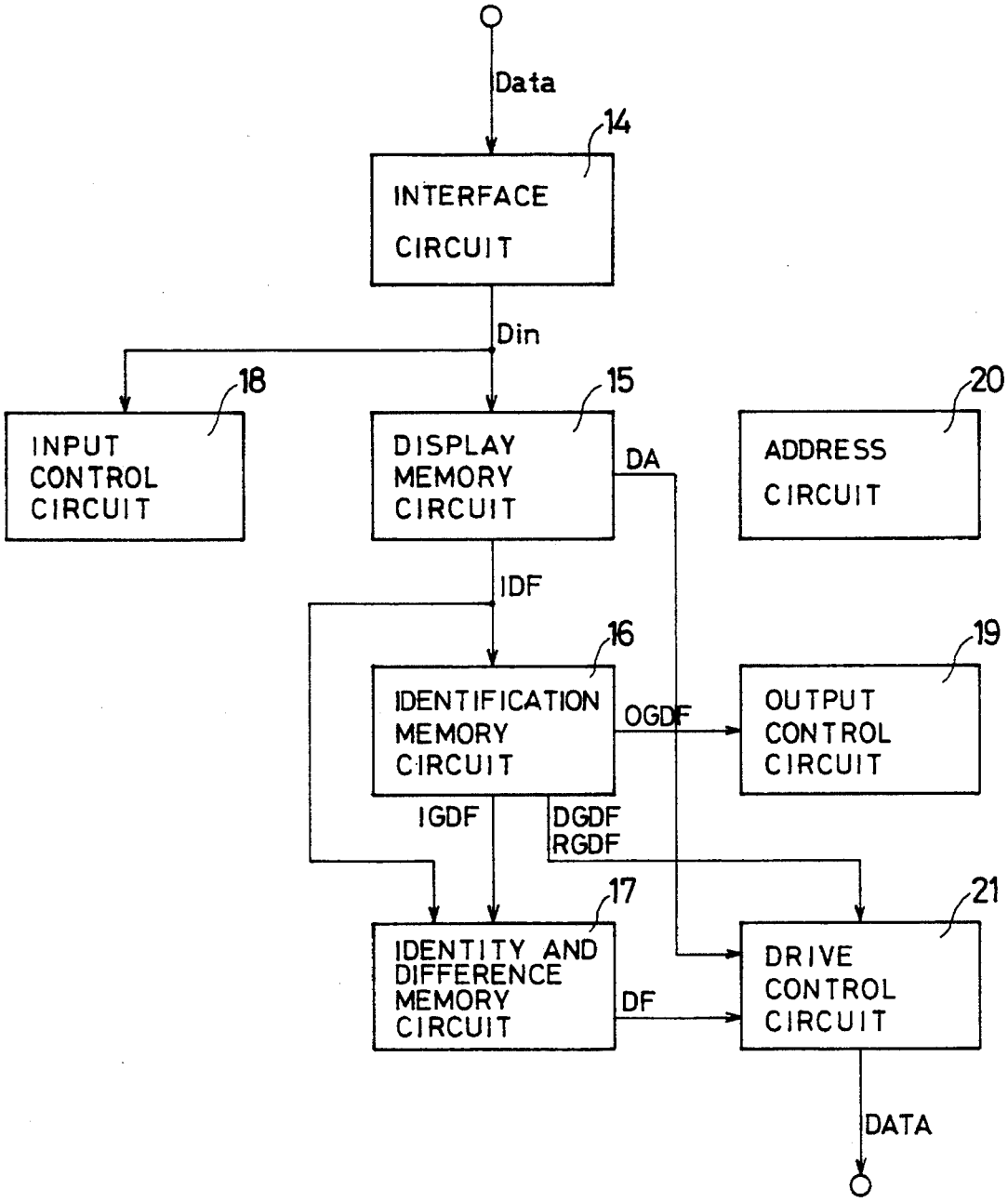
FIG. 12 is a block diagram showing the schematic structure of a display control circuit according to the embodiment of the present invention.
Figure 13:
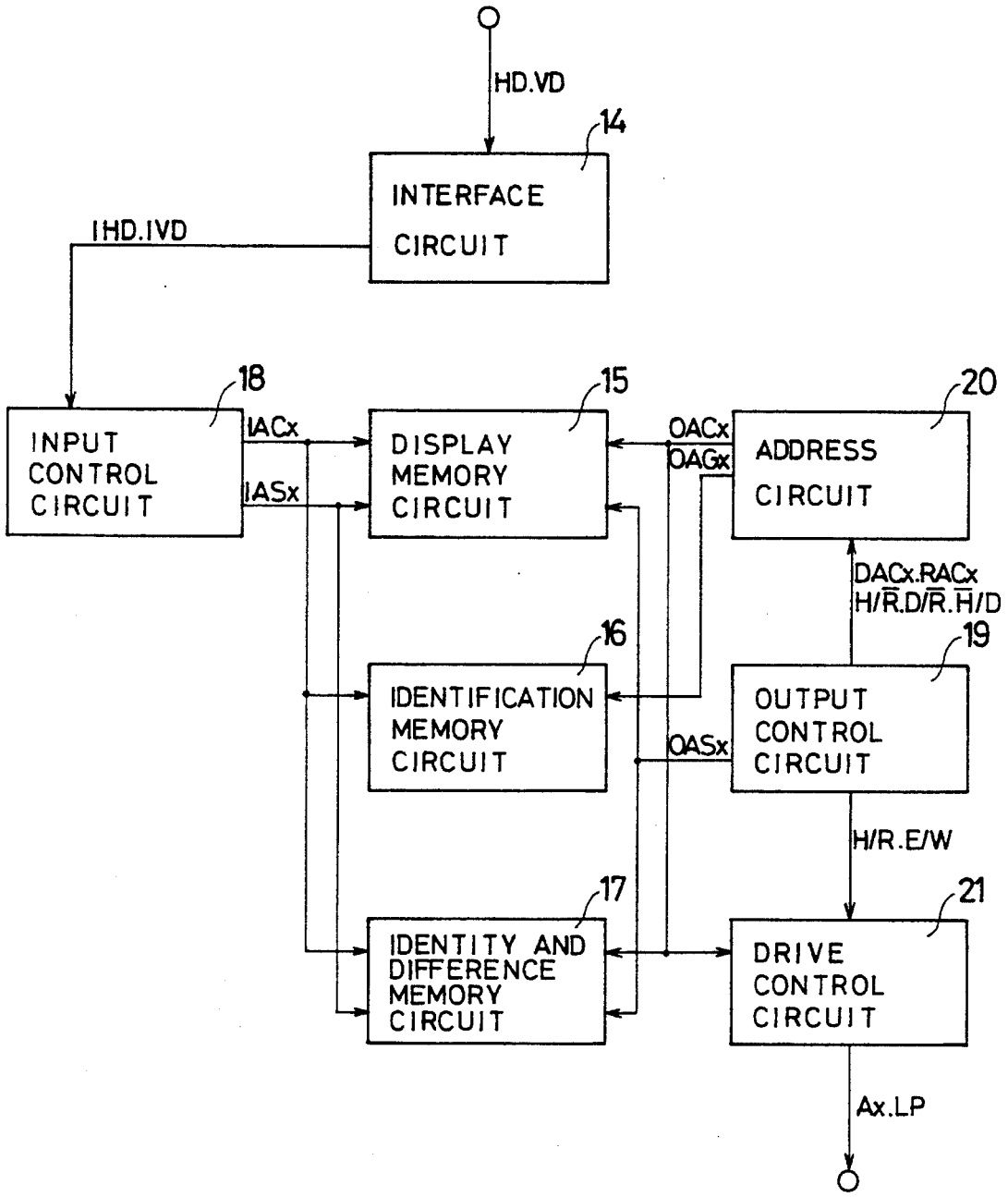
FIG. 13 is a block diagram showing the schematic structure of the display control circuit according to the embodiment of the present invention.

FIGS. 12 and 13 are block diagrams showing the schematic structure of the display controller 13. The display controller 13 includes an interface circuit 14, a display memory circuit 15, an identification memory circuit 16, an identity and difference memory circuit 17, an input control circuit 18, an output control circuit 19, an address circuit 20 and a drive control circuit 21. The interface circuit 14 receives a digital signal Data and synchronous signals HD and VD from the personal computer 2 and distributes the same as input data Din and synchronous signals IHD and IVD to necessary circuits. The display memory circuit 15 records display data DA to be displayed next on the FLC panel 1. The identification memory circuit 16 collectively records the change IDF of data of the display memory circuit 15 as identification data IGDF and OGDF every four scanning electrodes. The identity and difference memory circuit 17 collectively records the change IDF of data of the display memory circuit 15 as identity and difference data DF every four pixels. The input control circuit 18 controls addresses IACx and IASx for writing input data into the memory circuits 15, 16 and 17. The output control circuit 19 and address circuit 20 control addresses OACx, OASx and OAGx of data to be outputted from the memory circuits 15, 16 and 17 to the FLCD 4. The drive control circuit 21 controls the operations of the scanning side drive circuit 11 and signal side drive circuit 12 forming the FLCD 4 on receipt of the display data DA, the identity and difference data DF, a drive mode H/R-, a voltage mode E-/W, state data DGDF and RGDF, and the address OACx.

It is supposed that the digital signal Data, the synchronous signals HD and VD, and a clock CLK shown in FIG. 4 are inputted from the personal computer 2 to the interface circuit 14 when the display state of "A B C D" shown in FIG. 3 is recorded on the display memory circuit 15. Assuming that 4:1 jump scan is performed on scanning electrodes L0, L4, L8, LC, L1, L5, L9, LD, L2, L6, LA, LE, L3, L7, LB and LF in order, and a selection voltage is applied to one scanning electrode by an N:1 jump scan driving method and is then applied to two scanning electrodes by a driving method disclosed in Japanese Unexamined Patent Publication No. 59389/1989 (hereinafter referred to as a driving method of FIG. 10), the operation of the display controller 13 will be described.

The input data Din, synchronous signals IHD and IVD, and a clock ICK are outputted from the interface circuit 14 to the input control circuit 18.

Figure 14:
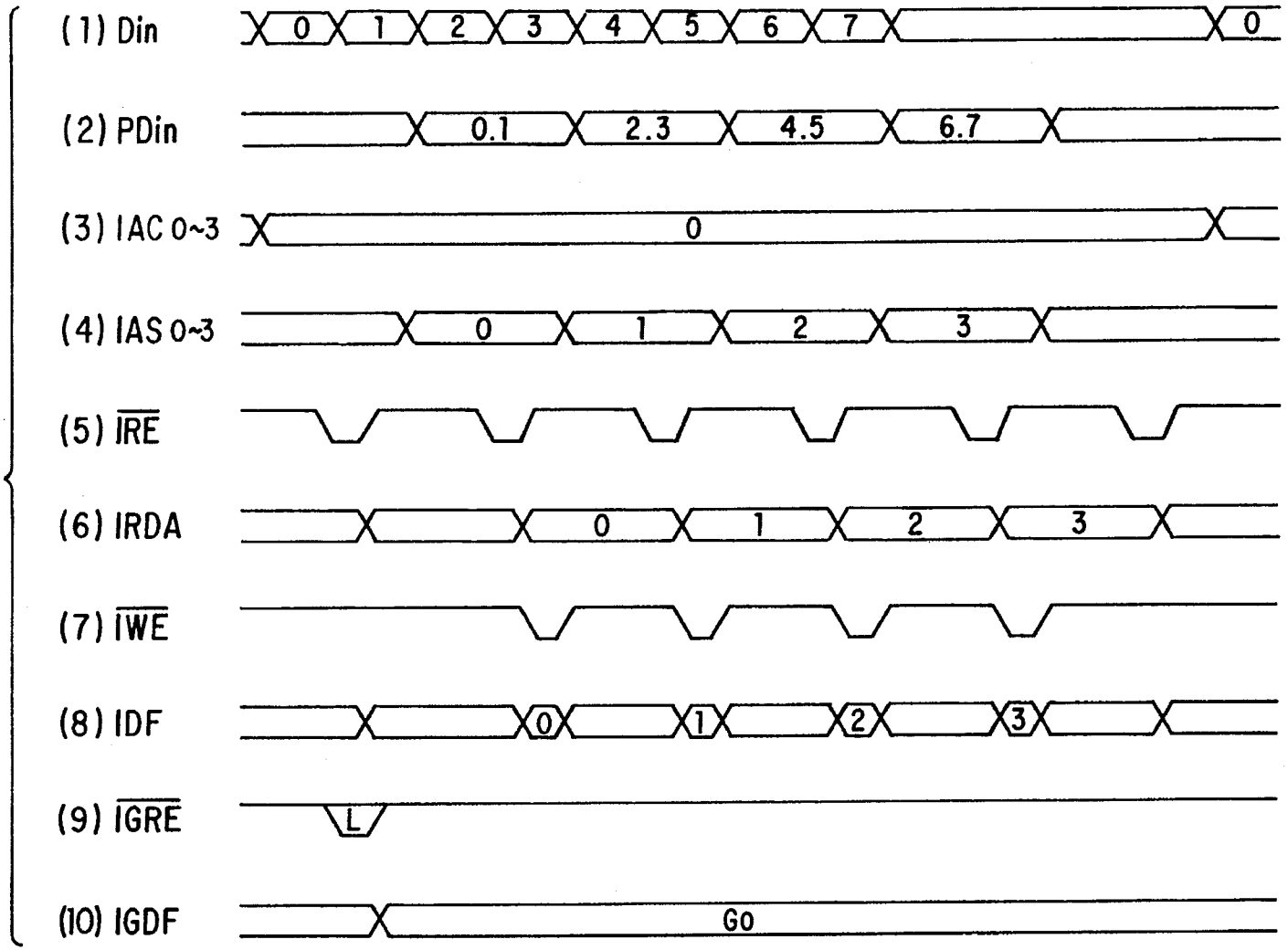
FIG. 14 is a timing chart for explaining operations carried out on the input side of the display control circuit according to the embodiment of the present invention.

FIG. 14 shows operations carried out on the input side. FIG. 14 (1) shows the input data Din to be inputted to the display memory circuit 15. FIG. 14 (2) shows data PDin which is obtained by serial-parallel converting the data Din with the use of the display memory circuit 15. FIG. 14 (3) shows an input line address IACx to be inputted to the display memory circuit 15, the identification memory circuit 16 and the identity and difference memory circuit 17. FIG. 14 (4) shows an input column address IASx to be inputted to the display memory circuit 15 and the identity and difference memory circuit 17. FIG. 14 (5) shows an input side read-out control signal IRE- to be inputted to the display memory circuit 15, the identification memory circuit 16 and the identity and difference memory circuit 17. FIG. 14 (6) shows data IRDA read out from the display memory circuit 15 by the control signal IRE-. FIG. 14 (7) shows an input side write control signal IWE- to be inputted to the display memory circuit 15, the identification memory circuit 16 and the identity and difference memory circuit 17. FIG. 14 (8) shows exclusive-OR of the data PDin and the data IRDA (that is, a difference between both data). FIG. 14 (9) shows a control signal IGRE- for reading out data erasing identification data GDFI from the identification memory circuit 16. FIG. 14 (10) shows data erasing identification data IGDF thus read out.

In the input control circuit 18, third data in a 0th horizontal scanning section of the input data Din is in the state of "bright". Consequently, the address IACx is outputted to the display memory circuit 15, the identification memory circuit 16 and the identity and difference memory circuit 17 in such a manner that a first horizontal scanning section of the input data Din is recorded on a memory line address ACx=0, a second horizontal scanning section is recorded on a memory line address ACx=1, third to seventh horizontal scanning sections are recorded on correspondent memory line addresses respectively, and an eighth horizontal scanning section is recorded on a memory line address ACx=7. Seventh data in the 0th horizontal scanning section of the input data Din is in the state of "bright". Consequently, the address IASx is outputted to the display memory circuit 15 and the identity and difference memory circuit 17 in such a manner that 0th and first data of the input data Din subsequent to the horizontal synchronous signal IHD are recorded on a memory column address ASx=0, second and third data are recorded on a memory column address ASx=1, fourth and fifth data are recorded on a memory column address ASx=2, and sixth and seventh data are recorded on a memory column address ASx=3.

In the display memory circuit 15, the data IRDA stored in an address which is specified by the memory addresses IACx and IASx is read out by the control signal IRE-. Then, the data PDin is stored in the same address by the control signal IWE-. The data PDin is the paralleled input data Din. The OR IDF of exclusive-OR of the data IRDA and the data PDin is outputted to the identification memory circuit 16 and the identity and difference memory circuit 17. The OR IDF indicates that there is a change if one of the paralleled data is changed. The exclusive-OR indicates the change between the data IRDA and the data PDin.

In the identification memory circuit 16, the data erasing identification data GDFI is read out from the memory by the control signal IGRE- at the beginning of the addresses IACx=0, 4, 8, C, and is then outputted to the identity and difference memory circuit 17. The data erasing identification data GDFI and the data selecting identification data GDFO are read out, by the control signal IRE-, from addresses Ax=0, 1, 2 and 3 correspondingly to addresses IACx=0 to 3, 4 to 7, 8 to B, and C to F, respectively (that is, the memory has a 2-bit structure). The data erasing identification data GDFI and the data selecting identification data GDFO are individually ORed with the conversion data IDF (if one of both data is in the state of "changed display", there is the change of display), and are recorded on the same address of the memory by the control signal IWE-.

In the identity and difference memory circuit 17, identity and difference data is read out from addresses corresponding to the memory addresses IACx and IASx by the control signal IRE- (an address ACx=0 corresponding to addresses IACx=0, 1, an address ACx=1 corresponding to addresses IACx=2, 3, . . . an address ACx=7 corresponding to addresses IACx=E, F, an address ASx=0 corresponding to addresses IASx=0, 1 and addresses IASx=8,9, an address ASx=1 corresponding to addresses IASx=2, 3 and addresses IASx=A, B, an address ASx=2 corresponding to addresses IASx=4, 5 and addresses IASx=C, D, and an address ASx=3 corresponding to addresses IASx=6, 7 and addresses IASx=E, F) . (The memory has 2 bits, one of which corresponds to IASx=0 to 7 and the other corresponds to IASx=8 to F). The identity and difference data thus read out and the data erasing identification data IGDF are individually ANDed (if both data are in the state of "changed display", there is the change of display), are individually ORed with the conversion data IDF (if one of the data is in the state of "changed display", there is the change of display), and are individually recorded as identity and difference data on the same address of the memory by the control signal IWE-.

Figure 9:
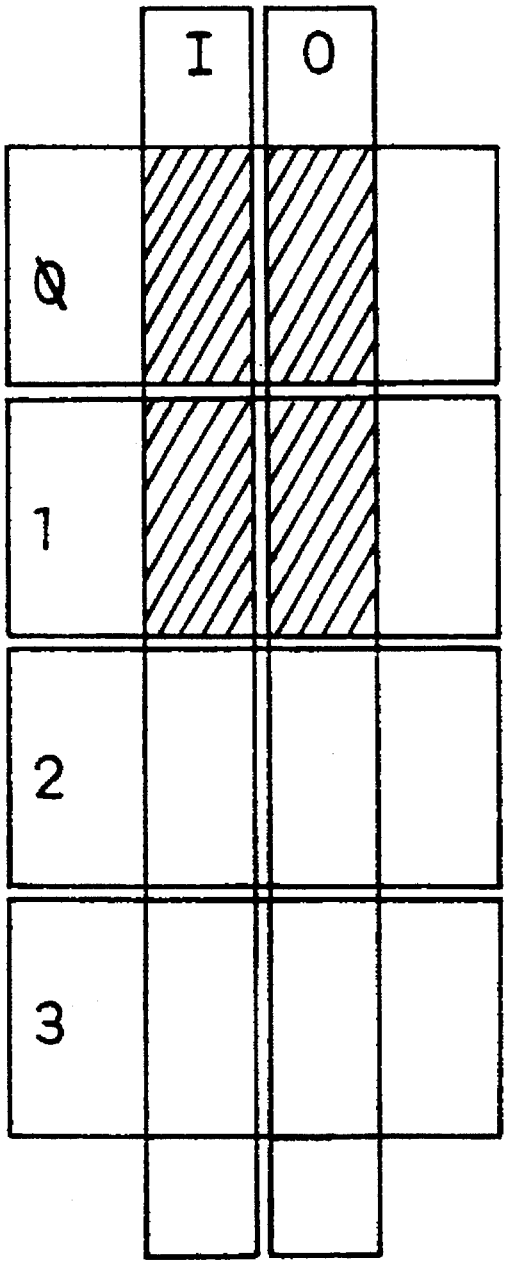
FIG. 9 is a diagram showing, in a matrix, the data of an identification memory circuit included in the display system.
Figure 11:
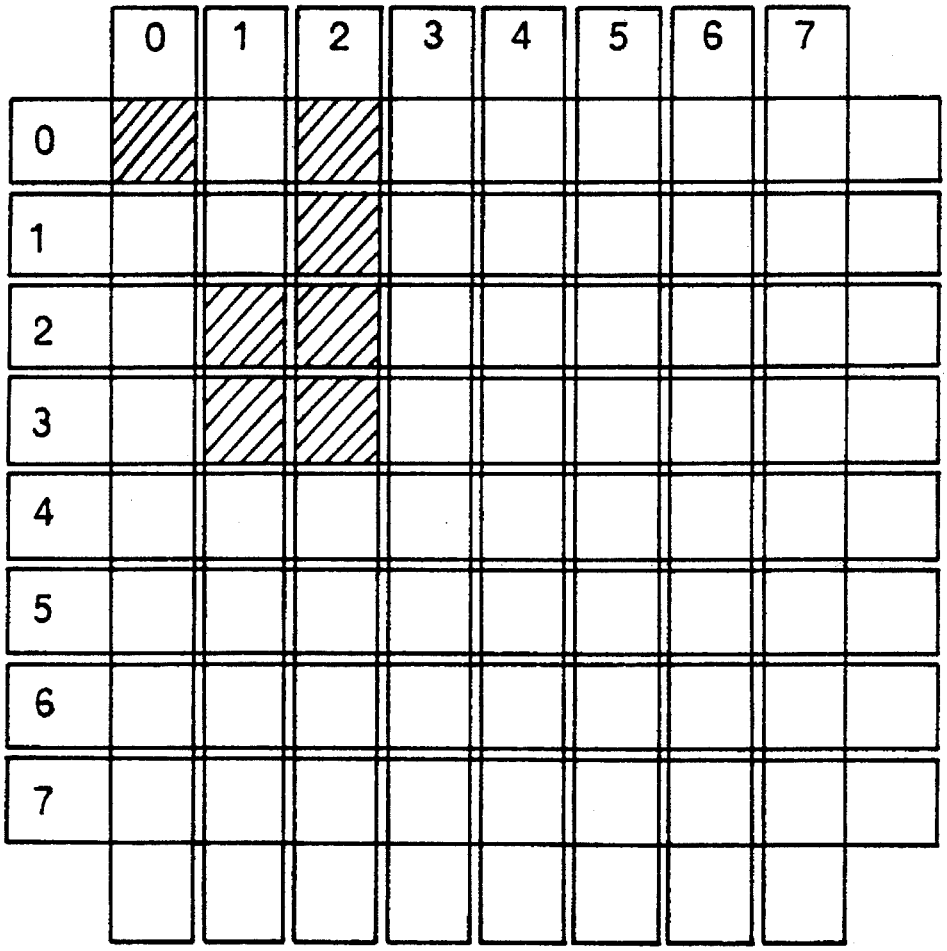
FIG. 11 is a diagram showing, in a matrix, the data of an identity and difference memory circuit included in a display system shown in FIG. 10.

According to the above-mentioned operations, data "E B C D" shown in FIG. 7 is recorded on the display memory circuit 15, data shown in FIG. 9 is recorded on the identification memory circuit 16, and data shown in FIG. 11 is recorded on the identity and difference memory circuit 17.

Figure 15:
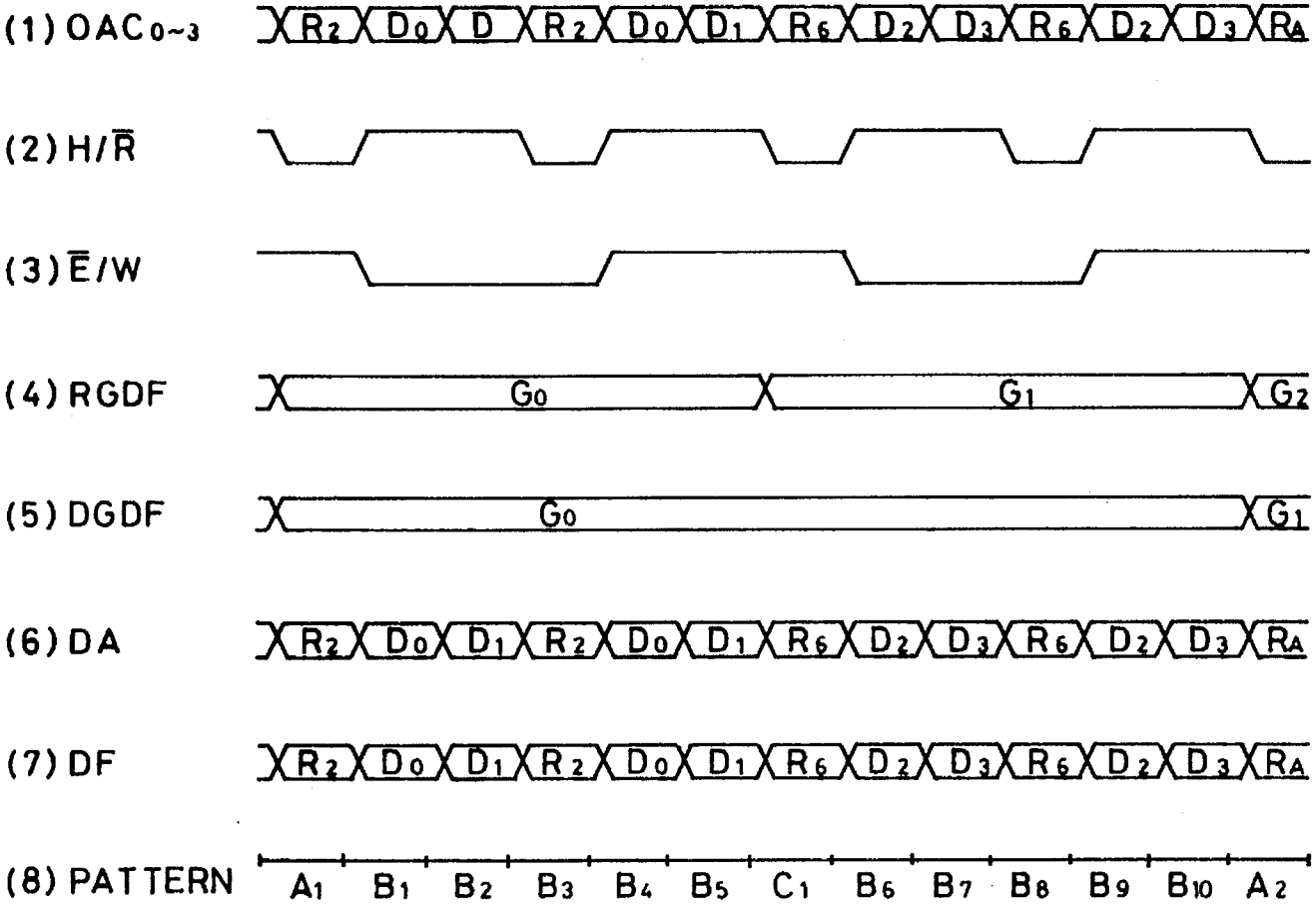
FIG. 15 is a timing chart for explaining operations carried out on the output side of the display control circuit according to the embodiment of the present invention.

FIG. 15 is a diagram for explaining operations carried out on the output side. FIG. 15 (1) shows an output line address OACx to be inputted from the output control circuit 19 to the display memory circuit 15, the identity and difference memory circuit 17 and the drive control circuit 21 through the address circuit 20. FIG. 15 (2) shows a drive mode signal H/R- to be outputted from the output control circuit 19 to the drive control circuit 21. FIG. 15 (3) shows a voltage mode signal E-/W to be outputted from the output control circuit 19 to the drive control circuit 21. FIG. 15 (4) shows N:1 jump scan driving state data RGDF to be outputted from the identification memory circuit 16 to the drive control circuit 21. FIG. 15 (5) shows state data DGDF for the driving method of FIG. 10 which is to be outputted from the identification memory circuit 16 to the drive control circuit 21. FIG. 15 (6) shows display data DA to be outputted from the display memory circuit 15 to the drive control circuit 21. FIG. 15 (7) shows identity and difference data DF to be outputted from the identity and difference memory circuit 17 to the drive control circuit 21. FIG. 15 (8) shows an operating pattern on the output side.

Figure 16:
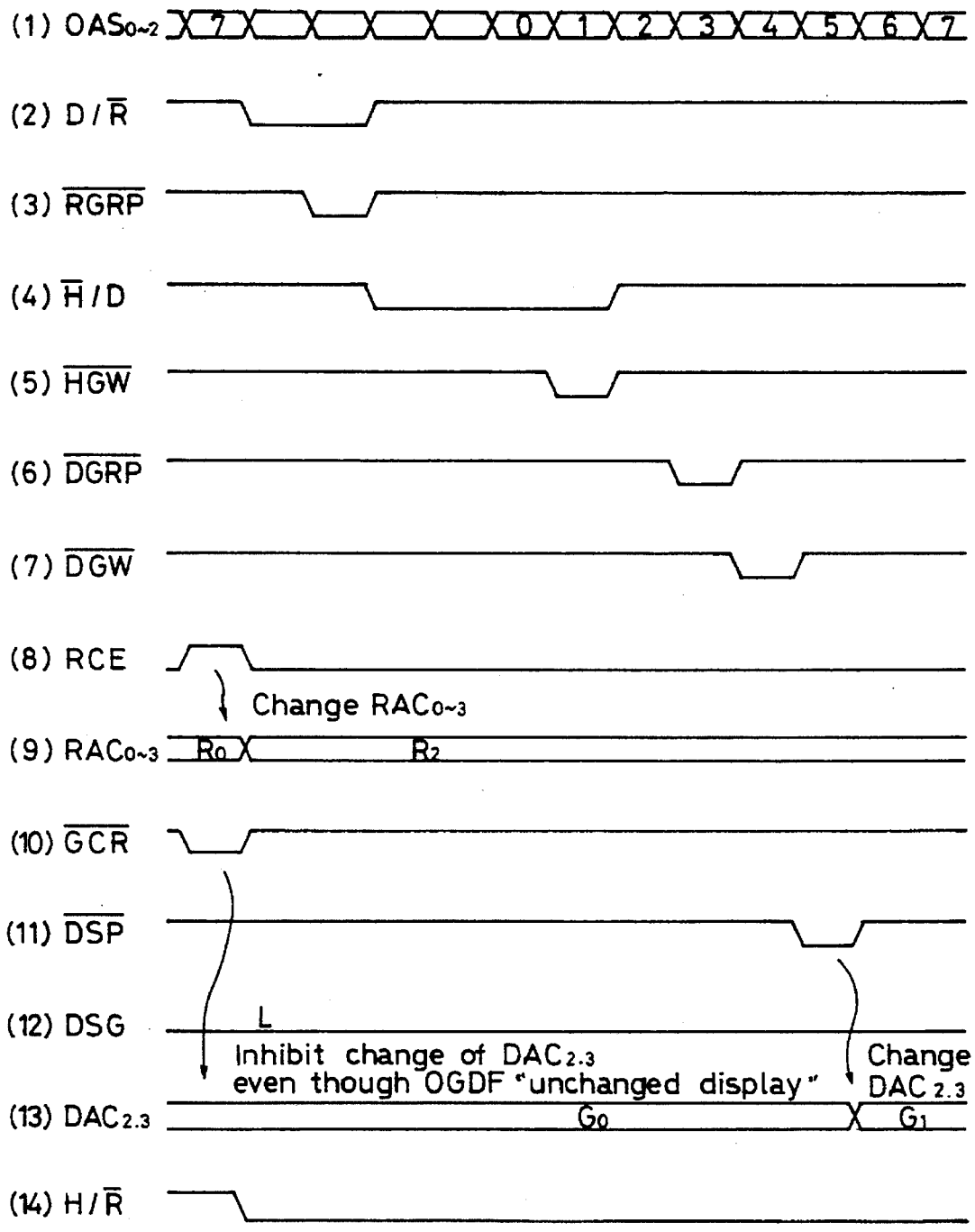
FIG. 16 is a timing chart for explaining a pattern A1 of FIG. 15 (8) in detail.
Figure 17:
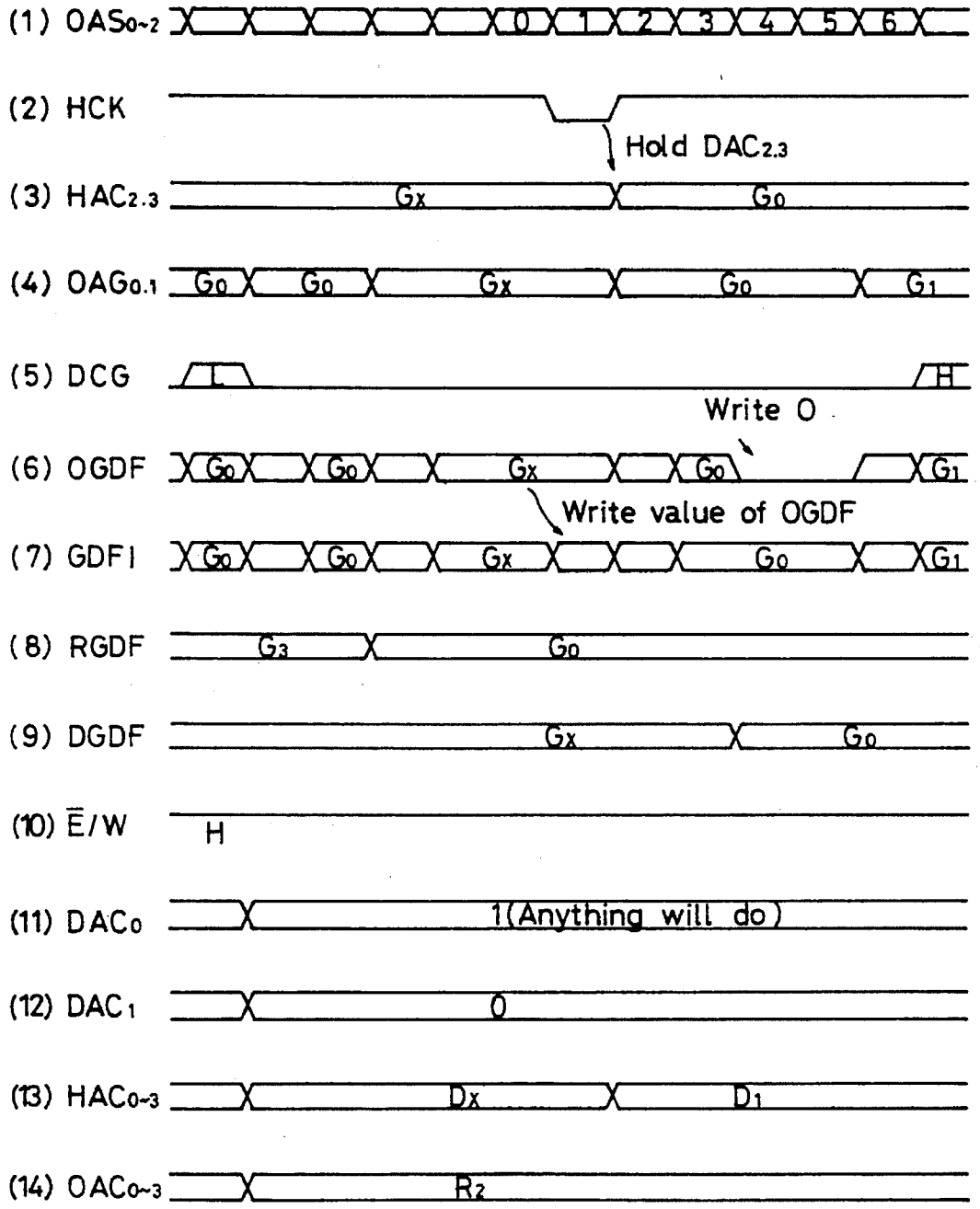
FIG. 17 is a timing chart for explaining the pattern A1 of FIG. 15 (8) in detail.
Figure 18:
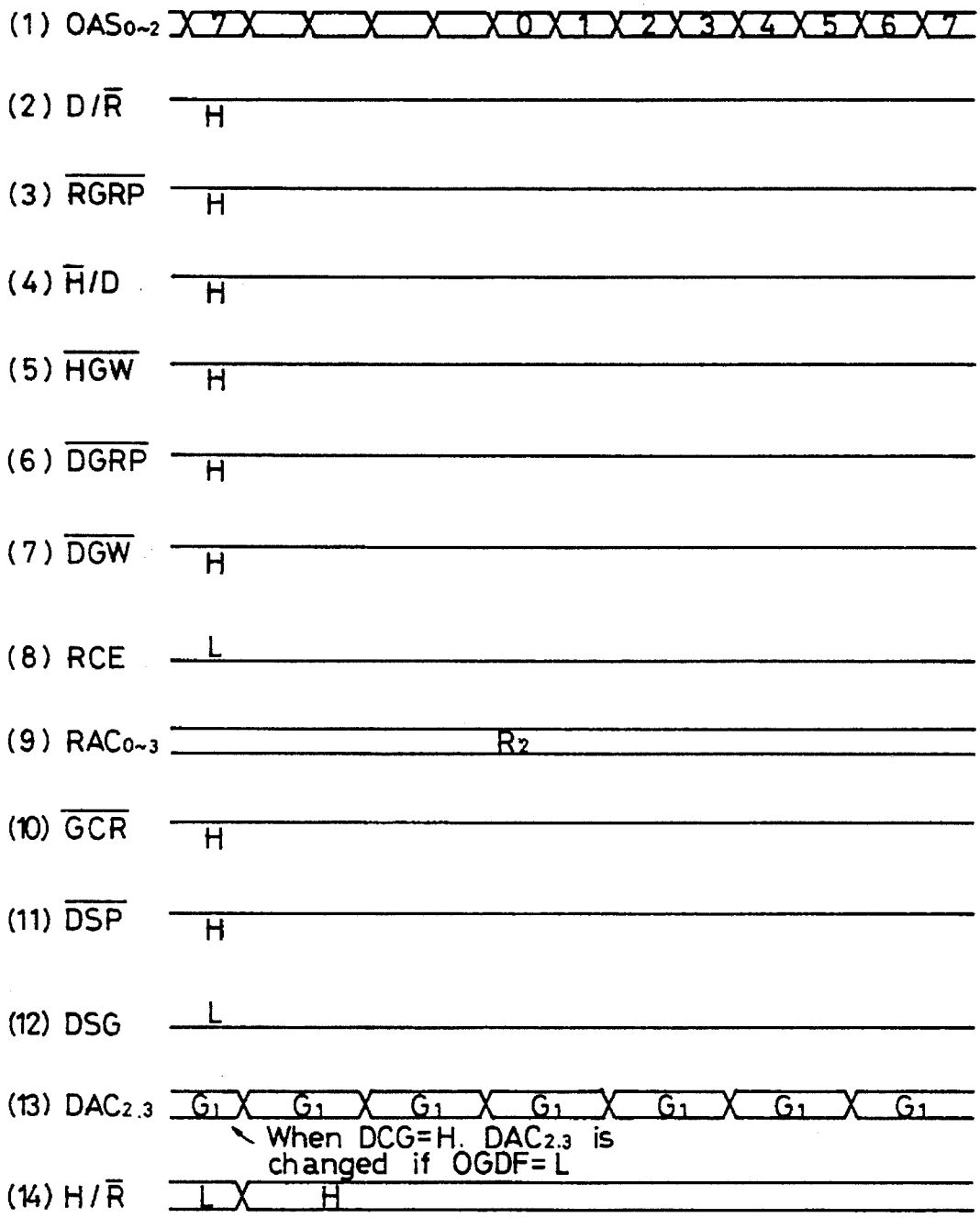
FIG. 18 is a timing chart for explaining a pattern B1 of FIG. 15 (8) in detail.
Figure 19:
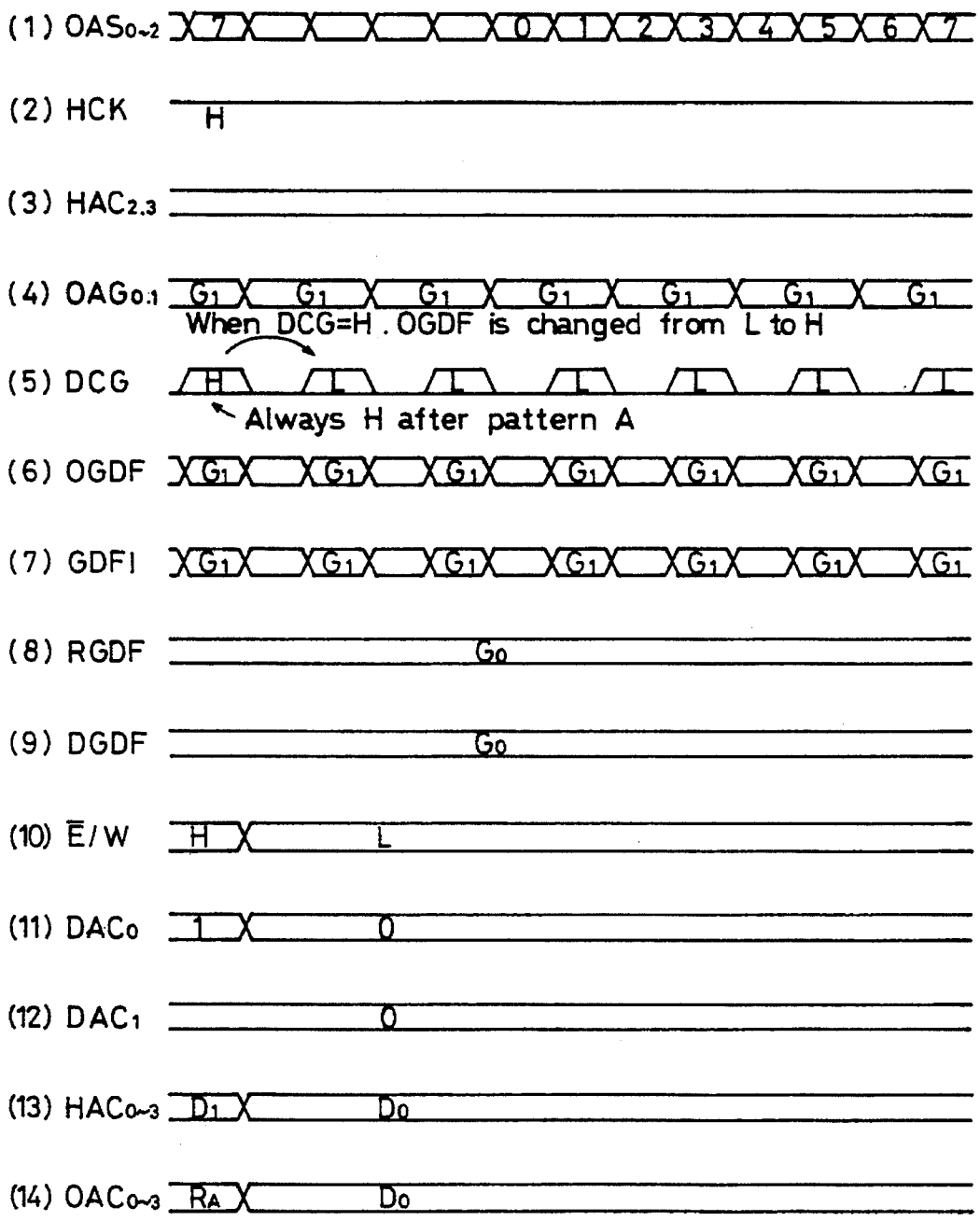
FIG. 19 is a timing chart for explaining the pattern B1 of FIG. 15 (8) in detail.
Figure 20:
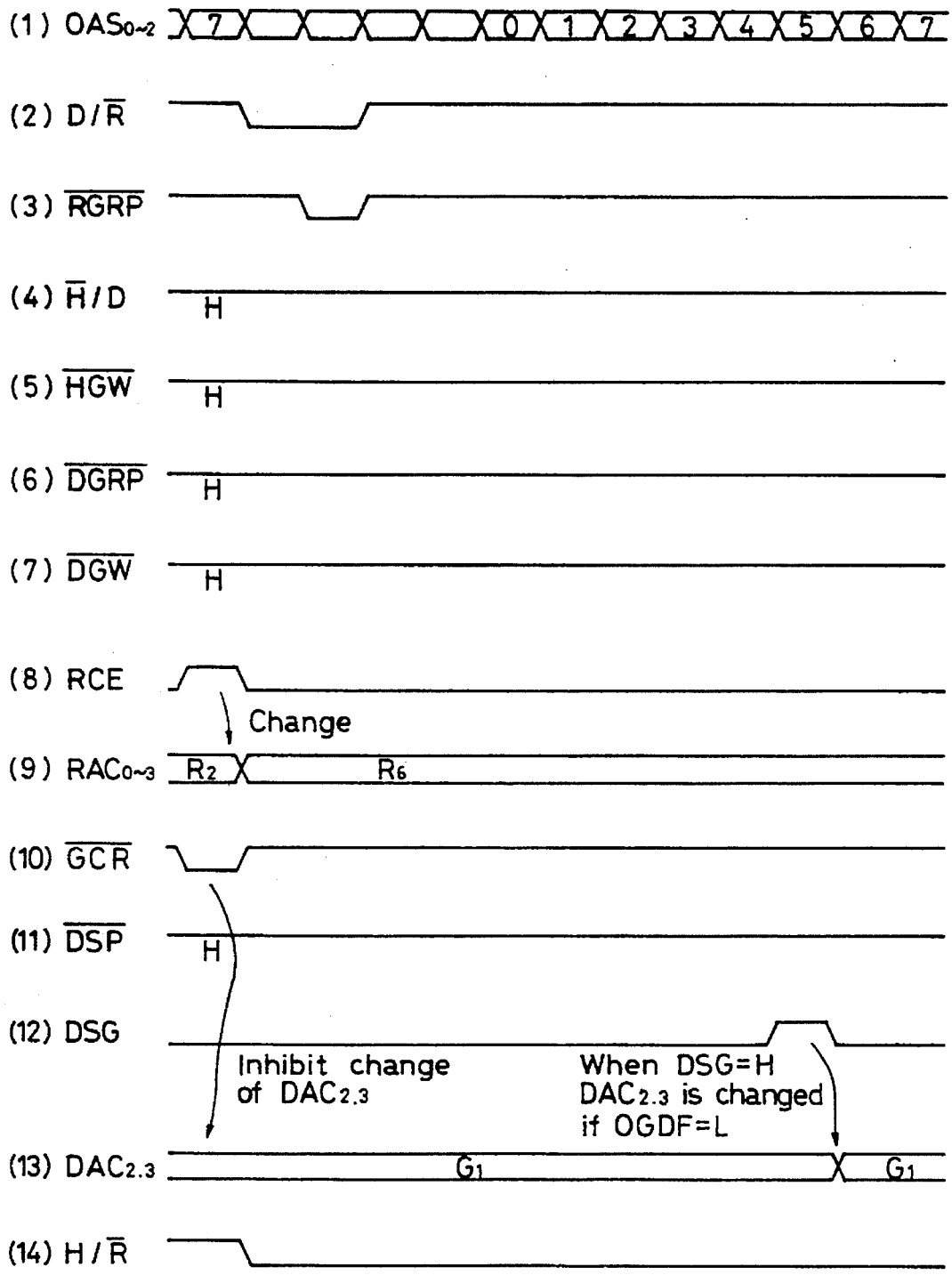
FIG. 20 is a timing chart for explaining a pattern Cl of FIG. 15 (8) in detail.
Figure 21:
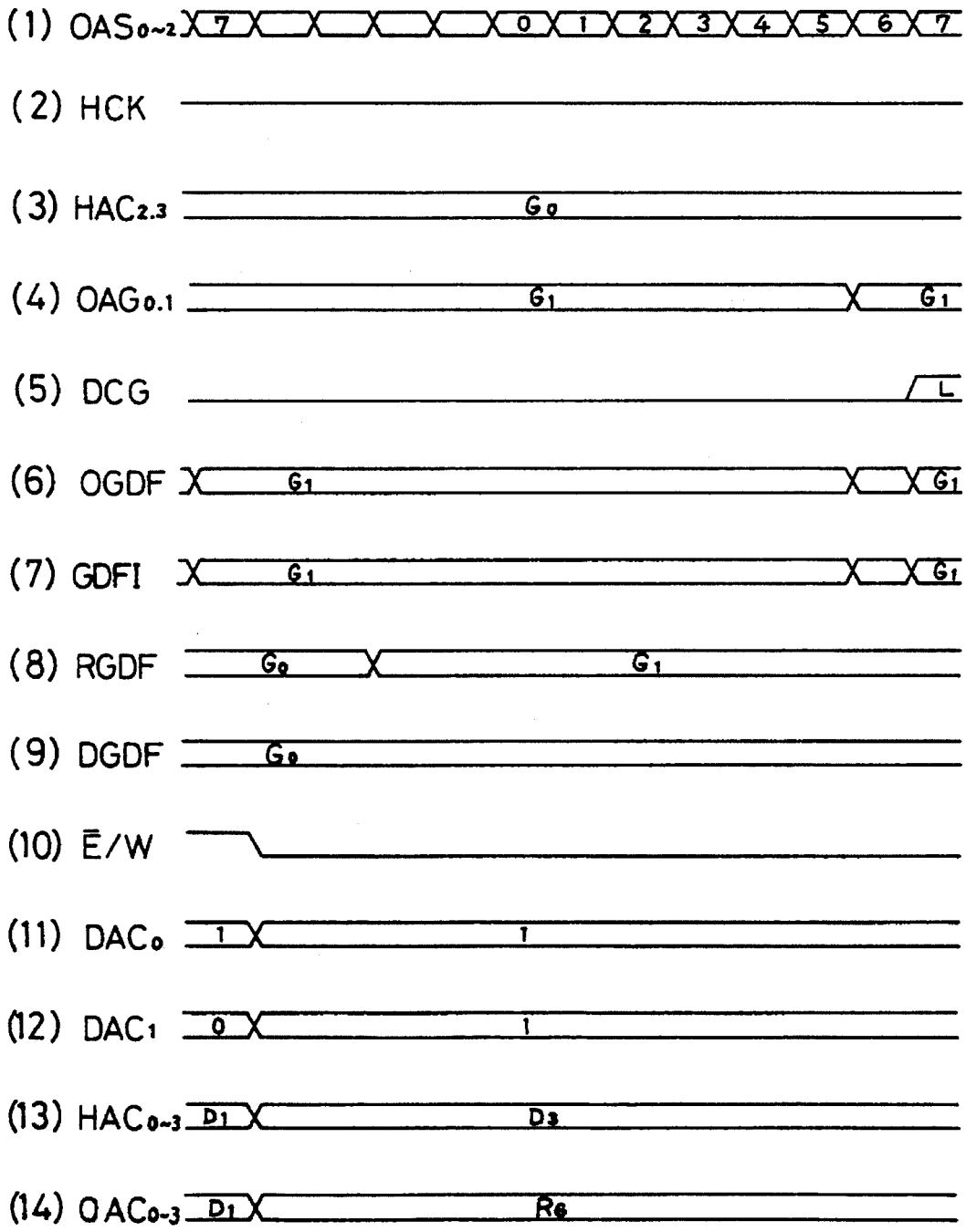
FIG. 21 is a timing chart for explaining the pattern C1 of FIG. 15 (8) in detail.
Figure 22:
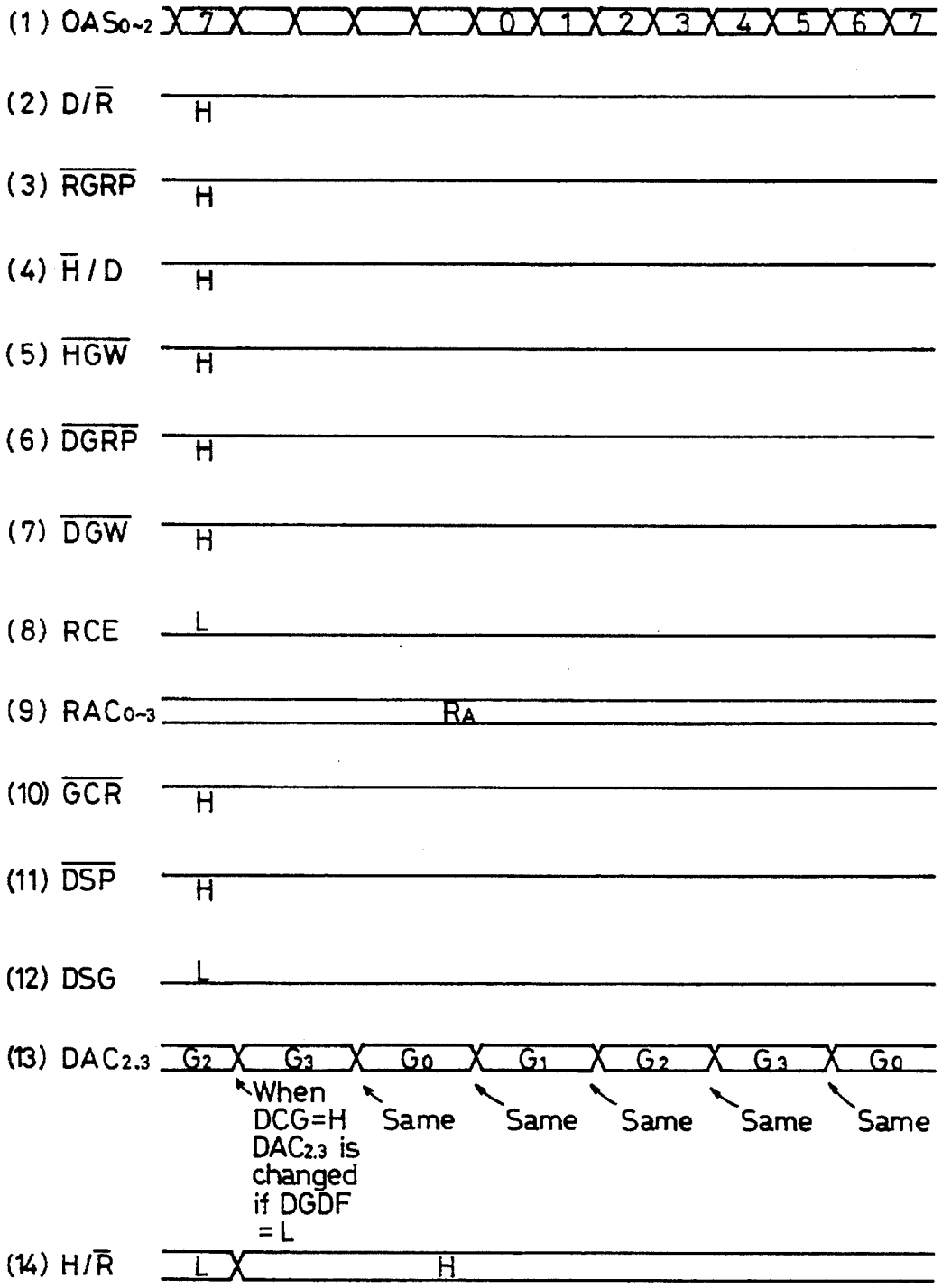
FIG. 22 is a timing chart for explaining, in detail, a pattern B11 to follow a pattern A2 of FIG. 15 (8)
Figure 23:
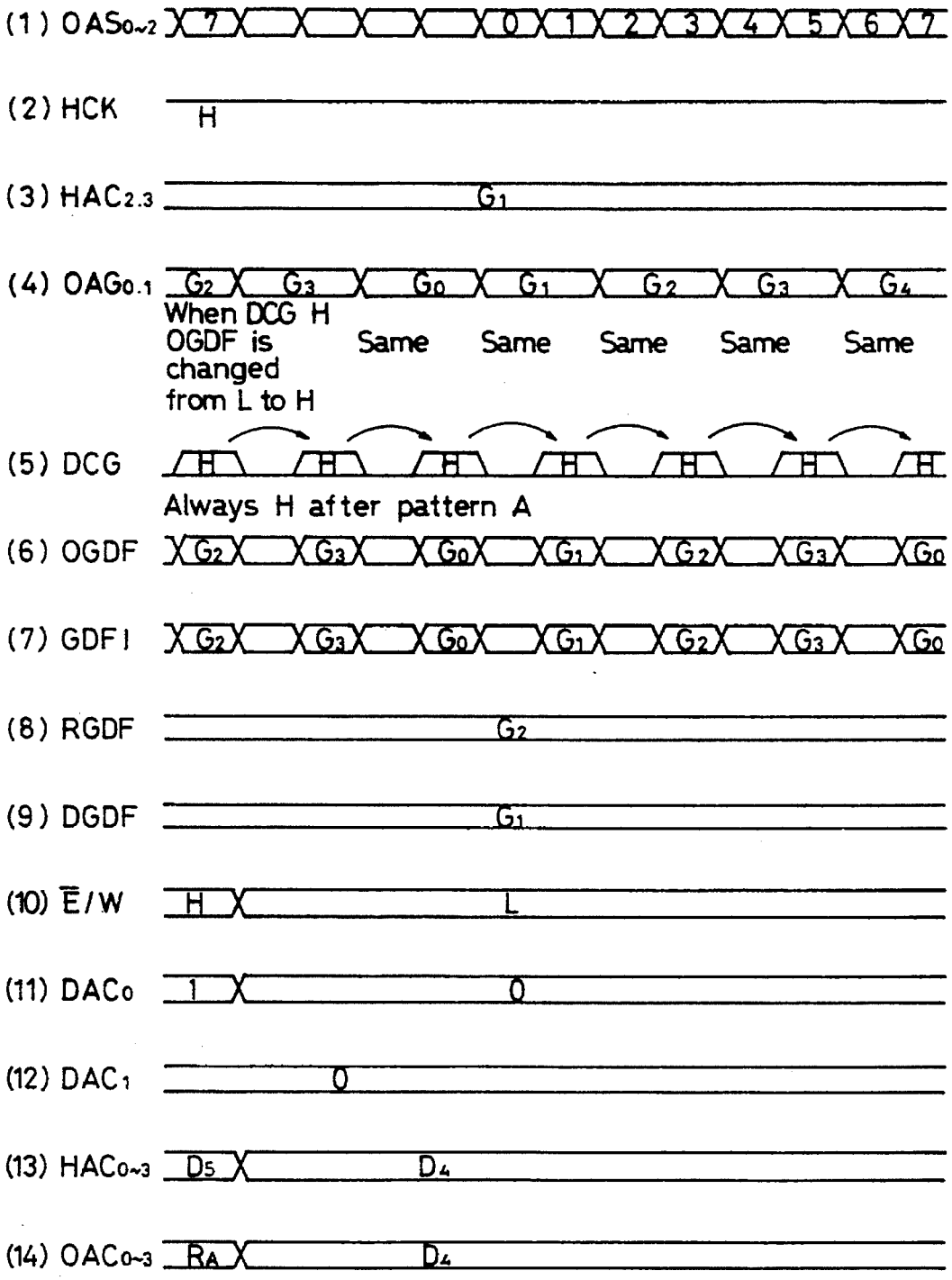
FIG. 23 is a timing chart for explaining, in detail, the pattern B11 to follow the pattern A2 of FIG. 15 (8)

FIGS. 16 and 17 are diagrams for explaining a pattern A1 of FIG. 15 (8) in detail. FIGS. 18 and 19 are diagrams for explaining a pattern B1 of FIG. 15 (8) in detail. FIGS. 20 and 21 are diagrams for explaining a pattern C1 of FIG. 15 (8) in detail. FIGS. 22 and 23 are diagrams for explaining, in detail, a pattern B11 to follow a pattern A2 of FIG. 15 (8).

Figure 10:
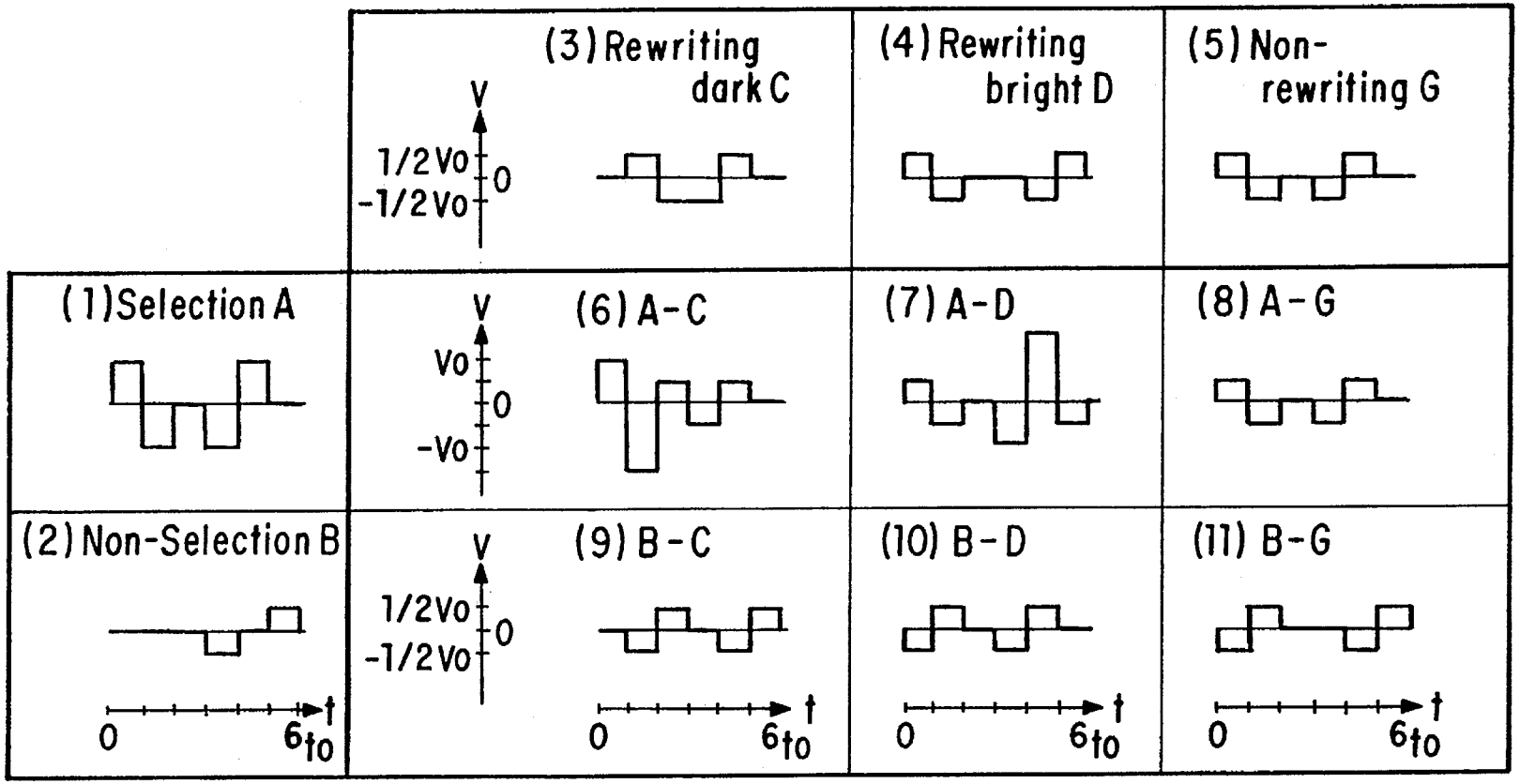
FIG. 10 is a diagram showing the waveform of each applied voltage used for driving an FLC panel disclosed in Japanese Unexamined Patent Publication No. 59389/1989.

In FIGS. 16, 18, 20 and 22, (1) shows an output column address OASx to be outputted from the output control circuit 19 to the display memory circuit 15 and the identity and difference memory circuit 17, (2) shows a switching signal D/R- for switching an output group address OAG0.1 into the N:1 jump scanning address RAC2.3 side, the output group address OAG0.1 being outputted from the output control circuit 19 to the identification memory circuit 16 through the address circuit 20, (3) shows a timing signal RGRP- for holding data selecting identification data GDFO read out from the identification memory circuit 16 as N:1 jump scan driving state data RGDF, (4) shows a switching signal H-/D for switching an output group address OAG0.1 into the address HAC2.3 side, the output group address OAG0.1 indicating an address where the data erasing identification data GDFI is brought into the same state as that of the data selecting identification data GDFO, (5) shows a timing pulse HGW- for bringing the data erasing identification data GDFI into the same state as that of the data selecting identification data GDFO, (6) shows a timing signal DGRP- for holding the data selecting identification data GDFO as the state data DGDF for the driving method of FIG. 10, (7) shows a timing signal DGW- for changing the state of the data selecting identification data GDFO into "unchanged display", (8) shows a timing pulse RCE for changing an N:1 jump scanning address RACx, (9) shows the N:1 jump scanning address RACx, (10) shows a timing pulse GCR- for recognizing the change of an address DAC2.3 only when a timing pulse DCG is HIGH, the address DAC2.3 serving to check the identification data OGDF inputted to the output control circuit 19 and represented as the data selecting identification data GDFO in the identification memory circuit 16, (11) shows a timing pulse DSP- for forcedly changing the address DAC2.3, (12) shows a timing pulse DSG for recognizing the change of the address DAC2.3 irrespective of whether the timing pulse DCG is HIGH or LOW, (13) shows the address DAC2.3, and (14) shows a drive mode signal H/R- outputted from the output control circuit 19 to the drive control circuit 21.

In FIGS. 17, 19, 21 and 23, (1) shows an output column address OASx to be outputted from the output control circuit 19 to the display memory circuit 15 and the identity and difference memory circuit 17, (2) shows a timing pulse HCK for holding the address DAC2.3 until the data of a scanning electrode group is completely read out, the address DAC2.3 serving to check the identification data OGDF, (3) shows an address HAC2.3 for the driving method of FIG. 10 thus held, (4) shows an output group address OAG0.1 obtained by switching the address RAC2.3 and an address (which is obtained by switching the address RAC2.3 and the address HAC2.3 by virtue of a switching signal H-/D) by virtue of a switching signal D/R- so as to be inputted to the identification memory circuit 16, (5) shows a timing pulse DCG for changing the address DAC2.3 when the data selecting identification data OGDF inputted from the identification memory circuit 16 is in the state of "unchanged display", (6) shows data selecting identification data OGDF indicating whether the display of pixels is changed for the scanning electrodes L0 to L3, L4 to L7, L8 to LB, and LC to LF, (7) shows data erasing identification data GDFI indicating whether the change of display of pixels has completely been read out for the scanning electrodes L0 to L3, L4 to L7, L8 to LB, and LC to LF, (8) shows N:1 jump scan driving state data RGDF read out from the identification memory circuit 16, (9) shows state data DGDF for the driving method of FIG. 10 read out from the identification memory circuit 16, (10) shows a voltage mode signal E-/W to be outputted from the output control circuit 19 to the drive control circuit 21, (11) shows a first lower address DAC0 for the driving method of FIG. 10, (12) shows a second lower address DAC1 for the driving method of FIG. 10, (13) shows an address HACx for the driving method of FIG. 10 which includes addresses HAC2.3 and DAC0.1, and (14) shows an output line address OACx to be outputted from the output control circuit 19 to the display memory circuit 15, the identity and difference memory circuit 17 and the drive control circuit 21 through the address circuit 20.

Assuming that data "E B C D" shown in FIG. 7 is recorded on the display memory circuit 15, data shown in FIG. 9 is recorded on the identification memory circuit 16 and data shown in FIG. 11 is recorded on the identity and difference memory circuit 17 before the pattern A1 of FIG. 15 by 2 to 11 patterns (for example, B8 is a pattern before a pattern A2 by 3 patterns), the operations carried out on the output side will be proceeded.

After the data shown in FIG. 9 is recorded on the identification memory circuit 16, an output group address OAG0.1=0 is outputted to the identification memory circuit 16 and the data selecting identification data OGDF is checked. Since the data selecting identification data OGDF is in the state of "changed display", an address DAC2.3=0 is kept. Then, a pattern A1 shown in FIGS. 16 and 17 is reached.

There will be described each pattern shown in FIG. 15 (8).

(A1) Referring to a pattern A1, the following operations are carried out as shown in FIGS. 16 and 17. The control signal GCR- is first set to LOW to inhibit the change of the address DAC2.3. The N:1 jump scan driving address RACx is changed from LD to L2. The drive mode H/R- is set to LOW. The fact of N:1 jump scan driving is inputted to the drive control circuit 21. An output line address OACx=L2 is inputted to the display memory circuit 15, the identity and difference memory circuit 17 and the drive control circuit 21 (At this time, the address DAC1 is equal to 1).

Then, the address switching signal D/R- is set to LOW to bring down the output group address OAG0.1 to the address RAC2.3 side. A scanning electrode group G0 (which corresponds to the scanning electrodes L0 to L3) is inputted to the identification memory circuit 16. The data selecting identification data GDFO of a group address AG0.1=0 (the data erasing identification data GDFI can be used) is captured at such a timing that the control signal RGRP- is LOW and is inputted as the N:1 jump scan driving state data RGDF to the drive control circuit 21. The address switching signal H-/D is set to LOW to bring down the output group address OAG0.1 to the address HAC2.3 side. A scanning electrode group Gx (which is earlier selected for the driving method of FIG. 10) is inputted to the identification memory circuit 16. The data erasing identification data GDFI of the group address AG0.1=Gx is brought into the same state as that of the data selecting identification data GDFO of the group address AG0.1=Gx at such a timing that the control signal HGW- is LOW. At the same time, the address DAC2.3 is held and changed into the address HAC2.3 at the leading edge of the control signal HCK.

Thereafter, the output group address OAG0.1 is brought down to the address DAC2.3 side to input G0 to the identification memory circuit 16, The data selecting identification data GDFO of the group address AG0.1=0 (the data erasing identification data GDFI can be used) is captured at such a timing that the control signal DGRP- is LOW, and is inputted as the state data DGDF for the driving method of FIG. 10 to the drive control circuit 21. Then, the data selecting identification data GDFO of the group address AG0.1=0 is brought into the state of "unchanged display" at such a timing that the control signal DGW- is LOW.

Subsequently, the address DAC2.3 is forcedly changed from 0 to 1 by the control signal DSP- to input an output group address OAG0.1=1 to the identification memory circuit 16. The data selecting identification data GDFO of a group address AG0.1=G1 is inputted as the identification data OGDF to the output control circuit 19 to check whether a scanning electrode group G1 is in the state of "changed display" or "unchanged display". If the data selecting identification data OGDF is in the state of "unchanged display" when the control signal DCG is HIGH, the address DAC2.3 is changed from 1 to 2 (the control signal DCG is set to HIGH after an address period 2OASx since the control signal DSP- has been set to LOW). Since the data selecting identification data GDFO of the address AG0.1=G1 shown in FIG. 9 is in the state of "changed display", the address DAC2.3 is kept 1.

According to the pattern A1, the following operations are carried out as shown in FIG. 15. The output line address OACx=L2 is outputted from the address circuit 20 to the drive control circuit 21. The drive mode H/R-=LOW and voltage mode E-/W=HIGH are outputted from the output control circuit 19 to the drive control circuit 21. The display data DA of the scanning electrode L2 is outputted from the display memory circuit 15 to the drive control circuit 21 correspondingly to the change of OASx=0 to 7. The identity and difference data DF of the scanning electrode L2 is outputted from the identity and difference memory circuit 17 to the drive control circuit 21 correspondingly to the change of OASx=0 to 7. The state data RGDF of the N:1 jump scan driving scanning electrode group G0 and the state data DGDF of the scanning electrode group G0 for the driving method of FIG. 10 are outputted from the identification memory circuit 16 to the drive control circuit 21.

(B1) Referring to a pattern B1, the following operations are carried out as shown in FIGS. 18 and 19. The drive mode H/R- is first set to HIGH to input the fact of driving shown in FIG. 10 to the drive control circuit 1. The voltage mode E-/W is set to LOW and inputted to the drive control circuit 21. The address DAC0 is set to 0. The address HACx for driving shown in FIG. 10 which includes the addresses DAC0.1 and HAC2.3 is set to L0, An output line address OACx=L0 is inputted to the display memory circuit 15, the identity and difference memory circuit 17 and the drive control circuit 21.

Other signals are not changed. According to the pattern B1, consequently, the following operations are carried out as shown in FIG. 15. The output line address OACx=L0 is outputted from the address circuit 20 to the drive control circuit 21. The drive mode H/R-=HIGH and voltage mode E-/W=LOW are outputted from the output control circuit 19 to the drive control circuit 21. The display data DA of the scanning electrode L0 is outputted from the display memory circuit 15 to the drive control circuit 21 correspondingly to the change of OASx=0 to 7. The identity and difference data DF of the scanning electrode L0 is outputted from the identity and difference memory circuit 17 to the drive control circuit 21 correspondingly to the change of OASx=0 to 7. The state data RGDF of the N:1 jump scan driving scanning electrode group G0 and the state data DGDF of the scanning electrode group G0 for the driving method of FIG. 10 are outputted from the identification memory circuit 16 to the drive control circuit 21.

(B2) Also referring to a pattern B2, the following operations are carried out in the same manner as in FIGS. 18 and 19. The drive mode H/R- is kept HIGH to input the fact of driving shown in FIG. 10 to the drive control circuit 21. The voltage mode E-/W is kept LOW and inputted to the drive control circuit 21. The address DAC0 is set to 1. The address HACx for driving shown in FIG. 10 which includes the addresses DAC0.1 and HAC2.3 is set to L1. An output line address OACx=L1 is inputted to the display memory circuit 15, the identity and difference memory circuit 17 and the drive control circuit 21.

Other signals are not changed. According to the pattern B2, consequently, the following operations are carried out as shown in FIG. 15. The output line address OACx=L1 is outputted from the address circuit 20 to the drive control circuit 21. The drive mode H/R-=HIGH and voltage mode E-/W=LOW are outputted from the output control circuit 19 to the drive control circuit 21. The display data DA of the scanning electrode L1 is outputted from the display memory circuit 15 to the drive control circuit 21 correspondingly to the change of OASx=0 to 7. The identity and difference data DF of the scanning electrode L1 is outputted from the identity and difference memory circuit 17 to the drive control circuit 21 correspondingly to the change of OASx=0 to 7. The state data RGDF of the N:1 jump scan driving scanning electrode group G0 and the state data DGDF of the scanning electrode group G0 for the driving method of FIG. 10 are outputted from the identification memory circuit 16 to the drive control circuit 21.

(B3) Also referring to a pattern B3, the following operations are carried out in the same manner as in FIGS. 18 and 19. The drive mode H/R- is first set to LOW to input the fact of the N:1 jump scan driving to the drive control circuit 21. The voltage mode E-/W is kept LOW and inputted to the drive control circuit 21. An N:1 jump scan driving address RACx=L2 is inputted as the output line address OACx to the display memory circuit 15, the identity and difference memory circuit 17 and the drive control circuit 21.

Other signals are not changed. According to the pattern B3, consequently, the following operations are carried out as shown in FIG. 15. The output line address OACx=L2 is outputted from the address circuit 20 to the drive control circuit 21. The drive mode H/R-=LOW and voltage mode E-/W=LOW are outputted from the output control circuit 19 to the drive control circuit 21. The display data DA of the scanning electrode L2 is outputted from the display memory circuit 15 to the drive control circuit 21 correspondingly to the change of OASx=0 to 7. The identity and difference data DF of the scanning electrode L2 is outputted from the identity and difference memory circuit 17 to the drive control circuit 21 correspondingly to the change of OASx=0 to 7. The state data RGDF of the N:1 jump scan driving scanning electrode group G0 and the state data DGDF of the scanning electrode group G0 for the driving method of FIG. 10 are outputted from the identification memory circuit 16 to the drive control circuit 21.

(B4) Also referring to a pattern B4, the following operations are carried out in the same manner as in FIGS. 18 and 19. The drive mode H/R- is first set to HIGH to input the fact of driving shown in FIG. 10 to the drive control circuit 21. The voltage mode E-/W is set to HIGH and inputted to the drive control circuit 21. The address DAC0 is set to 0. The address HACx for driving shown in FIG. 10 which includes the addresses DAC0.1 and HAC2.3 is set to L0. The output line address OACx=L0 is inputted to the display memory circuit 15, the identity and difference memory circuit 17 and the drive control circuit 21.

Other signals are not changed. According to the pattern B4, consequently, the following operations are carried out as shown in FIG. 15. The output line address OACx=L0 is outputted from the address circuit 20 to the drive control circuit 21. The drive mode H/R-=HIGH and voltage mode E-/W=HIGH are outputted from the output control circuit 19 to the drive control circuit 21. The display data DA of the scanning electrode L0 is outputted from the display memory circuit 15 to the drive control circuit 21 correspondingly to the change of OASx=0 to 7. The identity and difference data DF of the scanning electrode L0 is outputted from the identity and difference memory circuit 17 to the drive control circuit 21 correspondingly to the change of OASx=0 to 7. The state data RGDF of the N:1 jump scan driving scanning electrode group G0 and the state data DGDF of the scanning electrode group G0 for the driving method of FIG. 10 are outputted from the identification memory circuit 16 to the drive control circuit 21.

(B5) Also referring to a pattern B5, the following operations are carried out in the same manner as in FIGS. 18 and 19. The drive mode H/R- is kept HIGH to input the fact of driving shown in FIG. 10 to the drive control circuit 21. The voltage mode E-/W is kept HIGH and inputted to the drive control circuit 21. The address DAC0 is set to 0. The address HACx for the driving method of FIG. 10 which includes the addresses DAC0.1 and HAC2.3 is set to L1. The output line address OACx=L1 is inputted to the display memory circuit 15, the identity and difference memory circuit 17 and the drive control circuit 21.

Other signals are not changed. According to the pattern B5, consequently, the following operations are carried out as shown in FIG. 15. The output line address OACx=L1 is outputted from the address circuit 20 to the drive control circuit 21. The drive mode H/R-=HIGH and voltage mode E-/W=HIGH are outputted from the output control circuit 19 to the drive control circuit 21. The display data DA of the scanning electrode L1 is outputted from the display memory circuit 15 to the drive control circuit 21 correspondingly to the change of OASx=0 to 7. The identity and difference data DF of the scanning electrode L1 is outputted from the identity and difference memory circuit 17 to the drive control circuit 21 correspondingly to the change of OASx=0 to 7. The state data RGDF of the N:1 jump scan driving scanning electrode group G0 and the state data DGDF of the scanning electrode group G0 for the driving method of FIG. 10 are outputted from the identification memory circuit 16 to the drive control circuit 21.

(C1) Referring to a pattern C1, the following operations are carried out as shown in FIGS. 20 and 21. The control signal GCR- is first set to LOW to inhibit the change of the address DAC2.3. The N:1 jump scan driving address RACx is changed from L2 to L6. The drive mode H/R- is set to LOW. The fact of N:1 jump scan driving is inputted to the drive control circuit 21. An output line address OACx=L6 is inputted to the display memory circuit 15, the identity and difference memory circuit 17 and the drive control circuit 21 (At this time, the address DAC1 is equal to 1).

Then, the address switching signal D/R- is set to LOW to bring down the output group address OAG0.1 to the address RAC2.3 side. The scanning electrode group G1 (which corresponds to the scanning electrodes L4 to L7) is inputted to the identification memory circuit 16. The data selecting identification data GDFO of a group address AG0.1=1 is captured at such a timing that the control signal RGRP- is LOW and is inputted as the N:1 jump scan driving state data RGDF to the drive control circuit 21.

Thereafter, the control signal DSG is set to HIGH to check whether the data selecting identification data OGDF of the scanning electrode group G1 is in the state of "changed display" or "unchanged display" irrespective of whether the control signal DCG is LOW or HIGH. If the data selecting identification data OGDF is in the state of "unchanged display", the address DAC2.3 is changed from 1 to 2. Since the data selecting identification data GDFO of the address AG0.1=G1 shown in FIG. 9 is in the state of "changed display", the address DAC2.3 is kept 1.

Other signals are not changed. According to the pattern Cl, consequently, the following operations are carried out as shown in FIG. 15. The output line address OACx=L6 is outputted from the address circuit 20 to the drive control circuit 21. The drive mode H/R-=LOW and voltage mode E-/W=HIGH are outputted from the output control circuit 19 to the drive control circuit 21. The display data DA of the scanning electrode L6 is outputted from the display memory circuit 15 to the drive control circuit 21 correspondingly to the change of OASx=0 to 7. The identity and difference data DF of the scanning electrode L6 is outputted from the identity and difference memory circuit 17 to the drive control circuit 21 correspondingly to the change of OASx=0 to 7. The state data RGDF of the N:1 jump scan driving scanning electrode group G1 and the state data DGDF of the scanning electrode group G0 for the driving method of FIG. 10 are outputted from the identification memory circuit 16 to the drive control circuit 21.

(B6) Also referring to a pattern B6, the following operations are carried out in the same manner as in FIGS. 18 and 19. The drive mode H/R- is first set to HIGH to input the fact of driving shown in FIG. 10 to the drive control circuit 21. The voltage mode E-/W is set to LOW and inputted to the drive control circuit 21. The address DAC0 is set to 0. The address HACx for the driving method of FIG. 10 which includes the addresses DAC0.1 and HAC2.3 is set to L2. The output line address OACx=L2 is inputted to the display memory circuit 15, the identity and difference memory circuit 17 and the drive control circuit 21.

Other signals are not changed. According to the pattern B6, consequently, the following operations are carried out as shown in FIG. 15. The output line address OACx=L2 is outputted from the address circuit 20 to the drive control circuit 21. The drive mode H/R-=HIGH and voltage mode E-/W=LOW are outputted from the output control circuit 19 to the drive control circuit 21. The display data DA of the scanning electrode L2 is outputted from the display memory circuit 15 to the drive control circuit 21 correspondingly to the change of OASx=0 to 7. The identity and difference data DF of the scanning electrode L2 is outputted from the identity and difference memory circuit 17 to the drive control circuit 21 correspondingly to the change of OASx=0 to 7. The state data RGDF of the N:1 jump scan driving scanning electrode group G1 and the state data DGDF of the scanning electrode group G0 for the driving method of FIG. 10 are outputted from the identification memory circuit 16 to the drive control circuit 21.

(B7) Also referring to a pattern B7, the following operations are carried out in the same manner as in FIGS. 18 and 19. The drive mode H/R- is kept HIGH to input the fact of driving shown in FIG. 10 to the drive control circuit 21. The voltage mode E-/W is kept LOW and inputted to the drive control circuit 21. The address DAC0 is set to 1. The address HACx for the driving method of FIG. 10 which includes the addresses DAC0.1 and HAC2.3 is set to L3. An output line address OACx=L3 is inputted to the display memory circuit 15, the identity and difference memory circuit 17 and the drive control circuit 21.

Other signals are not changed. According to the pattern B7, consequently, the following operations are carried out as shown in FIG. 15. The output line address OACx=L3 is outputted from the address circuit 20 to the drive control circuit 21. The drive mode H/R-=HIGH and voltage mode E-/W=LOW are outputted from the output control circuit 19 to the drive control circuit 21. The display data DA of the scanning electrode L3 is outputted from the display memory circuit 15 to the drive control circuit 21 correspondingly to the change of OASx=0 to 7. The identity and difference data DF of the scanning electrode L3 is outputted from the identity and difference memory circuit 17 to the drive control circuit 21 correspondingly to the change of OASx=0 to 7. The state data RGDF of the N:1 jump scan driving scanning electrode group G1 and the state data DGDF of the scanning electrode group G0 for the driving method of FIG. 10 are outputted from the identification memory circuit 16 to the drive control circuit 21.

(B8) Also referring to a pattern B8, the following operations are carried out in the same manner as in FIGS. 18 and 19. The drive mode H/R- is first set to LOW to input the fact of the N:1 jump scan driving to the drive control circuit 21. The voltage mode E-/W is kept LOW and inputted to the drive control circuit 21. An N:1 jump scan driving address RACx=L6 is inputted as the output line address OACx to the display memory circuit 15, the identity and difference memory circuit 17 and the drive control circuit 21.

Other signals are not changed. According to the pattern B8, consequently, the following operations are carried out as shown in FIG. 15. The output line address OACx=L6 is outputted from the address circuit 20 to the drive control circuit 21. The drive mode H/R-=LOW and voltage mode E-/W=LOW are outputted from the output control circuit 19 to the drive control circuit 21. The display data DA of the scanning electrode L6 is outputted from the display memory circuit 15 to the drive control circuit 21 correspondingly to the change of OASx=0 to 7. The identity and difference data DF of the scanning electrode L6 is outputted from the identity and difference memory circuit 17 to the drive control circuit 21 correspondingly to the change of OASx=0 to 7. The state data RGDF of the N:1 jump scan driving scanning electrode group G1 and the state data DGDF of the scanning electrode group G0 for the driving method of FIG. 10 are outputted from the identification memory circuit 16 to the drive control circuit 21.

(B9) Also referring to a pattern B9, the following operations are carried out in the same manner as in FIGS. 18 and 19. The drive mode H/R- is first set to HIGH to input the fact of driving shown in FIG. 10 to the drive control circuit 21. The voltage mode E-/W is set to HIGH and inputted to the drive control circuit 21. The address DAC0 is set to 0. The address HACx for the driving method of FIG. 10 which includes the addresses DAC0.1 and HAC2.3 is set to L2. The output line address OACx=L2 is inputted to the display memory circuit 15, the identity and difference memory circuit 17 and the drive control circuit 21.

Other signals are not changed. According to the pattern B9, consequently, the following operations are carried out as shown in FIG. 15. The output line address OACx=L2 is outputted from the address circuit 20 to the drive control circuit 21. The drive mode H/R-=HIGH and voltage mode E-/W=HIGH are outputted from the output control circuit 19 to the drive control circuit 21. The display data DA of the scanning electrode L2 is outputted from the display memory circuit 15 to the drive control circuit 21 correspondingly to the change of OASx=0 to 7. The identity and difference data DF of the scanning electrode L2 is outputted from the identity and difference memory circuit 17 to the drive control circuit 21 correspondingly to the change of OASx=0 to 7. The state data RGDF of the N:1 jump scan driving scanning electrode group G1 and the state data DGDF of the scanning electrode group G0 for the driving method of FIG. 10 are outputted from the identification memory circuit 16 to the drive control circuit 21.

(B10) Also referring to a pattern B10, the following operations are carried out in the same manner as in FIGS. 18 and 19. The drive mode H/R- is kept HIGH to input the fact of driving shown in FIG. 10 to the drive control circuit 21. The voltage mode E-/W is kept HIGH and inputted to the drive control circuit 21. The address DAC0 is set to 1. The address HACx for the driving method of FIG. 10 which includes the addresses DAC0.1 and HAC2.3 is set to L3. The output line address OACx=L3 is inputted to the display memory circuit 15, the identity and difference memory circuit 17 and the drive control circuit Other signals are not changed. According to the pattern B10, consequently, the following operations are carried out as shown in FIG. 15. The output line address OACx=L3 is outputted from the address circuit 20 to the drive control circuit 21. The drive mode H/R-=HIGH and voltage mode E-/W=HIGH are outputted from the output control circuit 19 to the drive control circuit 21. The display data DA of the scanning electrode L3 is outputted from the display memory circuit 15 to the drive control circuit 21 correspondingly to the change of OASx=0 to 7. The identity and difference data DF of the scanning electrode L3 is outputted from the identity and difference memory circuit 17 to the drive control circuit 21 correspondingly to the change of OASx=0 to 7. The state data RGDF of the N:1 jump scan driving scanning electrode group G1 and the state data DGDF of the scanning electrode group G0 for the driving method of FIG. 10 are outputted from the identification memory circuit 16 to the drive control circuit 21.

(A2) Referring to a pattern A2, the following operations are carried out in the same manner as in FIGS. 16 and 17. The control signal GCR- is first set to LOW to inhibit the change of the address DAC2.3. The N:1 jump scan driving address RACx is changed from L6 to LA. The drive mode H/R- is set to LOW. The fact of N:1 jump scan driving is inputted to the drive control circuit 21. An output line address OACx=LA is inputted to the display memory circuit 15, the identity and difference memory circuit 17 and the drive control circuit 21 (At this time, the address DAC1 is set to 0).

Then, the address switching signal D/R- is set to LOW to bring down the output group address OAG0.1 to the address RAC2.3 side. A scanning electrode group G2 (which corresponds to the scanning electrodes L8 to LB) is inputted to the identification memory circuit 16. The data selecting identification data GDFO of a group address AG0.1=G2 is captured at such a timing that the control signal RGRP- is LOW and is inputted as the N:1 jump scan driving state data RGDF to the drive control circuit 21.

Thereafter, the address switching signal H-/D is set to LOW to bring down the output group address OAG0.1 to the address HAC2.3 side. G0 is inputted to the identification memory circuit 16. The data erasing identification data GDFI of a group address AG0.1=G0 is brought into the same state as that of the data selecting identification data GDFO of the group address AG0.1=G0 at such a timing that the control signal HGW- is LOW. The address DAC2.3 is held and changed into the address HAC2.3 at the leading edge of the control signal HCK.

Subsequently, the output group address OAG0.1 is brought down to the address DAC2.3 side to input G1 to the identification memory circuit 16. The data selecting identification data GDFO of the group address AG0.1=G1 is captured at such a timing that the control signal DGRP- is LOW, and is inputted as the state data DGDF for the driving method of FIG. 10 to the drive control circuit 21.

Next, the data selecting identification data GDFO of the group address AG0.1=G1 is brought into the state of "unchanged display" at such a timing that the control signal DGW- is LOW. The address DAC2.3 is changed from 1 to 2 by the control signal DSP- to input an output group address OAG0.1=G2 to the identification memory circuit 16. The data selecting identification data GDFO of the group address AG0.1=G2 is inputted as the identification data OGDF to the output control circuit 19 to check whether the scanning electrode group G2 is in the state of "changed display" or "unchanged display".

If the data selecting identification data OGDF is in the state of "changed display" when the control signal DCG is HIGH, the address DAC2.3 is kept 2 (the control signal DCG is first set to HIGH after an address period 2OASx since the control signal DSP- has been set to LOW). Since the data selecting identification data GDFO of the address AG0.1=G2 shown in FIG. 9 is in the state of "unchanged display", the address DAC2.3 is changed from 2 to 3. The control signal DCG ought to be set to HIGH again after the address period 2OASx (this portion is included in the pattern B11).

According to the pattern A2, the following operations are carried out as shown in FIG. 15. The output line address OACx=LA is outputted from the address circuit 20 to the drive control circuit 21. The drive mode H/R-=LOW and voltage mode E-/W=HIGH are outputted from the output control circuit 19 to the drive control circuit 21. The display data DA of the scanning electrode LA is outputted from the display memory circuit 15 to the drive control circuit 21 correspondingly to the change of OASx= 0 to 7. The identity and difference data DF of the scanning electrode LA is outputted from the identity and difference memory circuit 17 to the drive control circuit 21 correspondingly to the change of OASx=0 to 7. The state data RGDF of the N:1 jump scan driving scanning electrode group G2 and the state data DGDF of the scanning electrode group G1 for the driving method of FIG. 10 are outputted from the identification memory circuit 16 to the drive control circuit 21.

(B11) Referring to a pattern B11, the following operations are carried out as shown in FIGS. 22 and 23. The address DAC2.3 is first changed from 2 to 3, which is expected in the pattern A2. An output group address OAG0.1=G3 is inputted to the identification memory circuit 16. Then, the drive mode H/R- is set to HIGH to input the fact of driving shown in FIG. 10 to the drive control circuit 21. The voltage mode E-/W is set to LOW and inputted to the drive control circuit 21. The address HACx for the driving method of FIG. 10 which includes the addresses DAC0.1 and HAC2.3 is set to L4. An output line address OACx=L4 is inputted to the display memory circuit 15, the identity and difference memory circuit 17 and the drive control circuit 21.

The data selecting identification data GDFO of a group address AG0.1=G3 is inputted as the identification data OGDF to the output control circuit 19 to check whether a scanning electrode group G3 is in the state of "changed display" or "unchanged display". If the data selecting identification data OGDF is in the state of "changed display" when the control signal DCG is HIGH, the address DAC2.3 is kept 3 (the control signal DCG is set to HIGH again after an address period 2OASx since the address DAC2.3 has been changed). Since the data selecting identification data GDFO of the address AG0.1=G3 shown in FIG. 9 is in the state of "unchanged display", the address DAC2.3 is changed from 3 to 0 and the output group address OAG0.1=0 is inputted to the identification memory circuit 16.

Then, the data selecting identification data GDFO of the group address AG0.1=G0 is inputted as the identification data OGDF to the output control circuit 19 to check whether the scanning electrode group G0 is in the state of "changed display" or "unchanged display" when the control signal DCG is HIGH. Although the address AG0.1=G0 shown in FIG. 9 is in the state of "changed display", the data selecting identification data GDFO of the address AG0.1=G0 is in the state of "unchanged display" because the data selecting identification data GDFO has preliminarily been returned to the state of "unchanged display" in the pattern A1. The address DAC2.3 is changed from 0 to 1. The output group address OAG0.1=1 is inputted to the identification memory circuit 16.

Thereafter, the data selecting identification data GDFO of the group address AG0.1=G1 is inputted as the identification data OGDF to the output control circuit 19 to check whether the scanning electrode group G1 is in the state of "changed display" or "unchanged display" when the control signal DCG is HIGH. Although the address AG0.1=G1 shown in FIG. 9 is in the state of "changed display", the data selecting identification data GDFO of the address AG0.1=G1 is in the state of "unchanged display" because the data selecting identification data GDFO has preliminarily been returned to the state of "unchanged display" in the pattern A2. The address DAC2.3 is changed from 1 to 2. The output group address OAG0.1=G2 is inputted to the identification memory circuit 16. Subsequently, this operation is continued in the pattern B, interrupted when the control signal DCE is LOW and started again when the control signal DSG is HIGH in the pattern C, and ended when the control signal DCE is LOW in the pattern A.

Thus, the display controller 13 is operated in a cycle where the pattern A is once executed, the pattern B is executed five times, the pattern C is once executed and the pattern B is executed five times. Also during the execution of these output patterns, the data Data shown in FIGS. 5 and 6 are transferred from the personal computer 2. While the contents recorded on the display memory circuit 15 are not changed, the operations are not prevented on the output side.

Figure 24:
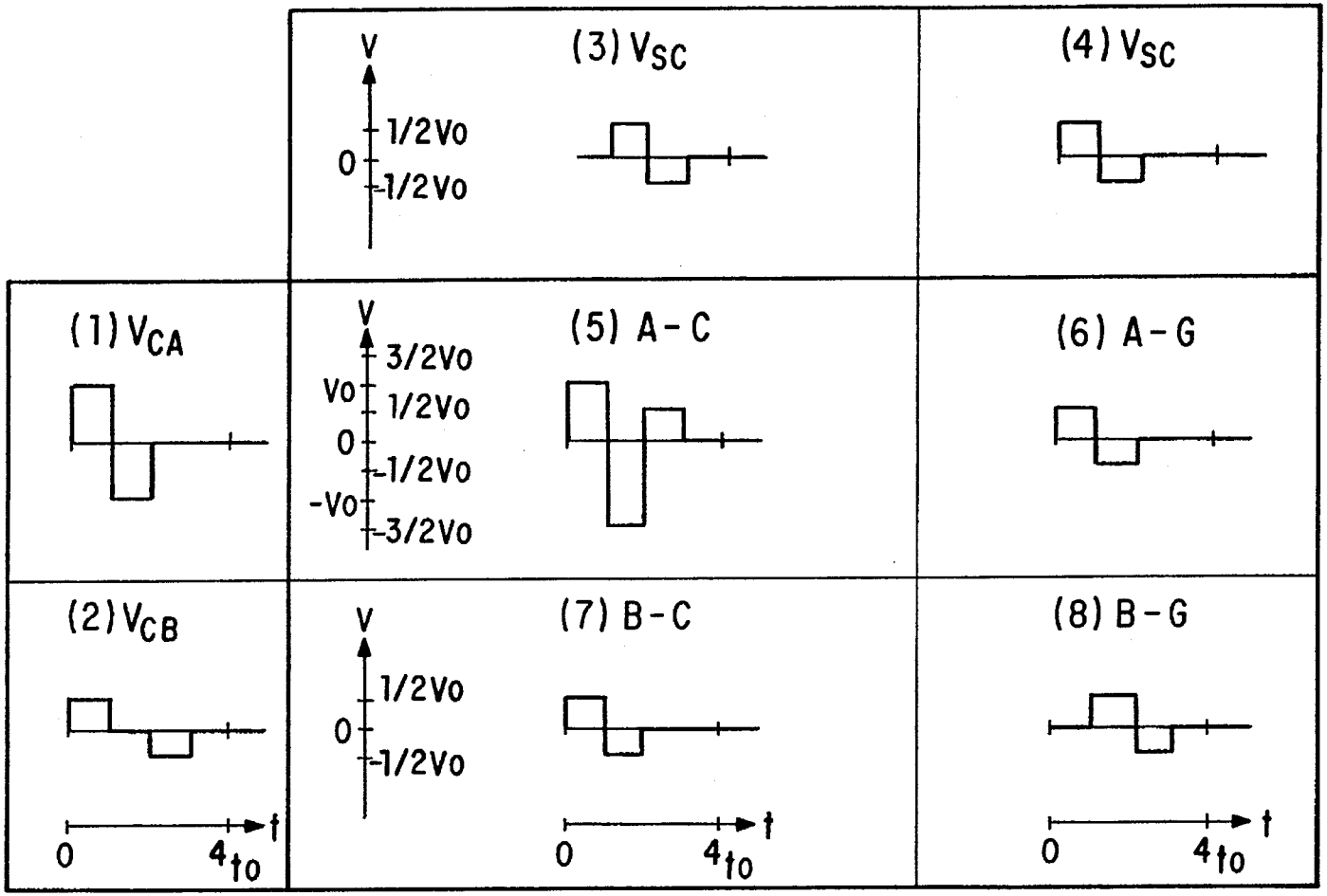
FIG. 24 is a diagram showing the waveforms of applied voltages used in the embodiment of the present invention.
Figure 25:
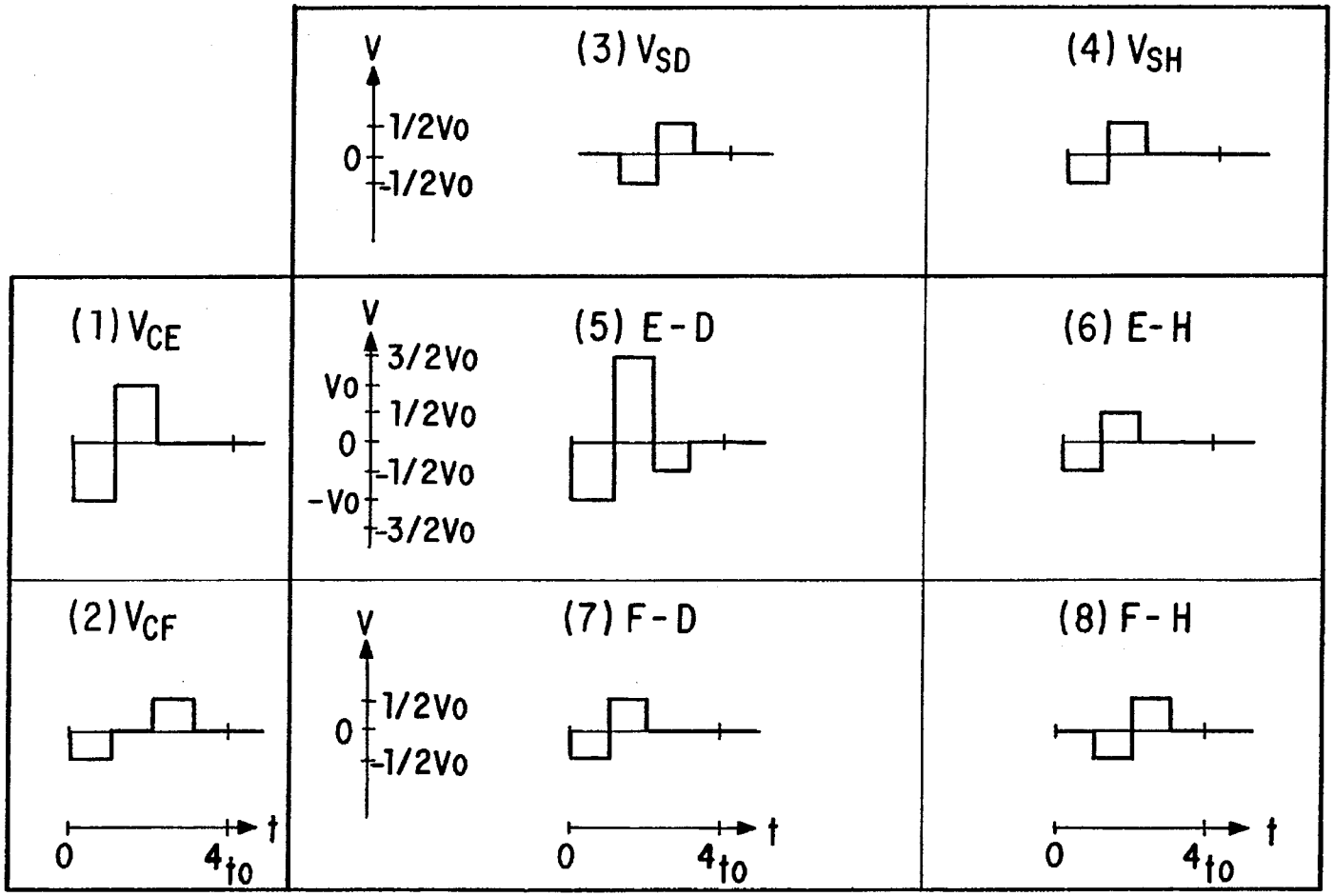
FIG. 25 is a diagram showing the waveforms of applied voltages used in the embodiment of the present invention.
Figure 26A:
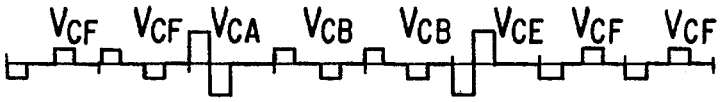
FIG. 26 is a diagram showing the waveforms of voltages applied to scanning electrodes, signal electrodes and pixels according to the embodiment of the present invention.
Figure 26B:
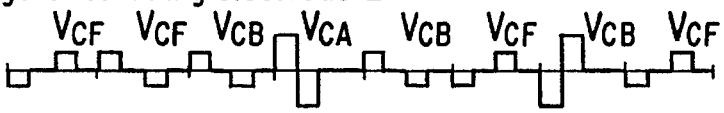
Figure 26C:
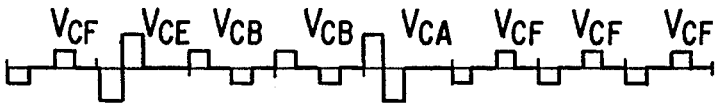
Figure 26D:
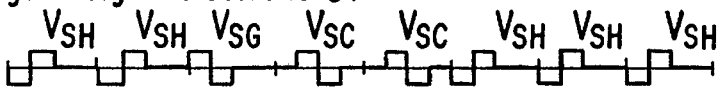
Figure 26E:
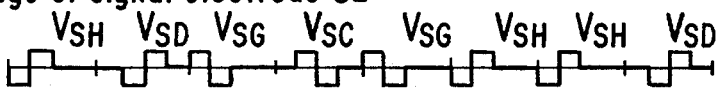
Figure 26F:
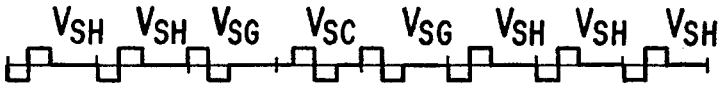
Figure 26G:
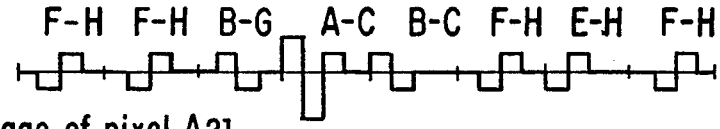
Figure 26H:
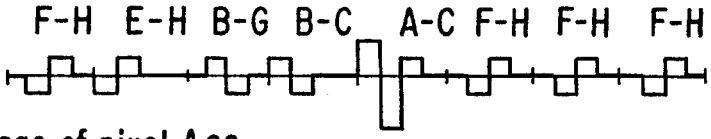
Figure 26I:
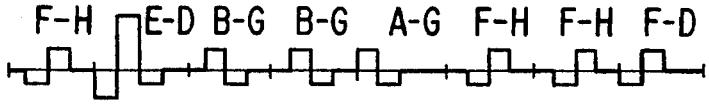
Figure 26J:
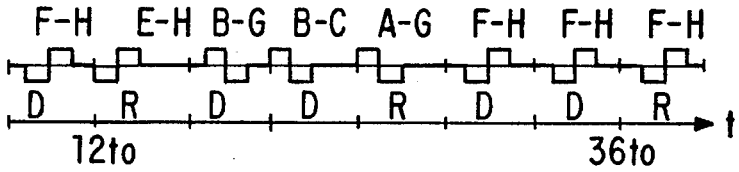

According to the present embodiment, the combination of voltage waveforms shown in FIGS. 24 and 25 is used for voltages to be outputted from the drive control circuit 21 to the scanning side drive circuit 11 and the signal side drive circuit 12.

FIG. 24 (1) shows the waveform of a selection voltage A which is applied to the scanning electrodes L so as to change the display state of pixels thereon into the state of "dark". FIG. 24 (2) shows the waveform of a non-selection voltage B which is applied to other scanning electrodes L so as not to change the display state of pixels thereon. FIG. 24 (3) shows the waveform of a rewriting dark voltage C which is applied to the signal electrodes S so as to change, into the state of "dark", the display state of pixels on the scanning electrodes L to which the selection voltage A is applied. FIG. 24 shows the waveform of a non-rewriting voltage G which is applied to the signal electrodes S so as not to change the display state of pixels on the scanning electrodes L to which the selection voltage A is applied.

FIGS. 24 (5) to (8) show the waveforms of effective voltages applied to a pixel Aij. FIG. 24 (5) shows a waveform A-C of a voltage which is applied to the pixel Aij when the selection voltage A is applied to the scanning electrode Li and the rewriting dark voltage C is applied to the signal electrode Sj. FIG. 24 (6) shows a waveform A-G of a voltage which is applied to the pixel Aij when the selection voltage A is applied to the scanning electrode Li and the non-rewriting voltage G is applied to the signal electrode Sj. FIG. 24 (7) shows a waveform B-C of a voltage which is applied to the pixel Aij when the non-selection voltage B is applied to the scanning electrode Li and the rewriting dark voltage C is applied to the signal electrode Sj. FIG. 24 (8) shows a waveform B-G of a voltage which is applied to the pixel Aij when the non-selection voltage B is applied to the scanning electrode Li and the non-rewriting voltage G is applied to the signal electrode Sj.

FIG. 25 (1) shows the waveform of a selection voltage E which is applied to the scanning electrodes L so as to change the display state of pixels thereon into the state of "bright". FIG. 25 (2) shows the waveform of a non-selection voltage F which is applied to other scanning electrodes L so as not to change the display state of pixels thereon. FIG. 25 (3) shows the waveform of a rewriting bright voltage D which is applied to the signal electrodes S so as to change, into the state of "bright", the display state of pixels on the scanning electrodes L to which the selection voltage E is applied. FIG. 25 (4) shows the waveform of a non-rewriting voltage H which is applied to the signal electrodes S so as not to change the display state of pixels on the scanning electrodes L to which the selection voltage E is applied.

FIGS. 25 (5) to (8) show the waveforms of effective voltages applied to the pixel Aij. FIG. 25 (5) shows a waveform E-D of a voltage which is applied to the pixel Aij when the selection voltage E is applied to the scanning electrode Li and the rewriting bright voltage D is applied to the signal electrode Sj. FIG. 25 (6) shows a waveform E-H of a voltage which is applied to the pixel Aij when the selection voltage E is applied to the scanning electrode Li and the non-rewriting voltage H is applied to the signal electrode Sj. FIG. 25 (7) shows a waveform F-D of a voltage which is applied to the pixel Aij when the non-selection voltage F is applied to the scanning electrode Li and the rewriting bright voltage D is applied to the signal electrode Sj. FIG. 25 (8) shows a waveform F-H of a voltage which is applied to the pixel Aij when the non-selection voltage F is applied to the scanning electrode Li and the non-rewriting voltage H is applied to the signal electrode According to the present embodiment, the drive control circuit 21 outputs the following combination of data DATA and voltages to the scanning side drive circuit 11 and the signal side drive circuit 12 by virtue of the drive mode H/R-, the voltage mode E-/W, the display data DA, the identity and difference data DF, the N:1 jump scan driving state data RGDF, the state data DGDF for the driving method of FIG. 10, and the like shown in FIG. 15.

(A1) When the drive mode H/R- is LOW and the voltage mode E-/W is HIGH, the data DATA is used for N:1 jump scan driving and the combination of voltages shown in FIG. 25. More specifically, if the display data DA is in the state of "bright" and the identity and difference data DF is in the state of "unchanged", or the display data DA is in the state of "bright" and the state data RGDF is in the state of "unchanged", data DATA corresponding to VSD shown in FIG. 24 (3) is outputted to the signal side drive circuit 12. In other cases, data DATA corresponding to VSH shown in FIG. 25 (4) is outputted to the signal side drive circuit 12.

(B1) When the drive mode H/R- is HIGH and the voltage mode E-/W is LOW, the data DATA is used for the driving of FIG. 10 and the combination of voltages shown in FIG. 24. More specifically, if the display data DA is in the state of "dark", the identity and difference data DF is in the state of "changed" and the state data DGDF is in the state of "changed", data DATA corresponding to VSC shown in FIG. 24 (3) is outputted to the signal side drive circuit 12. In other cases, data DATA corresponding to VSG shown in FIG. 24 (4) is outputted to the signal side drive circuit 12.

(B3) When the drive mode H/R- is LOW and the voltage mode E-/W is LOW, the data DATA is used for the N:1 jump scan driving and the combination of voltages shown in FIG. 24. More specifically, if the display data DA is in the state of "dark" and the identity and difference data DF is in the state of "unchanged", or the display data DA is in the state of "dark" and the state data RGDF is in the state of "unchanged", data DATA corresponding to VSC shown in FIG. 24 (3) is outputted to the signal side drive circuit 12. In other cases, data DATA corresponding to VSG shown in FIG. 24 (4) is outputted to the signal side drive circuit 12.

(B4) When the drive mode H/R- is HIGH and the voltage mode E-/W is HIGH, the data DATA is used for the driving of FIG. 10 and the combination of voltages shown in FIG. 25. More specifically, if the display data DA is in the state of "bright", the identity and difference data DF is in the state of "changed" and the state data DGDF is in the state of "changed", data DATA corresponding to VSD shown in FIG. 25 (3) is outputted to the signal side drive circuit 12. In other cases, data DATA corresponding to VSH shown in FIG. 25 (4) is outputted to the signal side drive circuit 12.

The data DATA thus outputted is transferred to a shift register (not shown) of the signal side drive circuit 12 by a clock XCLK and then to another register (not shown) of the signal side drive circuit 12 at the timing of a latch pulse LP outputted from the drive control circuit 21, and is held therein.

When the data DATA thus held is in the pattern A1 or B4, the combination of voltages shown in FIG. 25 is outputted from the drive control circuit 21 to the VC0 and VC1 terminals of the scanning side drive circuit 11 and the VS0 and VS1 terminals of the signal side drive circuit 12. When the data DATA thus held is in the pattern B1 or B3, the combination of voltages shown in FIG. 24 is outputted from the drive control circuit 21 to the VC0 and VC1 terminals of the scanning side drive circuit 11 and the VS0 and VS1 terminals of the signal side drive circuit 12. When the data DATA thus held corresponds to a scanning electrode Lx (for example, L0), an address Ax corresponding to the same scanning electrode Lx is transferred from the drive control circuit 21 to the scanning side drive circuit 11 by a clock YCLK and is held therein.

FIG. 26 shows voltages applied to scanning electrodes L0, L1 and L2, signal electrodes S1, S2 and S5, and pixels A11, A21, A22 and A25. In FIG. 26, (1) shows the waveform of a voltage applied to the scanning electrode L0, (2) shows the waveform of a voltage applied to the scanning electrode L1, (3) shows the waveform of a voltage applied to the scanning electrode L2, (4) shows the waveform of a voltage applied to the signal electrode S1, (5) shows the waveform of a voltage applied to the signal electrode S2, (6) shows the waveform of a voltage applied to the signal electrode S5, (7) shows the waveform of an effective voltage applied to the pixel A11, (8) shows the waveform of an effective voltage applied to the pixel A21, (9) shows the waveform of an effective voltage applied to the pixel A22, and (10) shows the waveform of an effective voltage applied to the pixel A25.

According to the present embodiment, a scanning electrode group is formed by 4 scanning electrodes. In general, a scanning electrode group can be formed by 2 to 32 scanning electrodes. While the scanning electrodes forming a scanning electrode group are driven by the driving method of FIG. 10, two scanning electrodes are driven by the N:1 jump scanning method. In general, 1 to 16 scanning electrode(s) can be driven by the N:1 jump scanning method while the scanning electrodes forming a scanning electrode group are driven by the driving method of FIG. 10.

In consideration of the display state of an FLC panel, it should be decided whether the next scanning electrode is driven by the driving method of FIG. 10 based on the combination of voltages shown in FIG. 24 or 25 after a specific scanning electrode is driven by the N:1 jump scan driving method based on the combination of voltages shown in FIG. 24. Accordingly, the order is not limited to that of the present embodiment.

Figure 34:
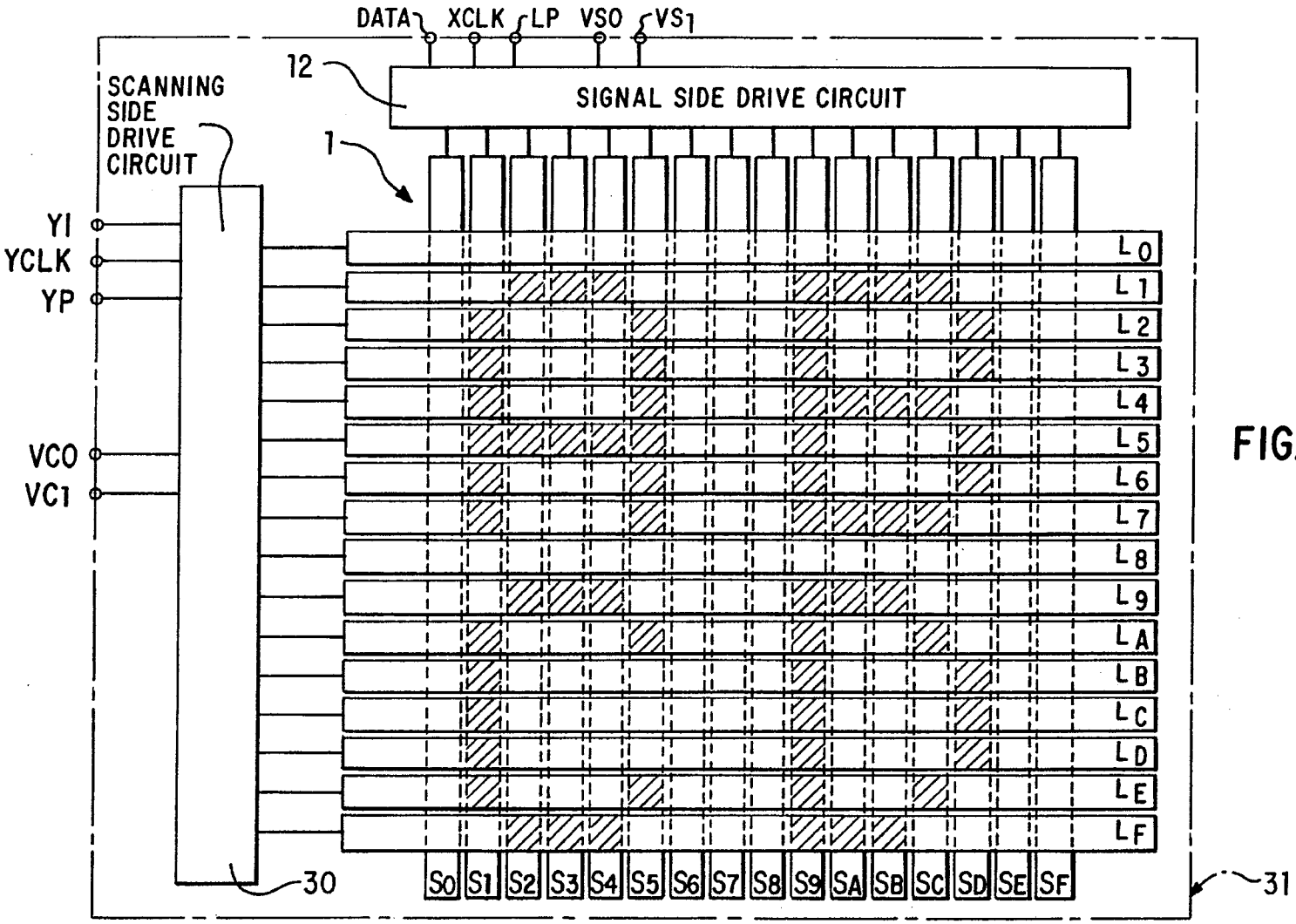
FIG. 34 is a plan view showing the structure of an FLCD having 1024×1024 pixels to be used in the display system according to the embodiment of the present invention.
Figure 35:
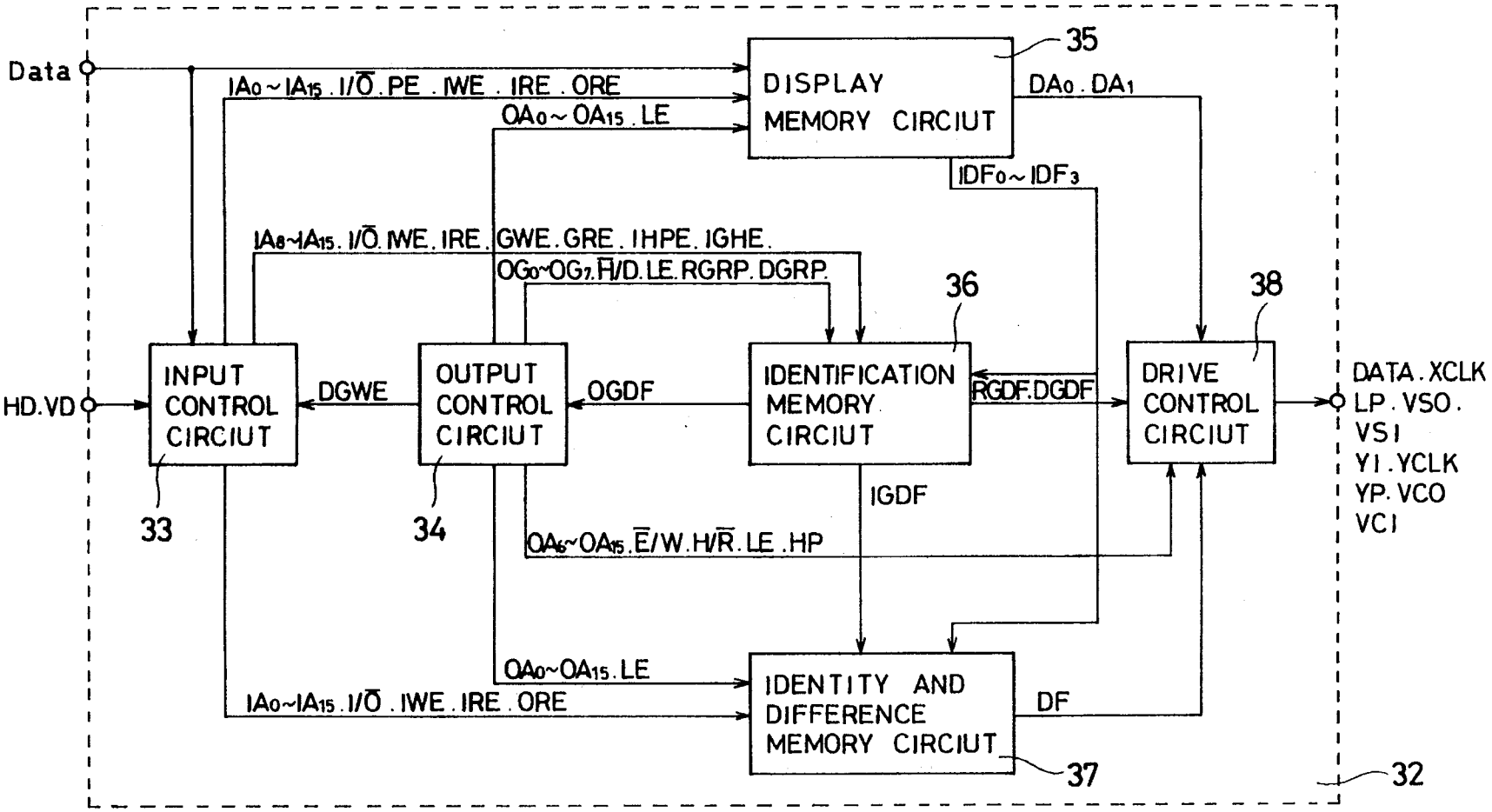
FIG. 35 is a block diagram showing the schematic structure of a display control circuit for the FLCD having 1024×1024 pixels according to the embodiment of the present invention.

A control circuit 32 shown in FIG. 35 has the following structure. An FLCD 31 shown in FIG. 34 is used. The FLCD 31 has such a structure that an FLC panel has 1024×1024 pixels, the same data YI as in the signal side drive circuit 12 is transferred to a shift register (not shown) which is operated by the clock YCLK and is then held in a latch (not shown) by a timing pulse YP in the scanning side drive circuit 30, and a voltage VC0 or VC1 is applied to each scanning electrode when the held data corresponding to the scanning electrode is "0" or "1" (In practice, it is impossible to show an FLC panel 1 having 1024×1024 pixels. For this reason, FIG. 34 shows an FLC panel 1 having 16×16 pixels). The identity and difference memory is formed at the rate of 1 bit every four pixels on a scanning electrode. A scanning electrode group is formed by 4 scanning electrodes. Every time 2 scanning electrodes forming a scanning electrode group are driven by the driving method of FIG. 10, a scanning electrode is driven by a 16:1 jump scanning method.

In the control circuit 32 shown in FIG. 35, there are omitted the interface circuit 14 of the control circuit 13 shown in FIGS. 12 and 13 and a clock generating and distributing circuit which is not shown in FIGS. 12 and 13. An address circuit 20 is provided in a display memory circuit 35, an identification memory circuit 36 or an identity and difference memory circuit 37. Basically, the structure of the control circuit 32 is the same as that of the control circuit 13. More specifically, the control circuit 32 comprises the display memory circuit 35, the identification memory circuit 36, the identity and difference memory circuit 37, an input control circuit 33 for controlling operations carried out on the input sides of the memory circuits 35, 36 and 37, an output control circuit 34 for controlling operations carried out on the output sides of the memory circuits 35, 36 and 37, and a drive control circuit 38 for controlling the operations of the scanning side drive circuit 30 and signal side drive circuit 12 of the FLCD 31.

Figure 36:
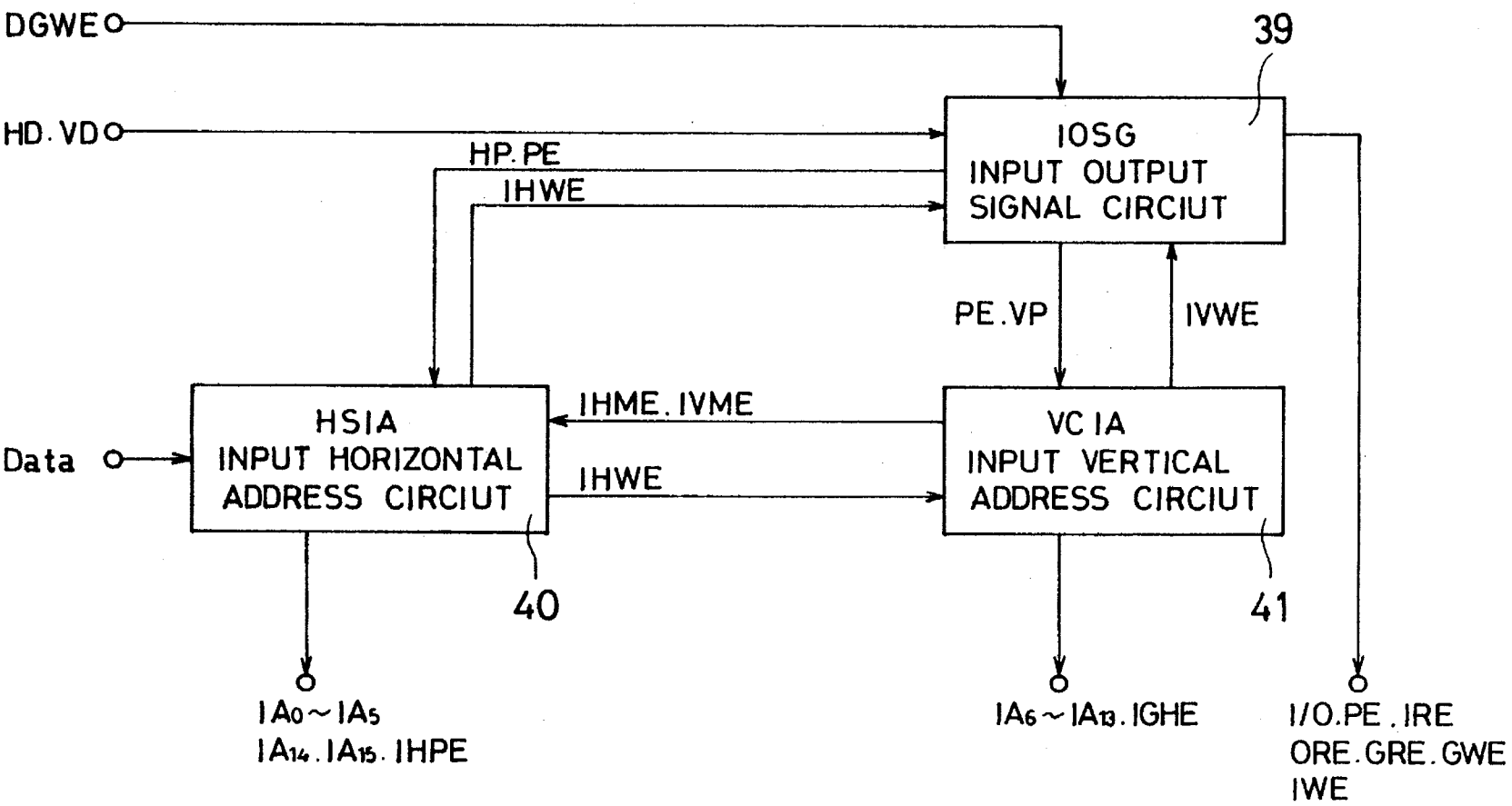
FIG. 36 is a block diagram showing the schematic structure of an input control circuit for the FLCD having 1024×1024 pixels according to the embodiment of the present invention.

As shown in FIG. 36, the input control circuit 33 includes an input-output signal circuit 39 which generates signals for controlling the read-out and write of the memory circuits 35, 36 and 37, an input horizontal address circuit 40 for generating input column addresses, and an input vertical address circuit 41 for generating input line addresses.

Figure 37:
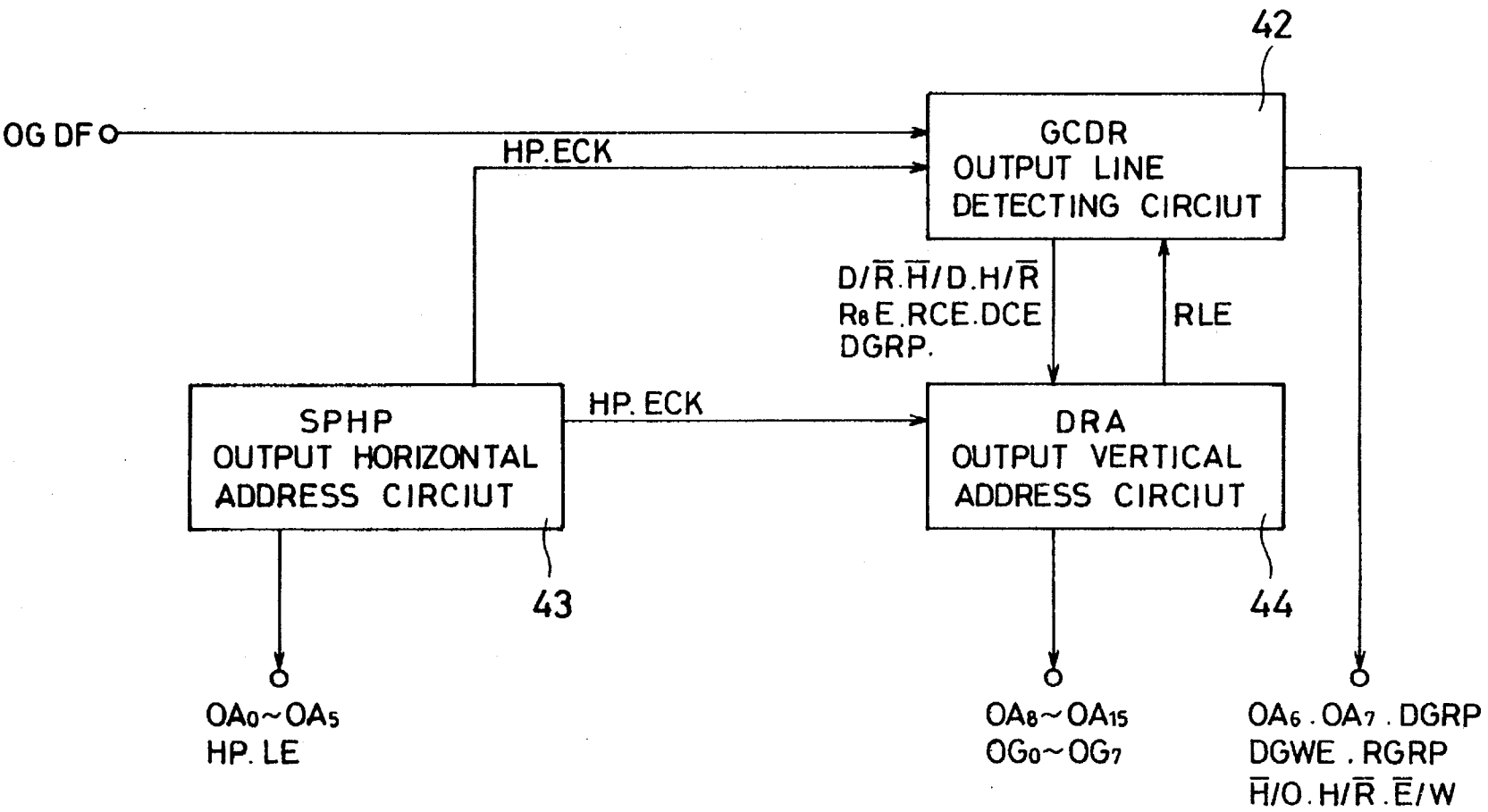
FIG. 37 is a block diagram showing the schematic structure of an output control circuit for the FLCD having 1024×1024 pixels according to the embodiment of the present invention.

As shown in FIG. 37, the output control circuit 34 includes an output line detecting circuit 42 which generates signals for controlling the read-out of the memory circuits 35, 36 and 37, an output horizontal address circuit 43 for generating output column addresses, and an output vertical address circuit 44 for generating output line addresses and output group addresses.

Figure 38:
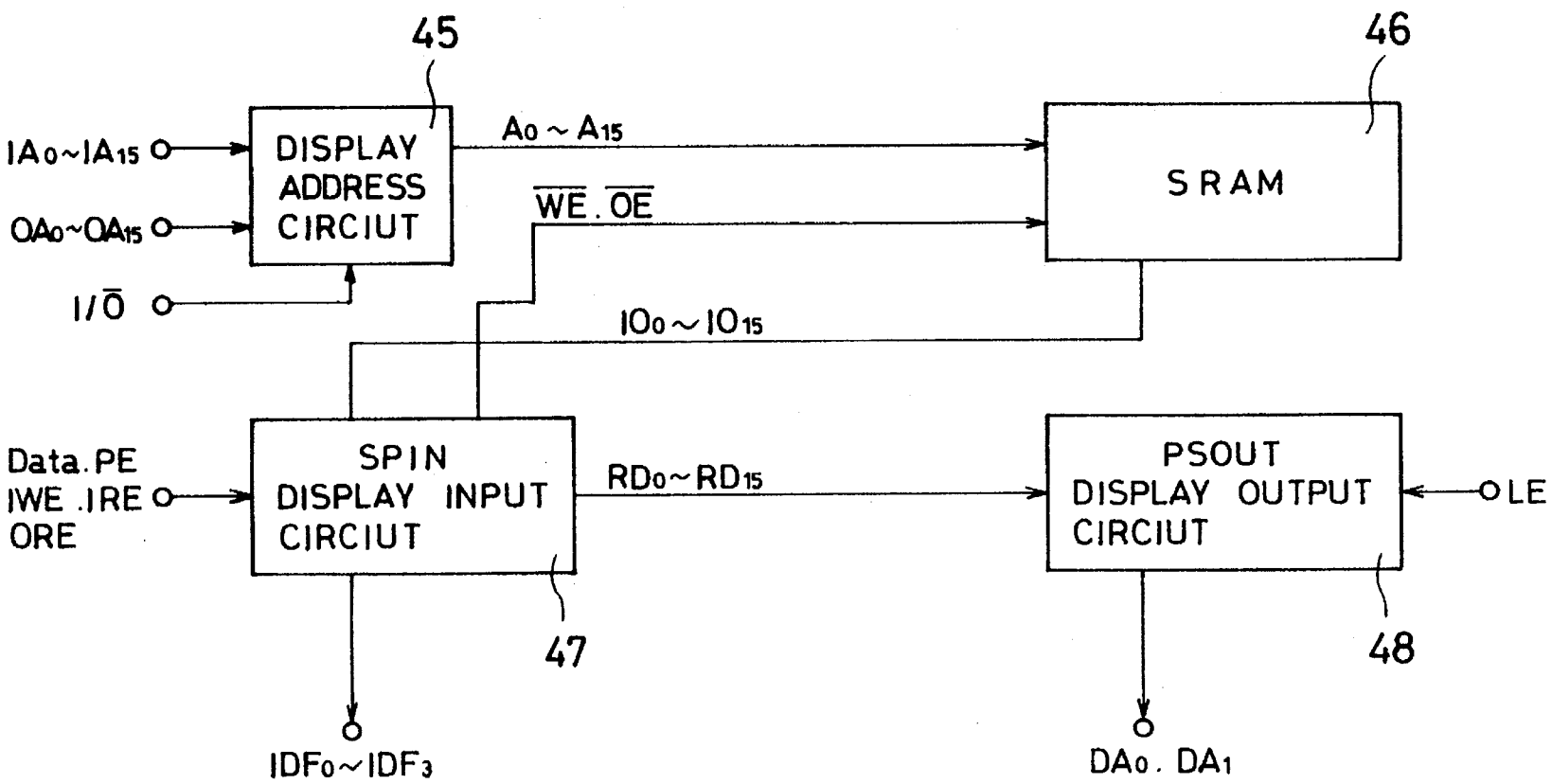
FIG. 38 is a block diagram showing the schematic structure of a display memory circuit for the FLCD having 1024×1024 pixels according to the embodiment of the present invention.

As shown in FIG. 38, the display memory circuit 35 includes a display address circuit 45 for switching input side addresses and output side addresses, a SRAM 46, a display input circuit 47 for reading out and writing data from and into the SRAM 46 in accordance with the input control circuit 33, and a display output circuit 48 for outputting data transferred from the display input circuit 47 as display data DA in accordance with the output control circuit 34.

Figure 39:
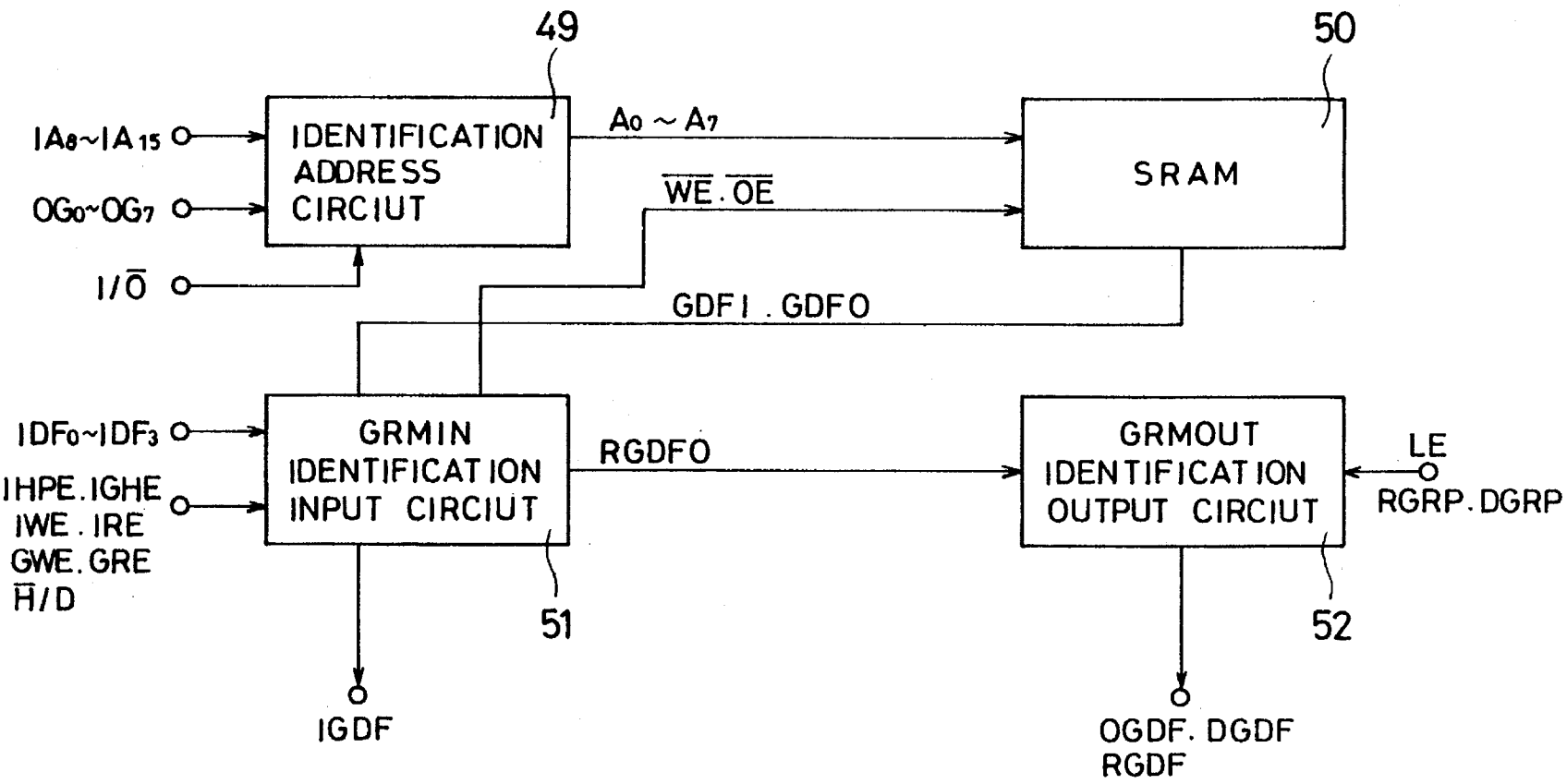
FIG. 39 is a block diagram showing the schematic structure of an identification memory circuit for the FLCD having 1024×1024 pixels according to the embodiment of the present invention.

As shown in FIG. 39, the identification memory circuit 36 includes an identification address circuit 49 for switching input side addresses and output side addresses, a SRAM 50, an identification input circuit 51 for reading out and writing identification data GDFI and GDFO from and into the SRAM 50 and outputting identification data IGDF in accordance with the input control circuit 33, and an identification output circuit 52 for outputting data transferred from the identification input circuit 51 as identification data OGDF and state data DGDF and RGDF in accordance with the output control circuit 34.

Figure 40:
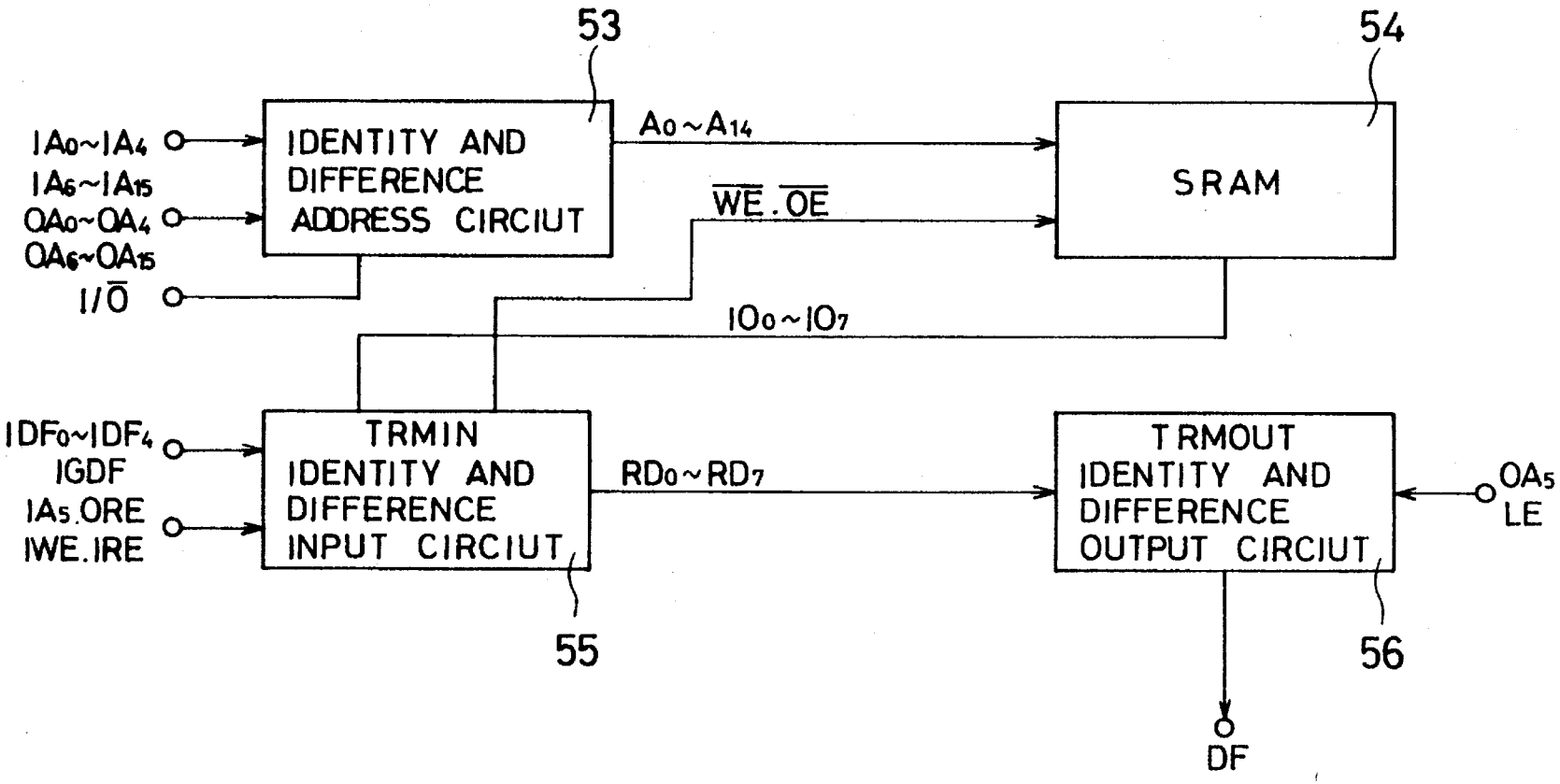
FIG. 40 is a block diagram showing the schematic structure of an identity and difference memory circuit for the FLCD having 1024×1024 pixels according to the embodiment of the present invention.

As shown in FIG. 40, the identity and difference memory circuit 37 includes an identity and difference address circuit 53 for switching input side addresses and output side addresses, a SRAM 54, an identity and difference input circuit 55 for reading out and writing data from and into the SRAM 54 in accordance with the input control circuit 33, and an identity and difference output circuit 56 for outputting data transferred from the identity and difference input circuit 55 as identity and difference data DF in accordance with the output control circuit 34.

Figure 41:
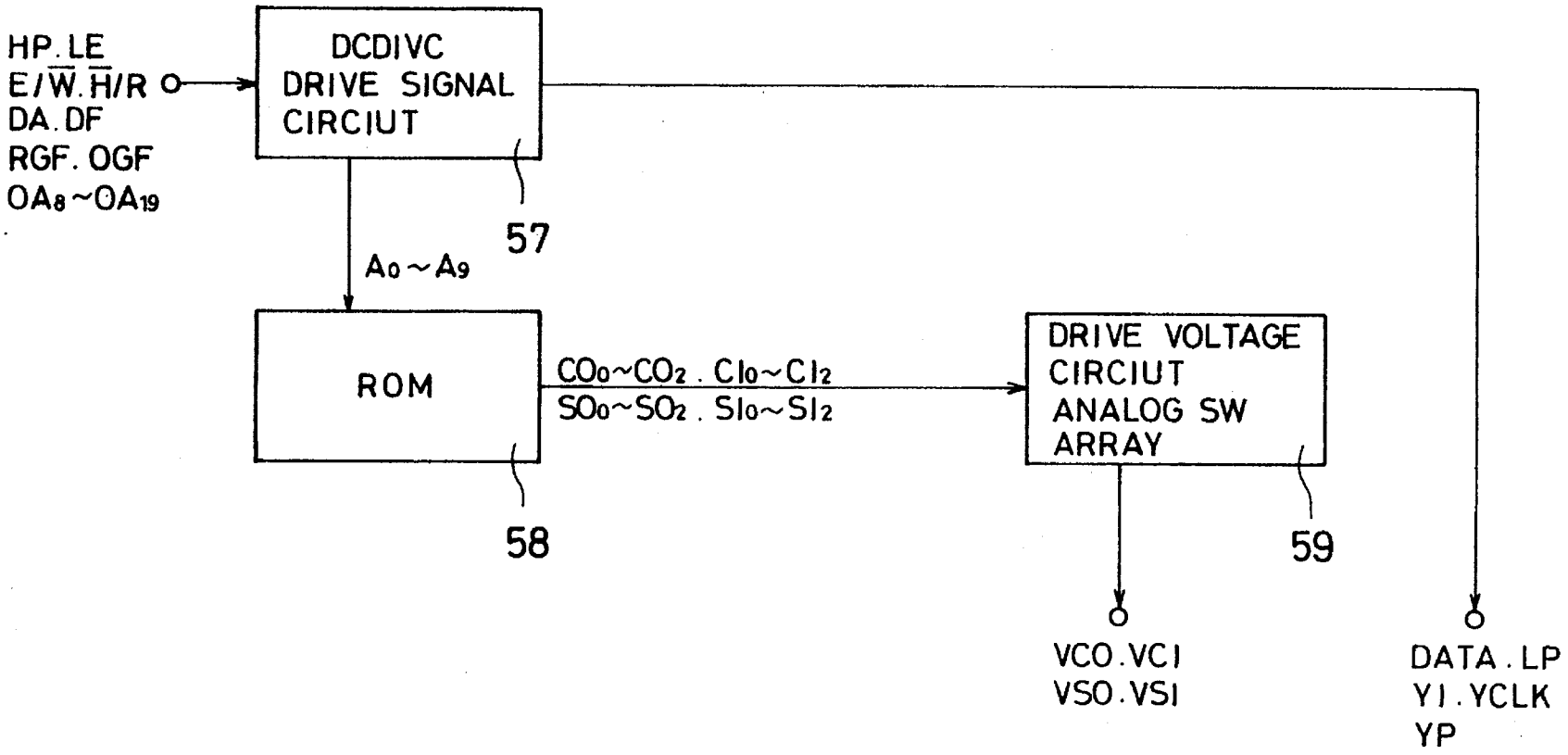
FIG. 41 is a block diagram showing the schematic structure of a drive control circuit for the FLCD having 1024×1024 pixels according to the embodiment of the present invention.

As shown in FIG. 41, the drive control circuit 38 includes a drive signal circuit 57 for outputting data DATA and YI, timing pulses LP and YP, and a clock YCLK, a ROM 58 for recording the combination of voltages, and a drive voltage circuit 59 for generating voltages VC0, VC1, VS0 and VS1.

Figure 42:
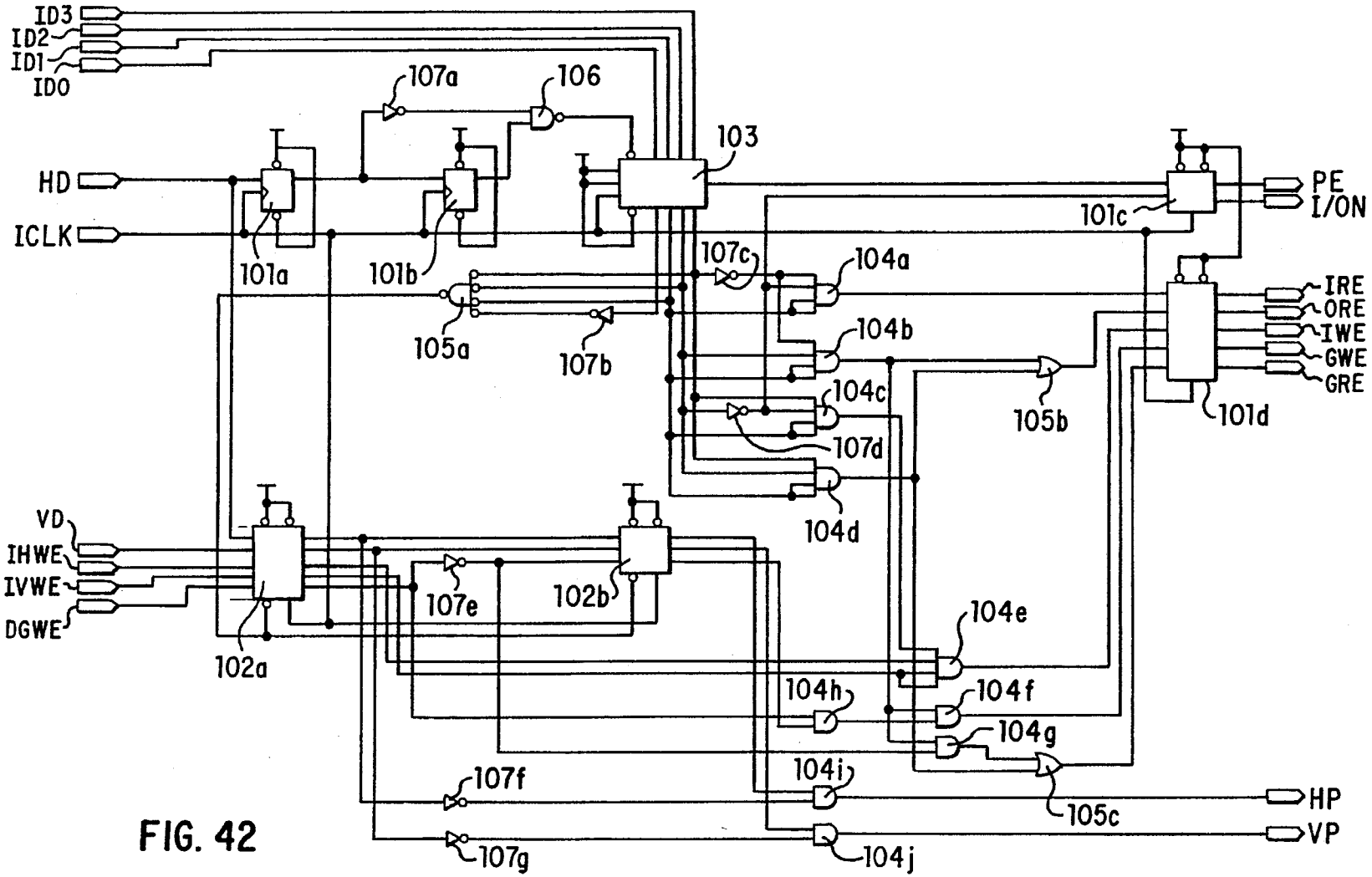
FIG. 42 is a circuit diagram showing the specific structure of an input-output signal circuit for the FLCD having 1024×1024 pixels according to the embodiment of the present invention.

FIG. 42 shows the specific structure of the input-output signal circuit 39. More specifically, the input-output signal circuit 39 has D-type flip-flops (hereinafter referred to as DFFs) 101*a* to 101*d*, DFFs having a count enable function (hereinafter referred to as ENA-DFFs) 102*a* and 102*b*, a counter 103, AND gates 104*a* to 104*j*, OR gates 105*a* to 105*c*, a NAND gate 106, and NOT gates 107*a* to 107*g*.

Figure 43:
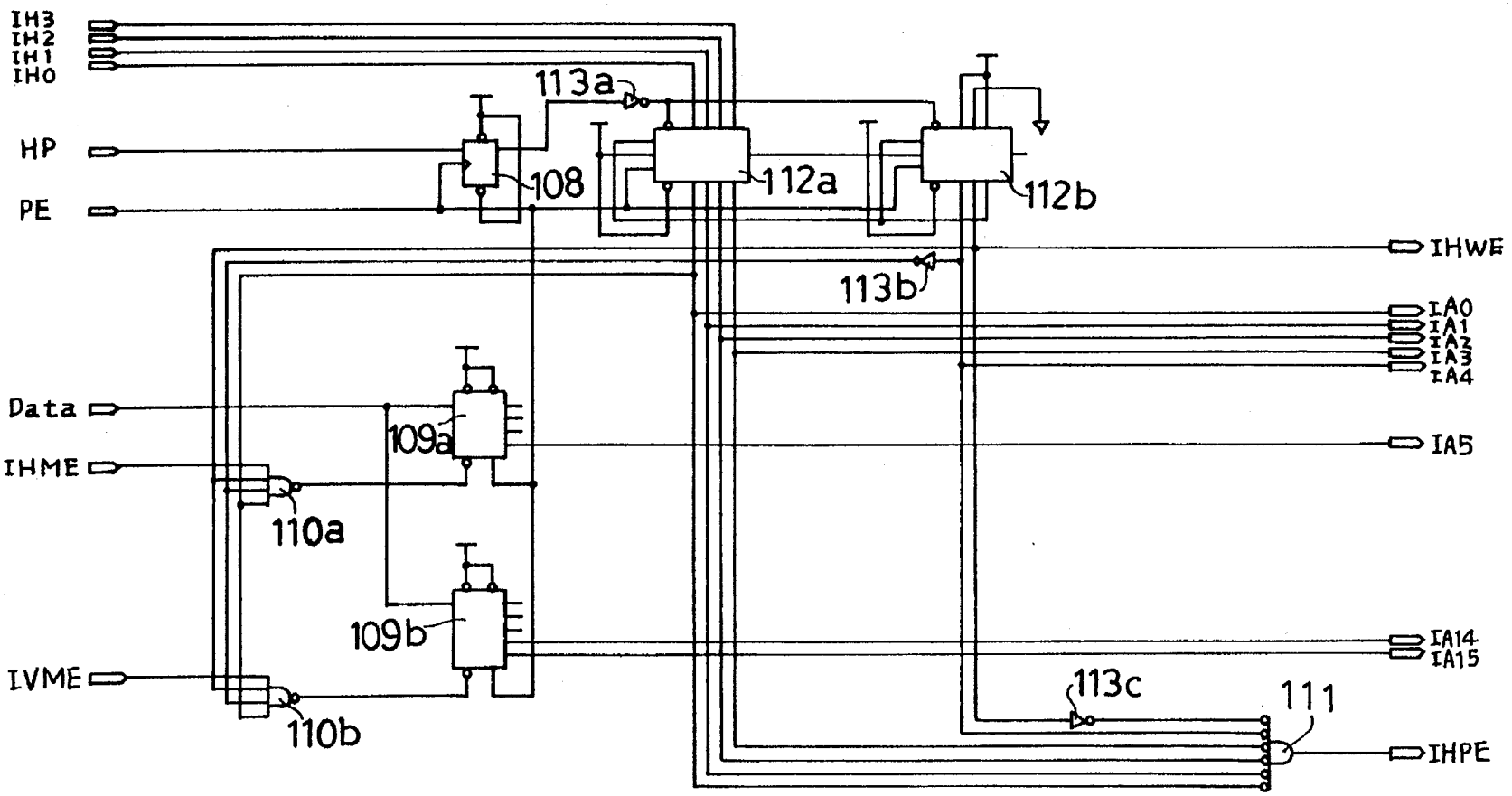
FIG. 43 is a circuit diagram showing the specific structure of an input horizontal address circuit for the FLCD having 1024×1024 pixels according to the embodiment of the present invention.

FIG. 43 shows the specific structure of the input horizontal address circuit 40. More specifically, the input horizontal address circuit 40 has a DFF 108, shift registers having a count enable function 109*a* and 109*b*, NAND gates 110*a* and 110*b*, a NOR gate 111, counters 112*a* and 112*b*, and NOT gates 113*a* to 113*c*.

Figure 44:
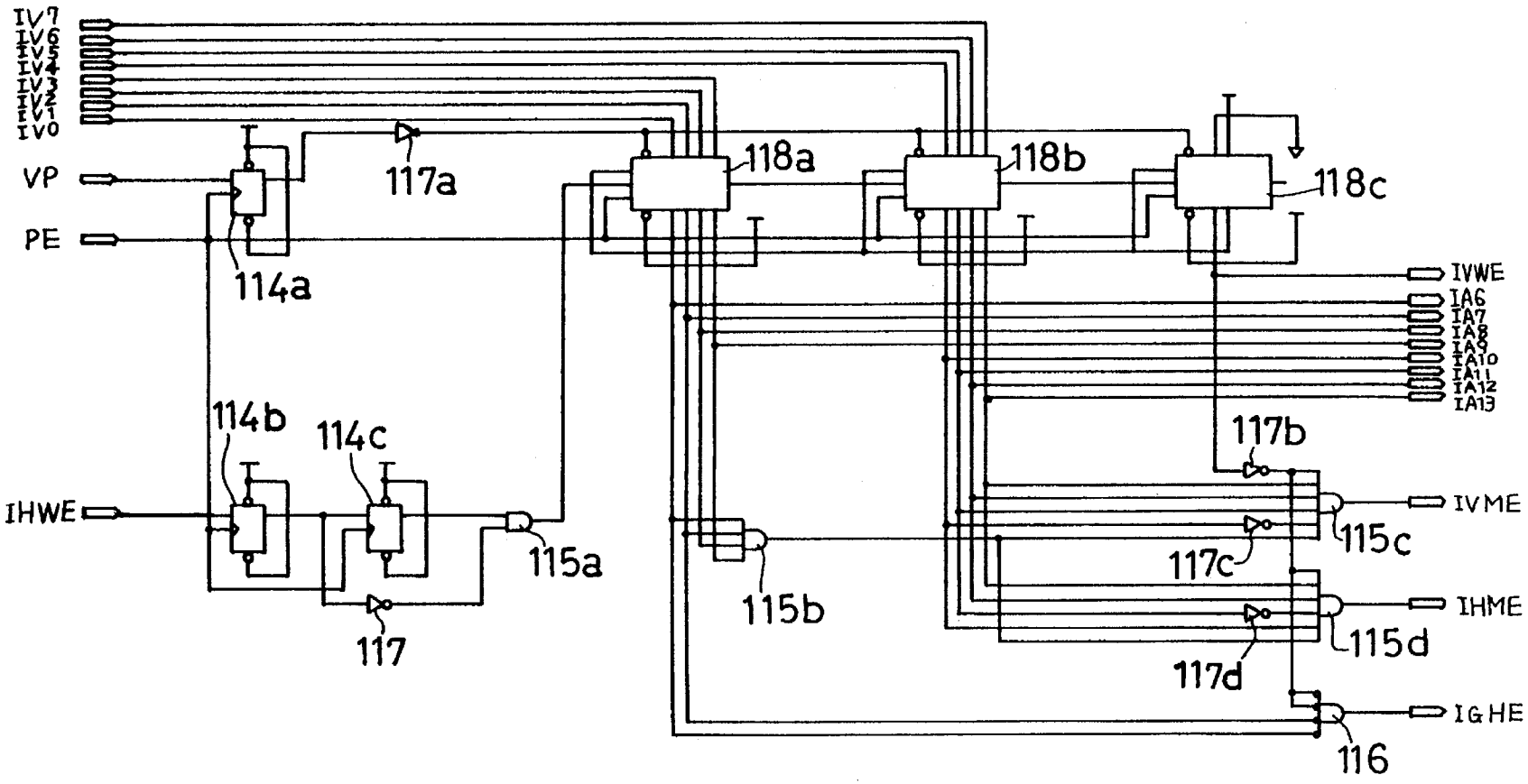
FIG. 44 is a circuit diagram showing the specific structure of an input vertical address circuit for the FLCD having 1024×1024 pixels according to the embodiment of the present invention.

FIG. 44 shows the specific structure of the input vertical address circuit 41. More specifically, the input vertical address circuit 41 has DFFs 114*a* to 114*c*, AND gates 115*a* to 115*d*, a NOR gate 116, NOT gates 117*a* to 117*d*, and counters 118*a* to 118*c*.

Figure 45:
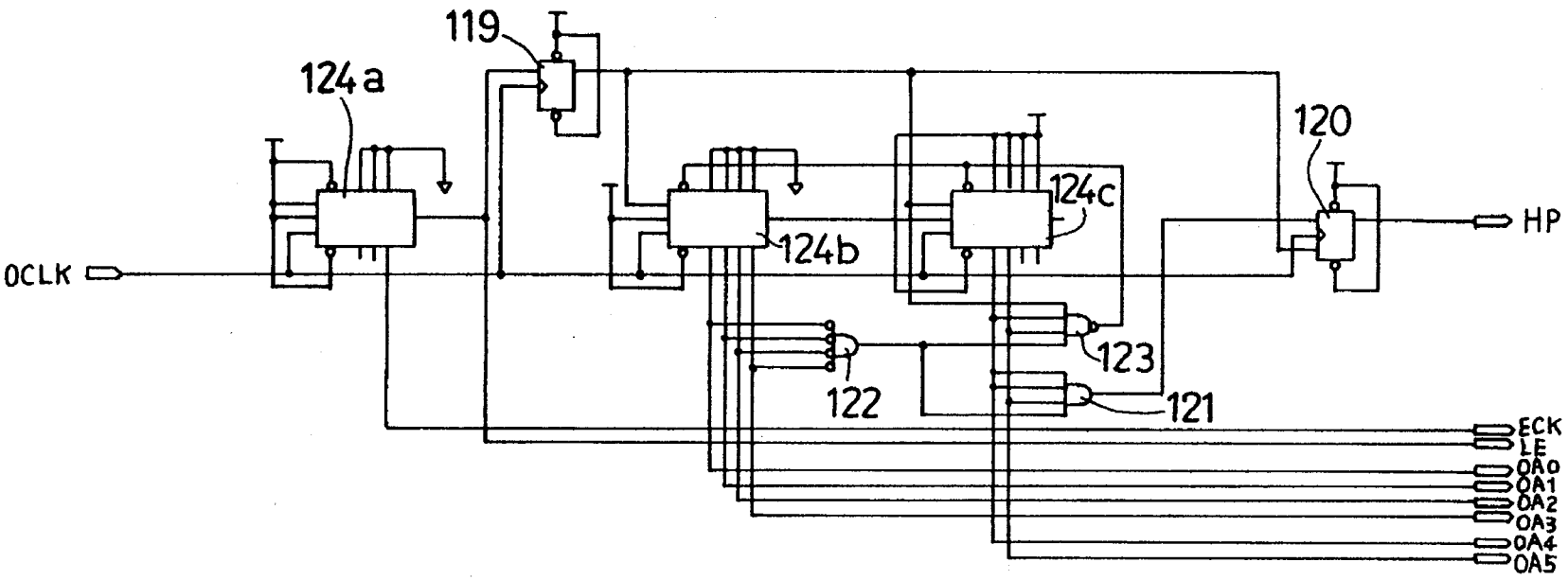
FIG. 45 is a circuit diagram showing the specific structure of an output horizontal address circuit for the FLCD having 1024×1024 pixels according to the embodiment of the present invention.

FIG. 45 shows the specific structure of the output horizontal address circuit 43. More specifically, the output horizontal address circuit 43 has a DFF 119, an ENA-DFF 120, an AND gate 121, a NOR gate 122, a NAND gate 123, and counters 124*a* to 124*c*.

Figure 46:
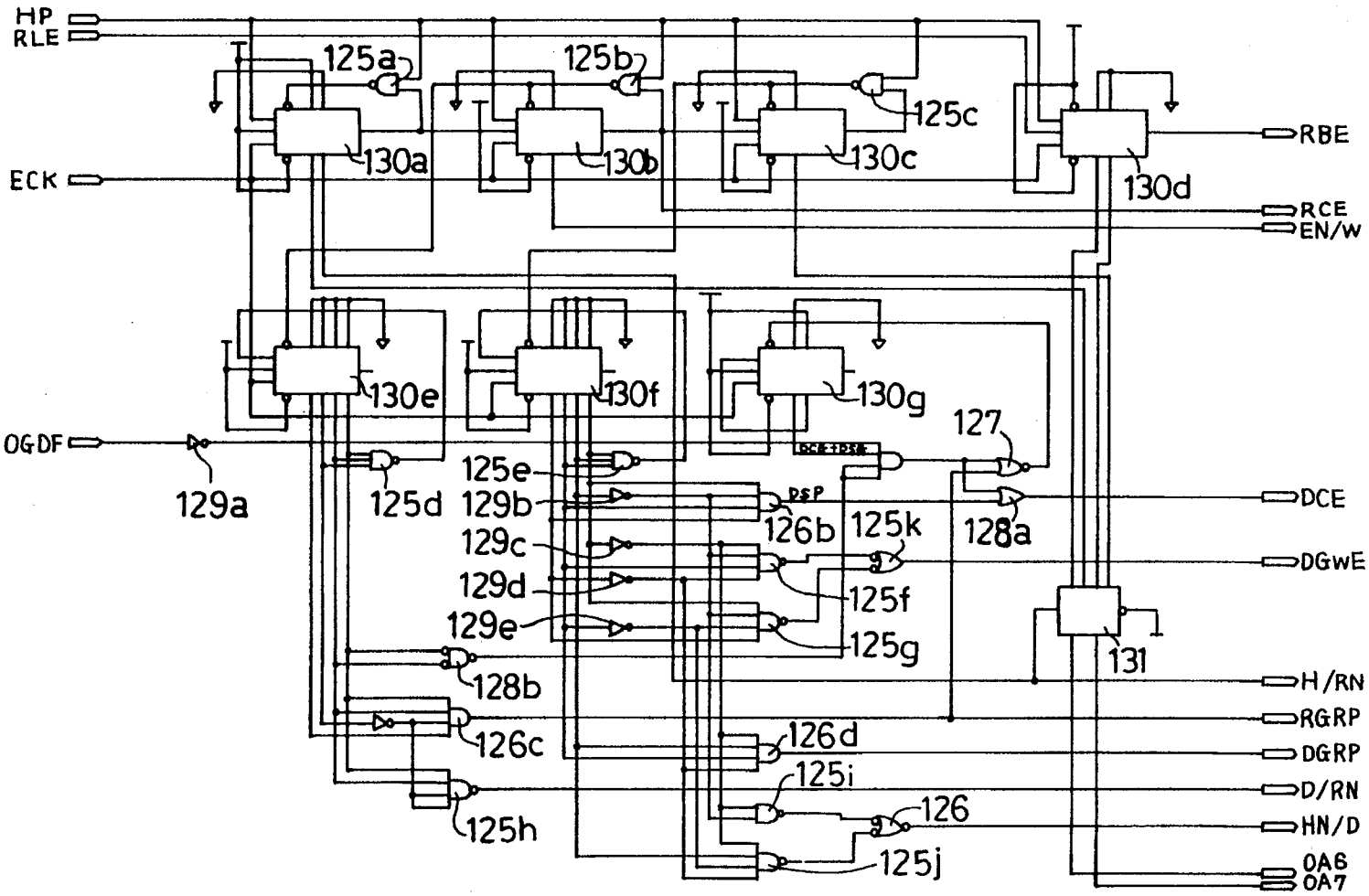
FIG. 46 is a circuit diagram showing the specific structure of an output line detecting circuit for the FLCD having 1024×1024 pixels according to the embodiment of the present invention.

FIG. 46 shows the specific structure of the output line detecting circuit 42. More specifically, the output line detecting circuit 42 has NAND gates 125*a* to 125*k*, AND gates 126*a* to 126*d*, a NOR gate 127, OR gates 128*a* and 128*b*, NOT gates 129*a* to 129*e*, counters 130*a* to 130*g*, and a 2-terminal selector 131.

Figure 47:
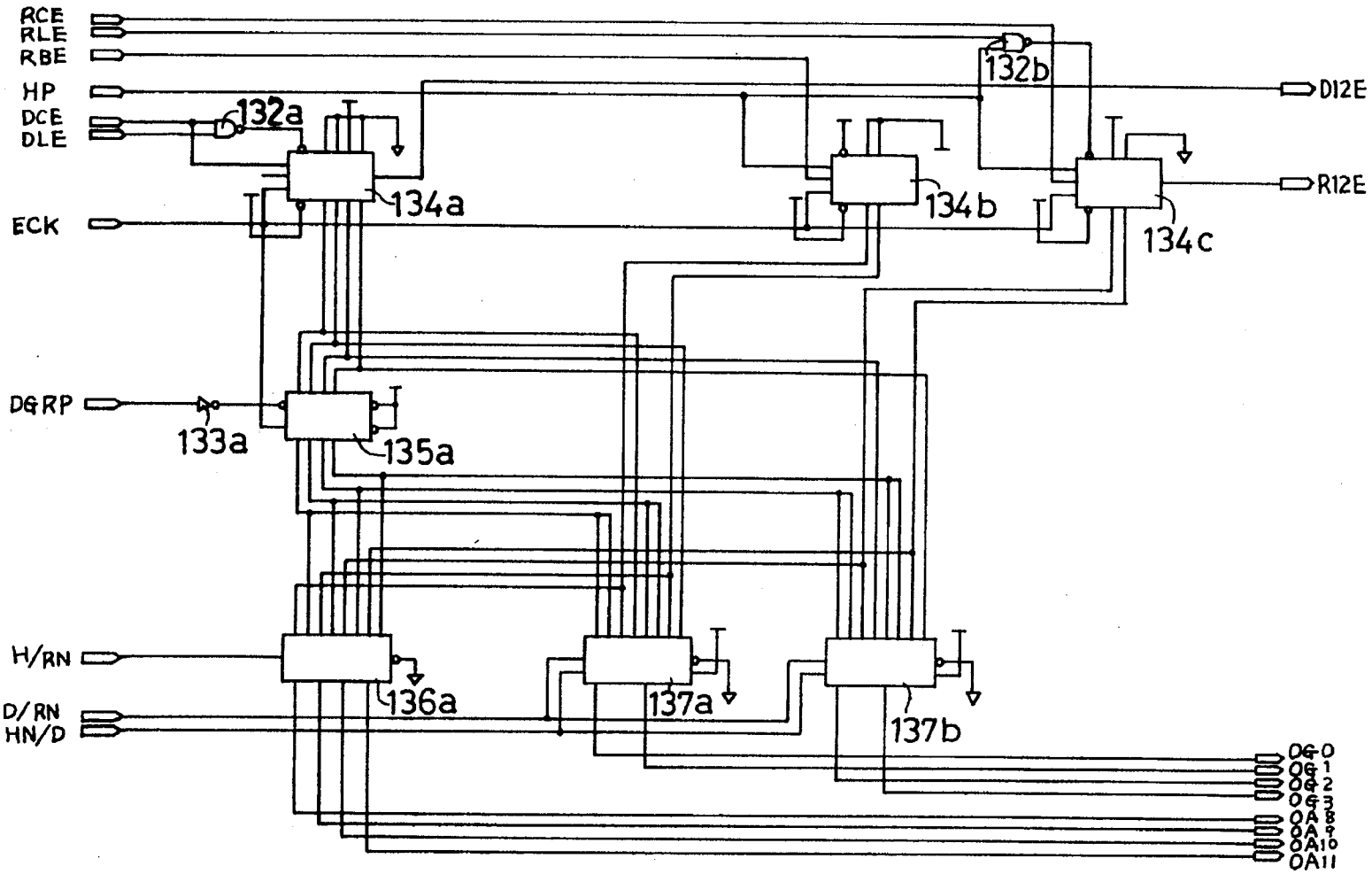
FIG. 47 is a circuit diagram showing the specific structure of an output vertical address circuit for the FLCD having 1024×1024 pixels according to the embodiment of the present invention.
Figure 48:
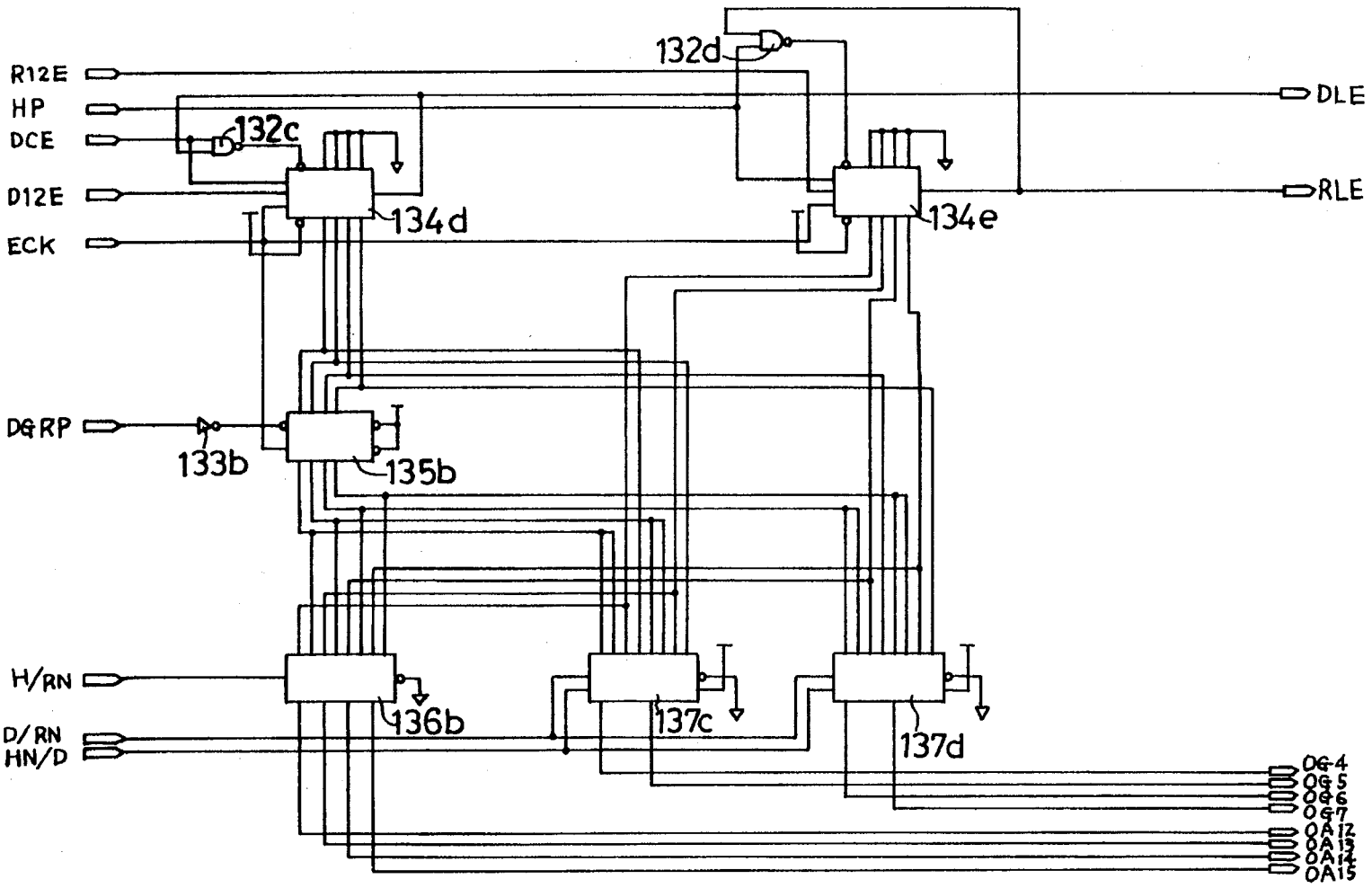
FIG. 48 is a circuit diagram showing the specific structure of the output vertical address circuit for the FLCD having 1024×1024 pixels according to the embodiment of the present invention.

The output vertical address circuit 44 is formed by circuits which are specifically shown in FIGS. 47 and 48. More specifically, the output vertical address circuit 44 has NAND gates 132*a* to 132*d*, NOT gates 133*a* and 133*b*, counters 134*a* to 134*e*, ENA-DFFs 135*a* and 135*b*, 2-terminal selectors 136*a* and 136*b*, and 4-terminal selectors 137*a* to 137*d*.

Figure 49:
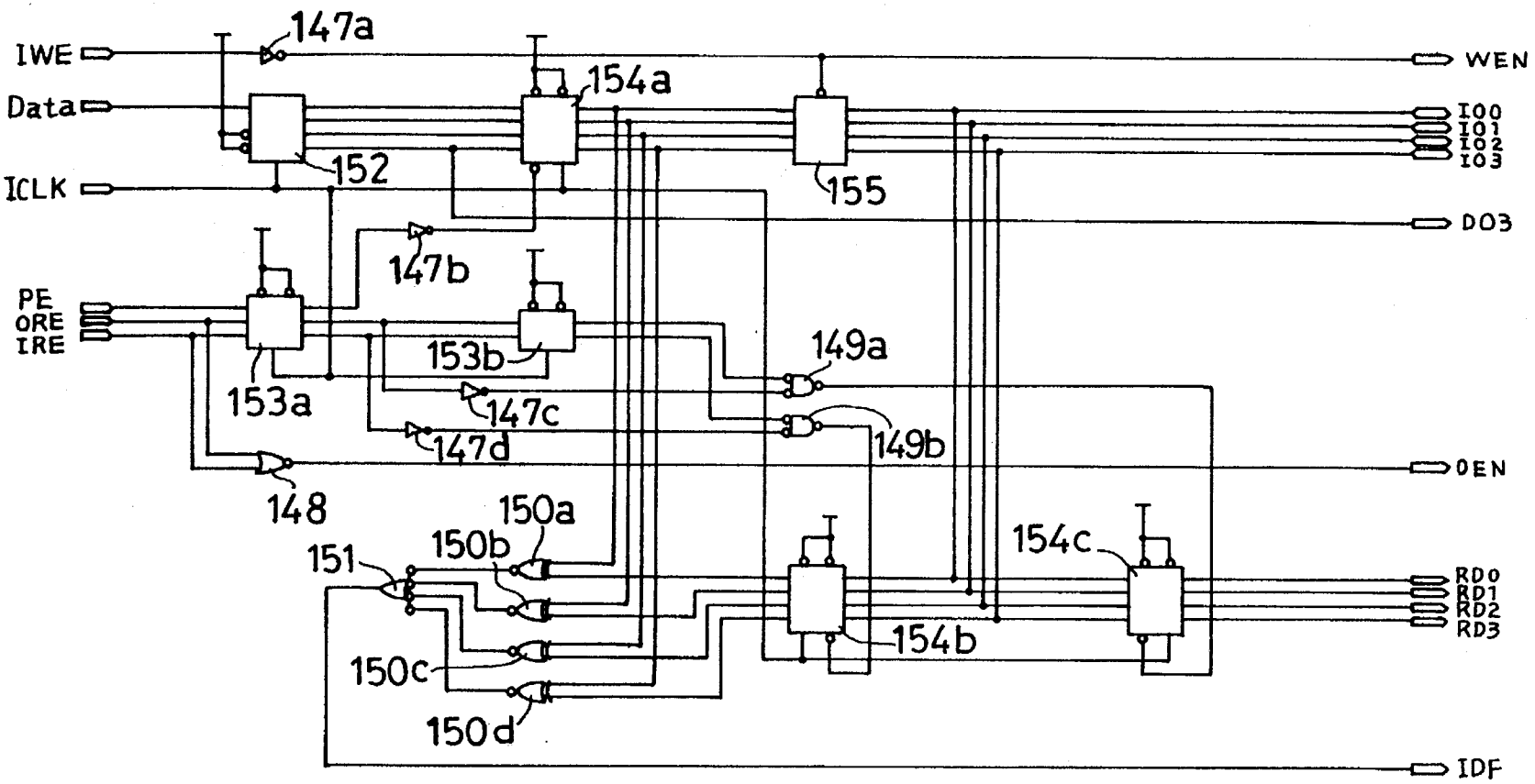
FIG. 49 is a circuit diagram showing the specific structure of a display input circuit for the FLCD having 1024×1024 pixels according to the embodiment of the present invention.

The display input circuit 47 is formed by 4 circuits, one of which is specifically shown in FIG. 49. More specifically, one of the circuits which are provided in parallel has NOT gates 147*a* to 147*d*, a NOR gate 148, 0R gates 149*a* and 149*b*, exclusive-OR gates 150*a* to 150*d*, a NAND gate 151, a shift register 152, DFFs 153*a* and 153*b*, and ENA-DFFs 154*a* to 154*c*.

Figure 50:
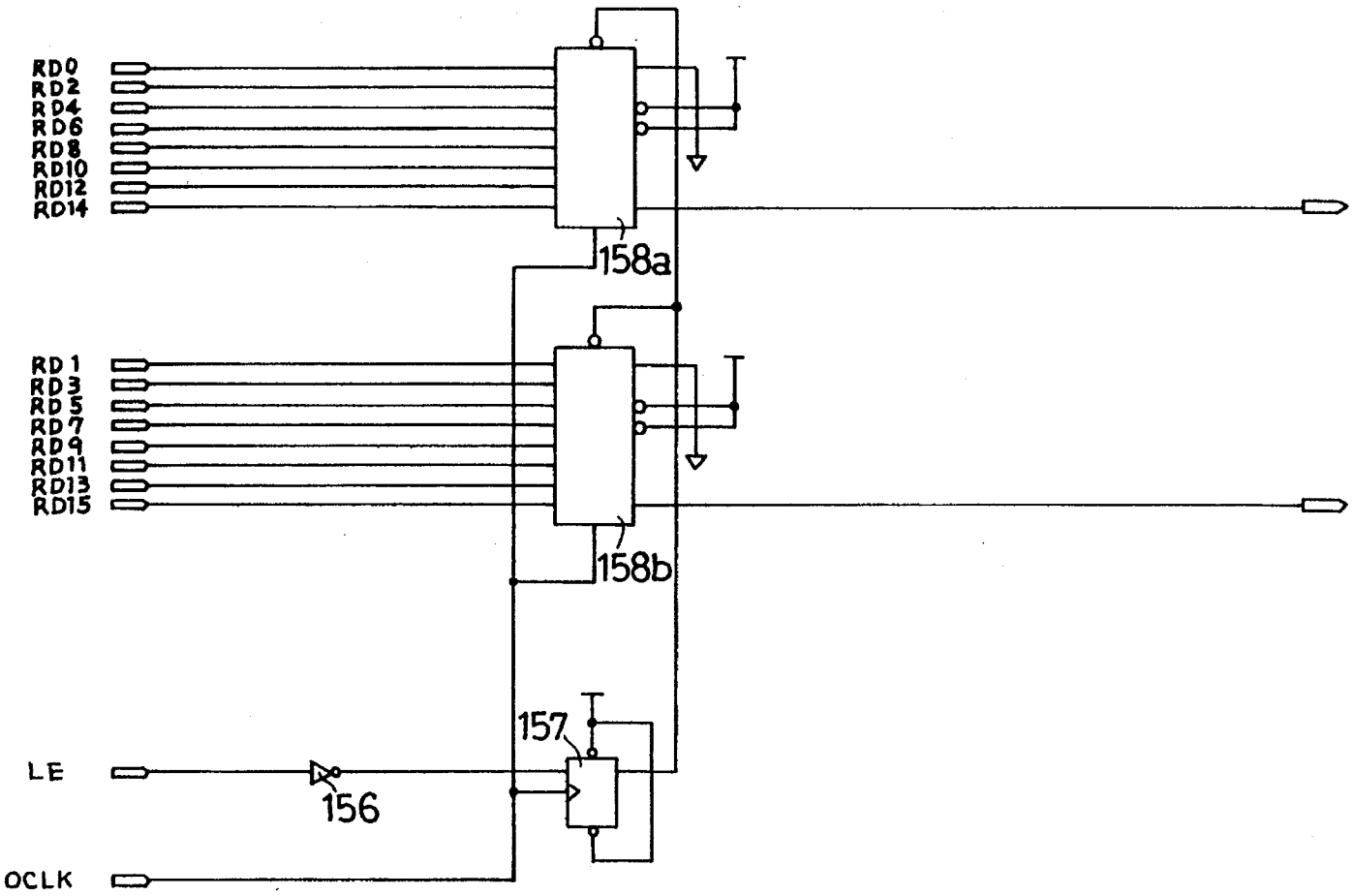
FIG. 50 is a circuit diagram showing the specific structure of a display output circuit for the FLCD having 1024×1024 pixels according to the embodiment of the present invention.

FIG. 50 shows the specific structure of the display output circuit 48. More specifically, the display output circuit 48 has a NOT gate 156, a DFF 157, and shift registers having a load function 158*a* and 158*b*.

Figure 51:
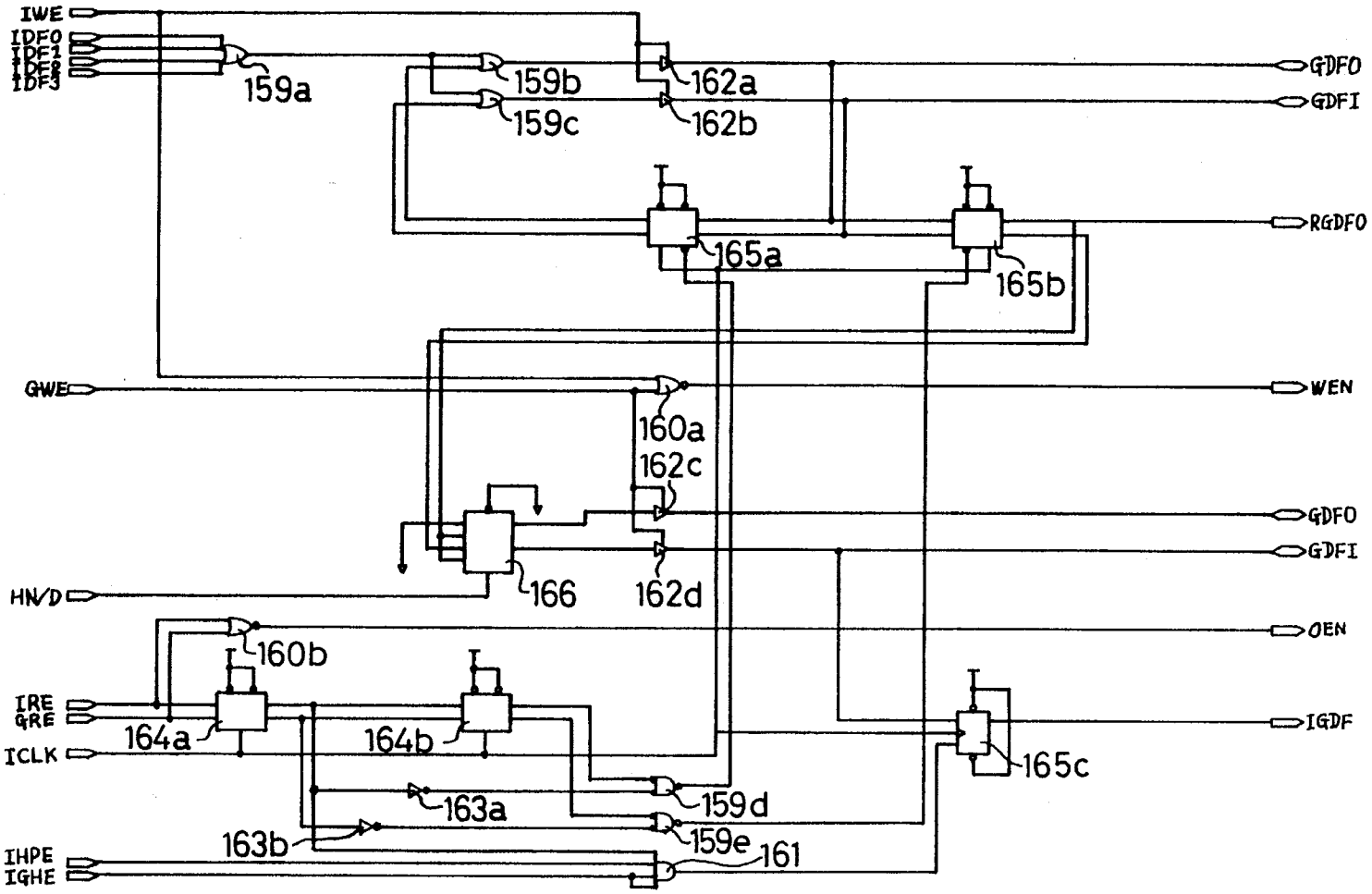
FIG. 51 is a circuit diagram showing the specific structure of an identification input circuit for the FLCD having 1024×1024 pixels according to the embodiment of the present invention.

FIG. 51 shows the specific structure of the identification input circuit 51. More specifically, the identification input circuit 51 has OR gates 159*a* to 159*e*, NOR gates 160*a* and 160*b*, an AND gate 161, ternary output buffers 162*a* to 162*d*, NOT gates 163*a* and 163*b*, DFFs 164*a* and 164*b*, ENA-DFFs 165*a* to 165*c*, and a 2-terminal selector 166.

Figure 52:
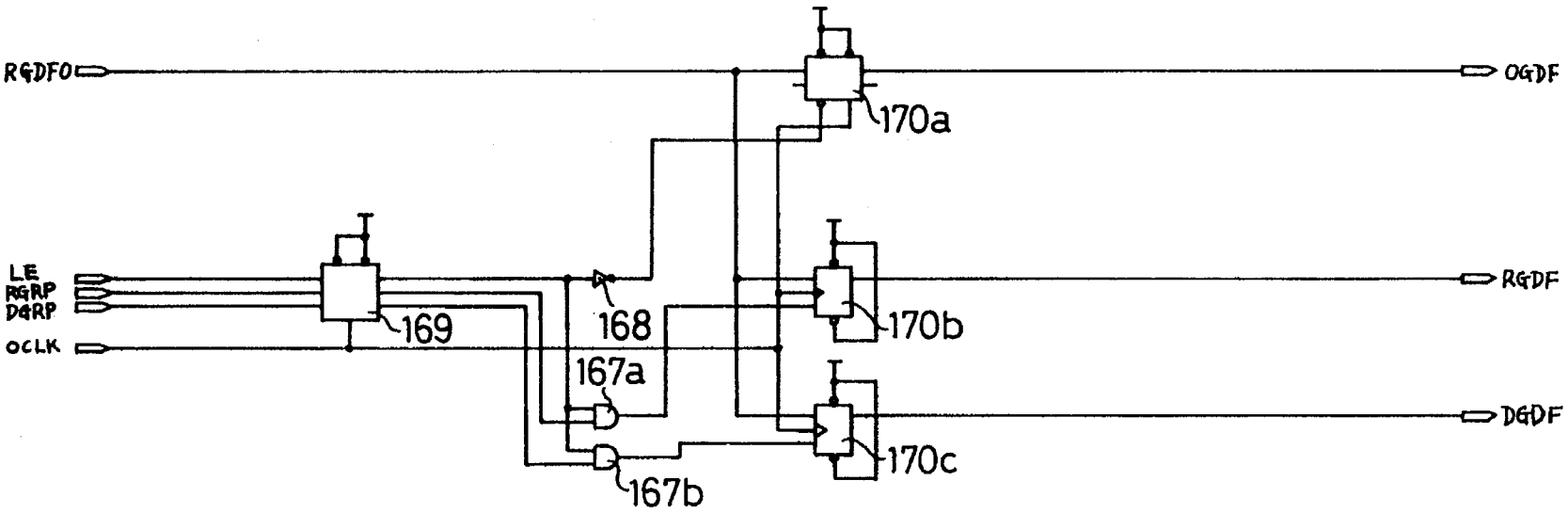
FIG. 52 is a circuit diagram showing the specific structure of an identification output circuit for the FLCD having 1024×1024 pixels according to the embodiment of the present invention.

FIG. 52 shows the specific structure of the identification output circuit 52. More specifically, the identification output circuit 52 has AND gates 167*a* and 167*b*, a NOT gate 168, a DFF 169, and ENA-DFFs 170*a* to 170*c*.

Figure 53:
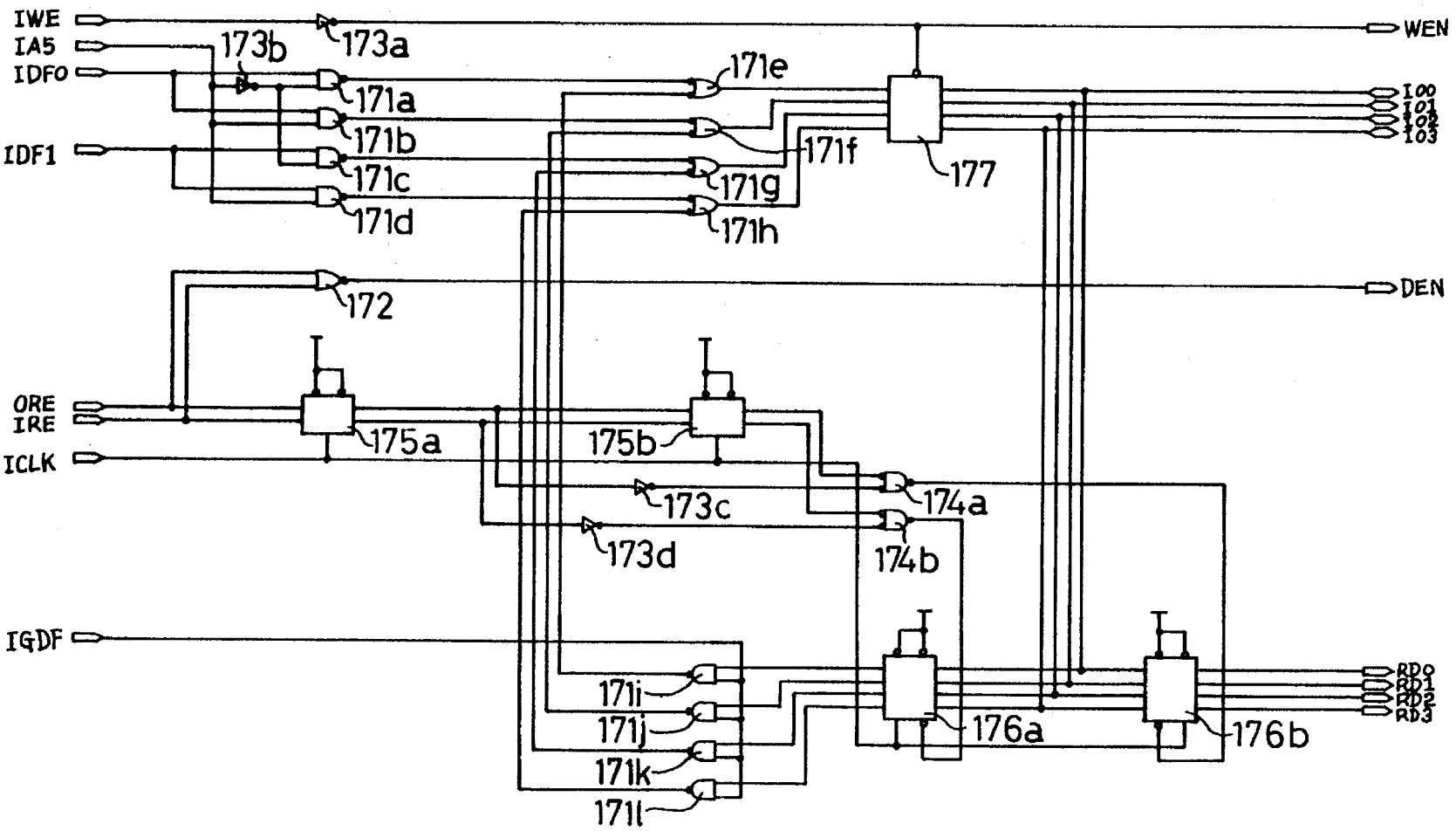
FIG. 53 is a circuit diagram showing the specific structure of an identity and difference input circuit for the FLCD having 1024×1024 pixels according to the embodiment of the present invention.

The identity and difference input circuit 55 is formed by 2 circuits, one of which is specifically shown in FIG. 53. More specifically, one of the circuits which are provided in parallel has NAND gates 171*a* to 171*l*, a NOR gate 172, NOT gates 173*a* to 173*d*, OR gates 174*a* and 174*b*, DFFs 175*a* and 175*b*, ENA-DFFs 176*a* and 176*b*, and a ternary output buffer 177.

Figure 54:
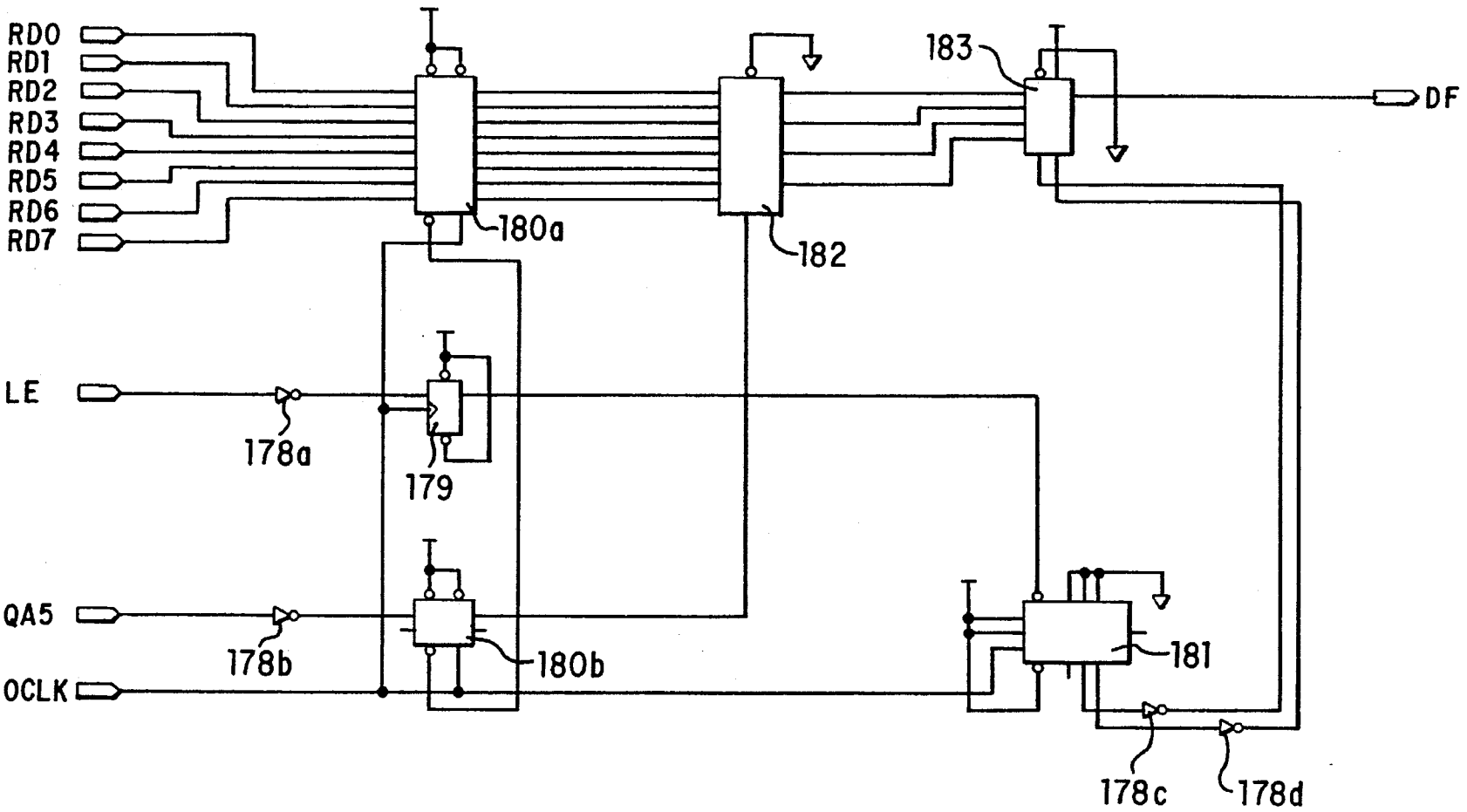
FIG. 54 is a circuit diagram showing the specific structure of an identity and difference output circuit for the FLCD having 1024×1024 pixels according to the embodiment of the present invention.

FIG. 54 shows the specific structure of the identity and difference output circuit 56. More specifically, the identity and difference output circuit 56 has NOT gates 178*a* to 178*d*, a DFF 179, ENA-DFFs 180*a* and 180*b*, a counter 181, a 2-terminal selector 182, and a 4-terminal selector 183.

The operation of the drive control circuit 38 has been described in detail in the description of the operation of the drive control circuit 21. Since the structures of the drive signal circuit 57 and drive voltage circuit 59 are simple, their description will be omitted. In order to create selection data YI by an output line address, it is necessary to load the complement of the output line address into a counter and to output a value.

The control circuit 32 is different from the control circuit 13 in that the AND of signals IHPE and IGHE of the control circuit 32 is a signal IGRE of the control circuit 13, the OR of signals HGW and DGW of the control circuit 13 is a signal DGWE of the control circuit 32, the OR of signals DCG and DSG of the control circuit 13 is a signal DG of the output line detecting circuit 42, and DGRP of the control circuit 32 also serves as HCK of the control circuit 13.

When the above-mentioned control circuit 32 is used to drive a scanning electrode based on the combination of voltages shown in FIG. 25 by a 16:1 jump scan driving method and then drive the next scanning electrode based on the combination of voltages shown in FIG. 24 by the driving method of FIG. 10, it takes 400μ sec per scanning electrode. However, there can be obtained an image on which a flicker is not marked.

Figure 27:
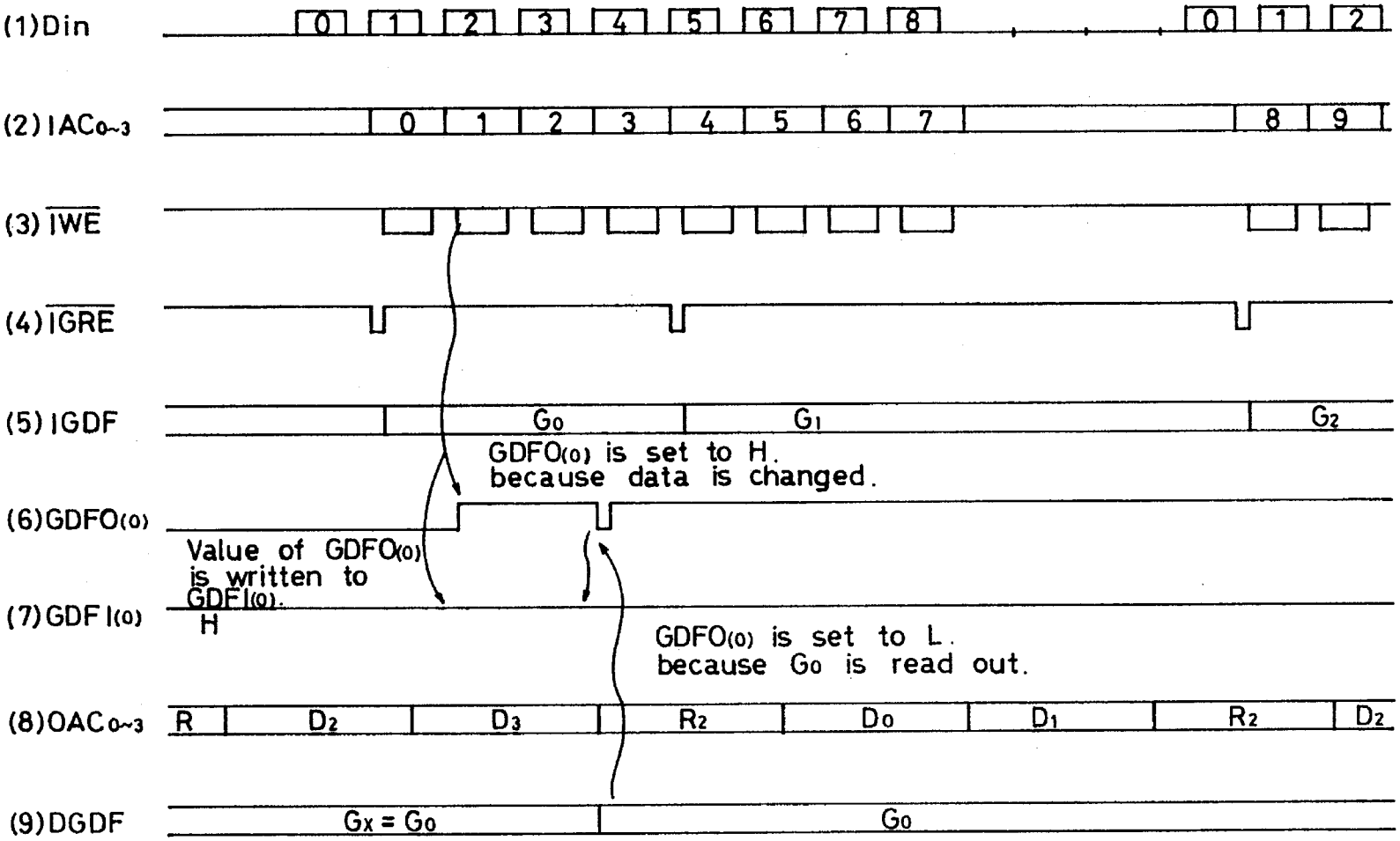
FIG. 27 is a timing chart showing an example of the distinctive operation of a display controller in accordance with the present invention.

FIG. 27 is a timing chart showing an example of the distinctive operation of the display controller 13 according to the present invention. In FIG. 27, (1) shows input data Din to be inputted to the display memory circuit iS, (2) shows an input line address IACx to be inputted to the display memory circuit 15, the identification memory circuit 16 and the identity and difference memory circuit 17, (3) shows an input side write control signal IWE- to be inputted to the display memory circuit 15, the identification memory circuit 16 and the identity and difference memory circuit 17, (4) shows a control signal IGRE- for reading out data erasing identification data IGDF from the identification memory circuit 16, (5) shows the identification data IGDF, (6) shows data selecting identification data GDFO(O) recorded in a group address G0 of the identification memory circuit 16, (7) shows data selecting identification data GDFI(O) recorded in the group address G0 of the identification memory circuit 16, (8) shows an output line address OACx to be inputted from the output control circuit 19 to the display memory circuit 15, the identity and difference memory circuit 17 and the drive control circuit 21 through the address circuit 20, and (9) shows state data DGDF for the driving method of FIG. 10 to be outputted from the identification memory circuit 16 to the drive control circuit 21.

FIG. 27 shows the case where the display "E B C D" shown in FIG. 7 is recorded in the display memory circuit 15, the data shown in FIG. 9 is recorded in the identification memory circuit 16, the data shown in FIG. 11 is recorded in the identity and difference memory circuit 17, and the input data Din is changed from "E" to "A" again while the scanning electrode group G0 is read out for the driving method of FIG. 10. This operation will be described below.

(1) Before the scanning electrodes L0 to L3 included in the scanning electrode group G0 are read out for the driving method of FIG. 10, the data selecting identification data GDFO(0) corresponding to the scanning electrode group G0 of the identification memory circuit 16 is returned to LOW.

(2) Since the input data Din has not been changed when the input line address IACx is 0, the data selecting identification data GDFO(0) corresponding to the scanning electrode group G0 is kept LOW.

(3) Since the input data Din has been changed when the input line address IACx is 1, the data selecting identification data GDFO(0) corresponding to the scanning electrode group G0 is set to HIGH again.

(4) Since data corresponding to the scanning electrode L3 has completely been read out for the driving method of FIG. 10, the data erasing identification data GDFI(0)

corresponding to the scanning electrode group G0 is brought into the same state as that of the data selecting identification data GDFO(0) after the output line address OACx=3.

(5) The data selecting identification data GDFO(O) corresponding to the scanning electrode group G0 is set to LOW at the beginning of an output line address OACx=R2.

(6) Since the input data Din has been changed when the input line address IACx is 3, the data selecting identification data GDFO(0) corresponding to the scanning electrode group G0 is set to HIGH again.

Assuming that the data erasing identification data IGDF is created from the data selecting identification data GDFO(0) when IACx is 0 as described in (2), the identity and difference data corresponding to the scanning electrode L0 of the identity and difference memory circuit 17 is brought into the state of "unchanged display" because the data erasing identification data IGDF is in the state of "unchanged display". In this case, the data of the scanning electrode L0 has completely been read out but the data of OACx=3 has not completely been read out. For this reason, the data of a change corresponding to the scanning electrode L3 of the identity and difference memory circuit 17 is erased before read out.

If the identification data IGDF is created from the data erasing identification data GDFI(0), there is eliminated a possibility that the identity and difference data DF is erased before read out. In addition, the data corresponding to the scanning electrode group G0 of the identity and difference memory circuit 17 is returned to the state of "unchanged display" after completely read out.

In case the identification memory circuit 16 has a structure shown in FIG. 9, there is a possibility that data erasing identification data GDFI(X) of a scanning electrode group Gx is always in the state of "changed display" depending on the time necessary for rewriting a scanning electrode when display data included in the scanning electrode group Gx is always changed. In this case, the data of the identity and difference memory circuit 17 cannot be returned to the state of "unchanged display".

Figure 28:
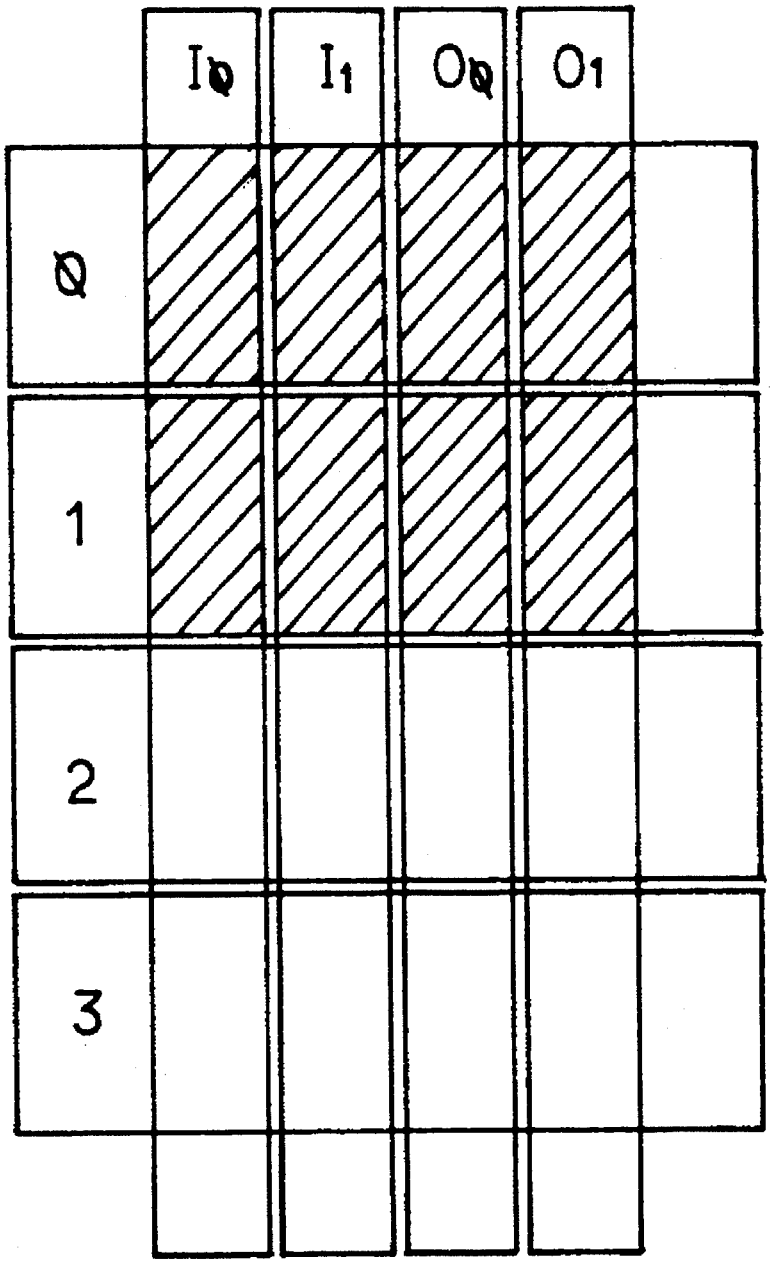
FIG. 28 is a diagram showing another example of the structure of the identification memory circuit.

As shown in FIG. 28, a scanning electrode group Gx corresponds to 4 scanning electrodes, and state data I0 and O0, and I1 and O1 correspond to each other every 2 scanning electrodes. When the change of display data is recorded, the scanning electrodes L0 and L1 are recorded on the state data I0 and O0 of a group address AG0 and the scanning electrodes L2 and L3 are recorded on the state data I1 and O1 of the group address AG0. Consequently, in case the data selecting identification data OGDF is created, the OR of the state data I0 and I1 can be used (if one of them is in the state of "changed display", there is the change of display"). In the pattern A1 shown in FIG. 15, the state data O0 can be brought into the state of "unchanged display". In the pattern C1, the state data I0 can be brought into the same state as that of the state data O0, and the state data O1 can be brought into the state of "unchanged display". In the pattern A2, the state data I1 can be brought into the same state as that of the state data O1. More specifically, if the identification memory circuit 16 has a structure shown in FIG. 28, there is increased a probability that the data of the identity and difference memory circuit 17 is returned to the state of "unchanged display" as compared with the case where the identification memory circuit 16 has the structure shown in FIG. 9.

Figure 29:
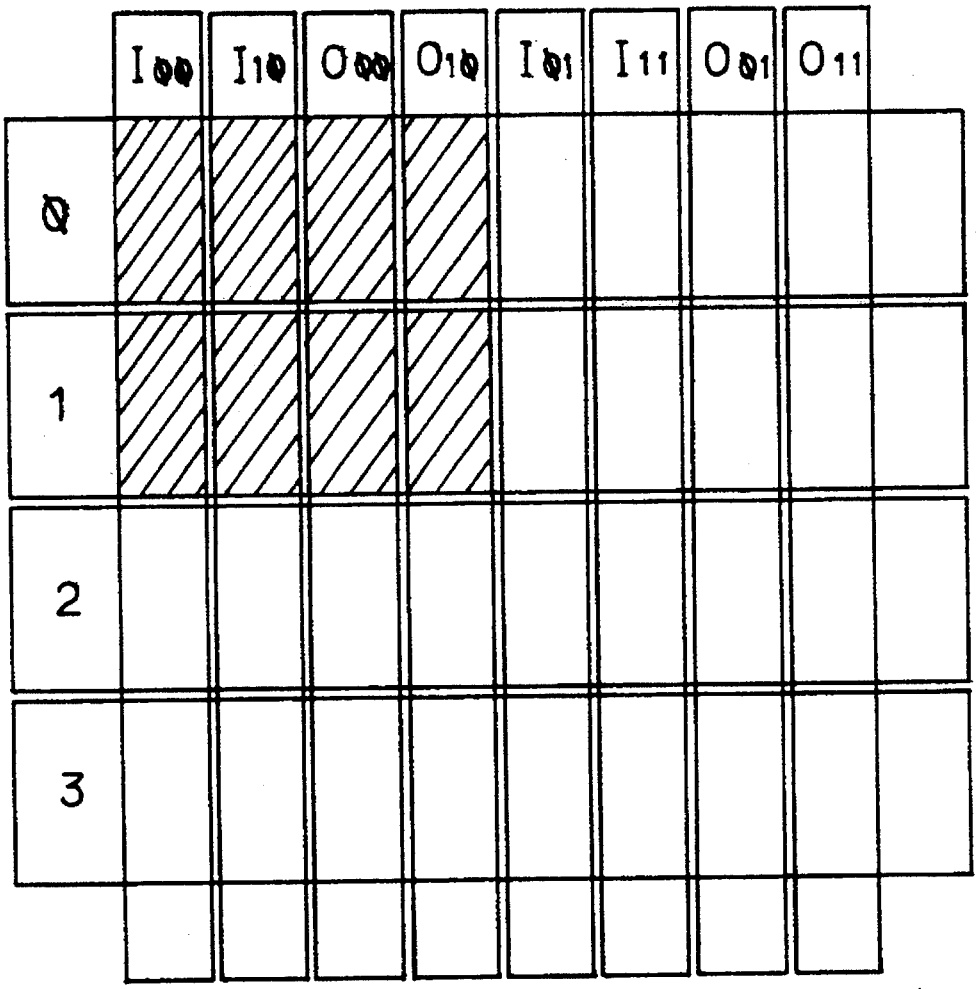
FIG. 29 is a diagram showing a further example of the structure of the identification memory circuit.

As shown in FIG. 29, furthermore, a scanning electrode group Gx can correspond to 4 scanning electrodes, addresses ASx=0 to 7 can be distinguished from addresses ASx=8 to F every 2 scanning electrodes, and state data I00 and O00, IO1 and O01, I10 and O10, and I11 and O11 can correspond to each other, respectively. In this case, if the identification memory circuit 16 has a structure shown in FIG. 29, there is further increased a probability that the data of the identity and difference memory circuit 17 is returned to the state of "unchanged display" as compared with the case where the identification memory circuit 16 has the structure shown in FIG. 28.

According to the present invention, there are data selecting and erasing identification data. Consequently, while the change of display is not completely read out in a display controller for a liquid crystal panel in which a scanning electrode is selected to rewrite pixels, data on the change of display cannot be erased.

What is claimed is:

1. A display controller for a liquid crystal panel structure, said panel structure including a liquid crystal provided in spaces between a plurality of scanning electrodes and a plurality of signal electrodes crossing over each other, and pixels formed of liquid crystal cells provided by overcrossings of the scanning and signal electrodes for displaying various images by changes of states of pixels, said display controller comprising:

display data storage means for storing data on a state of a pixel as display data for each pixel;

identity/non-identity data storage means for storing data, as identity/non-identity discerning data, on whether a difference takes place between a pixel state to be displayed and a pixel state presently displayed for each pixel group which includes a plurality of pixels;

identification data storage means for storing data, as identification data, on whether a pixel is included whose state to be displayed differs from a state presently displayed for each scanning electrode group which includes a plurality of scanning electrodes;

wherein said identification data storage means includes two memory parts:

data erasing memory part for storing data for rewriting a data value stored in the identity/non-identity data storing means to a data value indicating no change in display, and data selecting memory part for storing data for determining which scanning electrode group is scanned in a subsequent process; and further wherein said identification data storage means is a line-memory having a two-bit structure.

2. A display controller according to claim 1, further comprising:

means for rewriting a data value stored in said data selecting memory part to a value indicating no change in display before the scanning electrode group is scanned which has a data value indicating a change in display;

means for writing data which indicates no change in display or change in display into the data selecting memory part for each group of scanning electrodes while said scanning electrode group is scanned; and means for rewriting the data value stored in the data erasing memory part to the same data value as the data stored in the data selecting memory part after the scanning electrode group is scanned.

3. The display controller of claim 4, wherein the identity/non-identity data storage means stores data, as identity/non-identity discerning data, on whether a difference takes place between a pixel state to be displayed and a pixel state presently displayed for each pixel group which includes four pixels.

4. The display controller of claim 1, wherein the identification data storage means stores data, as identification data, on whether a pixel is included whose state to be displayed differs form a state presently displayed for each scanning electrode group which includes four scanning electrodes.

5. The display controller of claim 1, further comprising:

means for changing data GDFO stored in the line memory to "0" immediately before a scanning electrode is scanned, and for equalizing other data GDFI in the line memory to the value of the data GDFO after the scanning electrode has been scanned.

* * * * *